US011660658B2

(12) United States Patent
Gostylla et al.

(10) Patent No.: US 11,660,658 B2
(45) Date of Patent: May 30, 2023

(54) FASTENER MAGAZINES, AND RELATED SUPPLY SYSTEMS AND METHODS

(71) Applicant: Atlas Copco IAS UK Limited, Flintshire (GB)

(72) Inventors: Wojciech Gostylla, Flintshire (GB); Stuart Edmund Blacket, Flintshire (GB)

(73) Assignee: Atlas Copco IAS UK Limited, Flintshire (GB)

( * ) Notice: Subject to any disclaimer, the term of this patent is extended or adjusted under 35 U.S.C. 154(b) by 234 days.

(21) Appl. No.: 16/770,094

(22) PCT Filed: Dec. 5, 2018

(86) PCT No.: PCT/GB2018/053524
§ 371 (c)(1),
(2) Date: Jun. 5, 2020

(87) PCT Pub. No.: WO2019/110990
PCT Pub. Date: Jun. 13, 2019

(65) Prior Publication Data

US 2020/0346277 A1 Nov. 5, 2020

(30) Foreign Application Priority Data

Dec. 5, 2017 (GB) ..... 1720275

(51) Int. Cl.
*B21J 15/32* (2006.01)
*B21J 15/02* (2006.01)
*B21J 15/14* (2006.01)

(52) U.S. Cl.
CPC ..... *B21J 15/32* (2013.01); *B21J 15/025* (2013.01); *B21J 15/14* (2013.01); *Y10T 29/49943* (2015.01); *Y10T 29/49956* (2015.01)

(58) Field of Classification Search
CPC ..... B25J 15/025; B25J 15/14; B25J 15/32; Y10T 29/49956; Y10T 29/49943; B21J 15/025; B21J 15/14; B21J 15/32
See application file for complete search history.

(56) References Cited

U.S. PATENT DOCUMENTS 1,839,490 A 1/1932 Moeller
2,186,841 A 1/1940 Rylander
(Continued)

FOREIGN PATENT DOCUMENTS

CN 102873440 B 11/2014
CN 105665607 A 6/2016
(Continued)

OTHER PUBLICATIONS

Henrob, "Innovative Joining Solutions," brochure publicly available at least as early as Nov. 25, 2020 (2 pages).
(Continued)

*Primary Examiner* — Jermie E Cozart
(74) *Attorney, Agent, or Firm* — Michael Best & Friedrich LLP

(57) ABSTRACT

A rivet supply system supplies rivets to a rivet setting tool comprising a punch, an extendable nose arrangement and a die, and comprises at least one rivet delivery track for delivering the rivets to the nose arrangement, at least one rivet transfer device for holding or releasing the rivets received at the rivet-receiving zone, and at least one refillable magazine for storing the rivets in proximity of the setting tool. The magazine comprises a magazine portion of the rivet delivery track, wherein the rivets can be stored within the magazine, or can transit through the magazine to be delivered to the setting tool. The magazine also comprises at least one docking interface for refilling the magazine from for example a bulk feeder. The magazine is in rivet-supply relation with the nose arrangement so that it can supply
(Continued)

rivets to the setting tool, and is moveable together with the nose arrangement.

14 Claims, 41 Drawing Sheets

(56) References Cited

U.S. PATENT DOCUMENTS

| | | | |
|---|---|---|---|
| 2,366,448 | A | 1/1945 | Greene et al. |
| 2,611,911 | A | 9/1952 | Graham et al. |
| 2,689,589 | A | 9/1954 | Allen et al. |
| 2,766,763 | A | 10/1956 | Shough |
| 2,978,937 | A | 4/1961 | Reynolds et al. |
| 3,868,148 | A | 2/1975 | Schultz |
| 4,184,357 | A | 1/1980 | Stubbings |
| 4,278,194 | A | 7/1981 | Ersoy |
| 4,705,201 | A | 11/1987 | Bennett |
| 4,815,343 | A | 3/1989 | Sofinowski |
| 4,830,547 | A | 5/1989 | Boob et al. |
| 5,054,649 | A | 10/1991 | Lemaire et al. |
| 5,142,774 | A | 9/1992 | Jeffrey |
| 5,172,467 | A | 12/1992 | Muller |
| 5,291,645 | A | 3/1994 | Aoyama |
| 5,385,434 | A | 1/1995 | Quinn et al. |
| 5,465,868 | A | 11/1995 | Bonomi |
| 5,566,446 | A | 10/1996 | Luckhardt et al. |
| 5,620,520 | A | 4/1997 | Duffy et al. |
| 5,697,521 | A | 12/1997 | Dixon |
| 5,733,089 | A | 3/1998 | Albright |
| 5,813,114 | A | 9/1998 | Blacket et al. |
| 6,145,726 | A | 11/2000 | Hoof |
| 6,253,448 | B1 | 7/2001 | Zieve et al. |
| 6,260,734 | B1 | 7/2001 | Auriol et al. |
| 6,328,180 | B1 | 12/2001 | Sorensen et al. |
| 6,949,057 | B2 | 9/2005 | Everson et al. |
| 6,951,298 | B1 | 10/2005 | Coglet et al. |
| 6,964,094 | B2 | 11/2005 | Kondo |
| 6,986,440 | B2 | 1/2006 | Ammond et al. |
| 7,458,244 | B2 | 12/2008 | Dehike et al. |
| 7,810,231 | B2 | 10/2010 | Naitoh |
| 7,849,579 | B2 | 12/2010 | Craythorn et al. |
| 8,141,761 | B2 | 3/2012 | Draht et al. |
| 8,690,037 | B2 | 4/2014 | Wenzel et al. |
| 8,695,187 | B2 | 4/2014 | Schmidt |
| 8,800,409 | B1 | 8/2014 | Wuester et al. |
| 9,120,214 | B2 | 9/2015 | Vandenberg |
| 9,162,277 | B2 | 10/2015 | Flis et al. |
| 9,387,557 | B2 | 7/2016 | Doo et al. |
| 9,409,227 | B2 | 8/2016 | Ivo et al. |
| 9,610,632 | B2 | 4/2017 | Schug et al. |
| 2004/0217144 | A1 | 11/2004 | Matthews et al. |
| 2005/0051569 | A1 | 3/2005 | Ammond et al. |
| 2005/0121015 | A1 | 6/2005 | Postorivo, Jr. |
| 2007/0289354 | A1 | 12/2007 | Reiter |
| 2009/0279991 | A1 | 11/2009 | Dehlke |
| 2011/0252927 | A1 | 10/2011 | Ota et al. |
| 2011/0289769 | A1 | 12/2011 | Skolaude |
| 2011/0290848 | A1 | 12/2011 | Wenzel et al. |
| 2012/0017728 | A1 | 1/2012 | Schmidt |
| 2012/0067176 | A1 | 3/2012 | Ota et al. |
| 2012/0301262 | A1 | 11/2012 | Ivo et al. |
| 2013/0071209 | A1 | 3/2013 | Schug et al. |
| 2014/0076913 | A1 | 3/2014 | Neumeier et al. |
| 2015/0184689 | A1 | 7/2015 | Godfrey et al. |
| 2017/0072521 | A1 | 3/2017 | Munstermann et al. |
| 2019/0184504 | A1 | 6/2019 | Wilkins et al. |
| 2020/0215601 | A1 | 7/2020 | Kecici |

FOREIGN PATENT DOCUMENTS

| | | | |
|---|---|---|---|
| DE | 2826418 | A1 | 7/1981 |
| DE | 3301243 | A1 | 7/1984 |
| DE | 3503408 | A1 | 8/1986 |
| DE | 3930999 | A1 | 3/1991 |
| DE | 4310953 | A1 | 10/1994 |
| DE | 19538812 | A1 | 6/1996 |
| DE | 19700271 | A1 | 9/1997 |
| DE | 19731344 | A1 | 12/1998 |
| DE | 19756798 | A1 | 6/1999 |
| DE | 19842103 | A1 | 3/2000 |
| DE | 19545672 | C2 | 8/2001 |
| DE | 10064241 | A1 | 7/2002 |
| DE | 102004011846 | A1 | 9/2004 |
| DE | 10335085 | A1 | 2/2005 |
| DE | 202005018786 | U | 3/2006 |
| DE | 102005015032 | A1 | 10/2006 |
| DE | 102009013725 | A1 | 9/2010 |
| DE | 102009040764 | A1 | 3/2011 |
| DE | 102011103332 | A1 | 11/2012 |
| DE | 102011105841 | A1 | 12/2012 |
| DE | 102014011608 | A1 | 3/2015 |
| DE | 102013000799 | B4 | 5/2015 |
| DE | 102015216093 | A1 | 3/2017 |
| DE | 102016224559 | A1 | 6/2018 |
| EP | 0511093 | A1 | 10/1992 |
| EP | 3536779 | A1 | 4/1993 |
| EP | 0703037 | A1 | 3/1996 |
| EP | 0633825 | B1 | 4/1997 |
| EP | 0813463 | B1 | 1/2005 |
| EP | 1270113 | B1 | 12/2006 |
| EP | 1759785 | B1 | 12/2008 |
| EP | 1690613 | B1 | 6/2010 |
| EP | 2308613 | A1 | 4/2011 |
| EP | 2754512 | B1 | 9/2015 |
| EP | 3141318 | A1 | 3/2017 |
| EP | 3308905 | A1 | 4/2018 |
| FR | 2896173 | A1 | 7/2007 |
| GB | 530563 | A | 12/1940 |
| GB | 1248411 | A | 10/1971 |
| GB | 1303572 | A | 1/1973 |
| GB | 2456560 | A | 7/2009 |
| JP | S6026520 | A | 2/1985 |
| JP | S60137715 | A | 7/1985 |
| JP | H0616225 | A | 1/1994 |
| JP | H0624416 | A | 2/1994 |
| JP | H10291131 | A1 | 11/1998 |
| JP | 2012528730 | A | 11/2012 |
| JP | 2014515993 | A | 7/2014 |
| WO | 8404710 | A1 | 12/1984 |
| WO | 1994000257 | A1 | 1/1994 |
| WO | 9528242 | A1 | 10/1995 |
| WO | 9748510 | A1 | 12/1997 |
| WO | 0007751 | A1 | 2/2000 |
| WO | 2006103263 | A1 | 10/2006 |
| WO | 2007132195 | A1 | 11/2007 |
| WO | 2010041018 | A1 | 4/2010 |
| WO | 2014009753 | A1 | 1/2014 |
| WO | 2016193140 | A1 | 12/2016 |
| WO | 2017094324 | A1 | 6/2017 |

OTHER PUBLICATIONS

Atlas Copco, "Self-Pierce Riveting Equipment Guide: Servo Systems," brochure publicly available at least as early as Nov. 25, 2020, pp. 1, 6, 7, 9, and 20 (5 pages).

Henrob, "Self-pierce Riveting Products," brochure publicly available at least as early as Nov. 25, 2020, pp. 1 and 16 (2 pages).

International Preliminary Report on Patentability for Application No. PCT/GB2018/053524 dated Jun. 9, 2020 (12 pages).

Search Report issued by the United Kingdom Intellectual Property Office for Application No. 1720275.5 dated May 31, 2018 (5 pages).

International Search Report and Written Opinion for Application No. PCT/GB2018/053524 dated Jun. 7, 2019 (22 pages).

Search Report issued by the United Kingdom Intellectual Property Office for Application No. 1720275.5 dated Apr. 26, 2019 (3 pages).

Japanese Patent Office Notice of Reasons for Rejection for Related Application No. 2020531632 dated Oct. 18, 2022 (16 pages, including an English translation).

Japanese Patent Office Notice of Reasons for Refusal for Related Application No. 2020531570 dated Oct. 4, 1011 (4 pages, including an English translation).

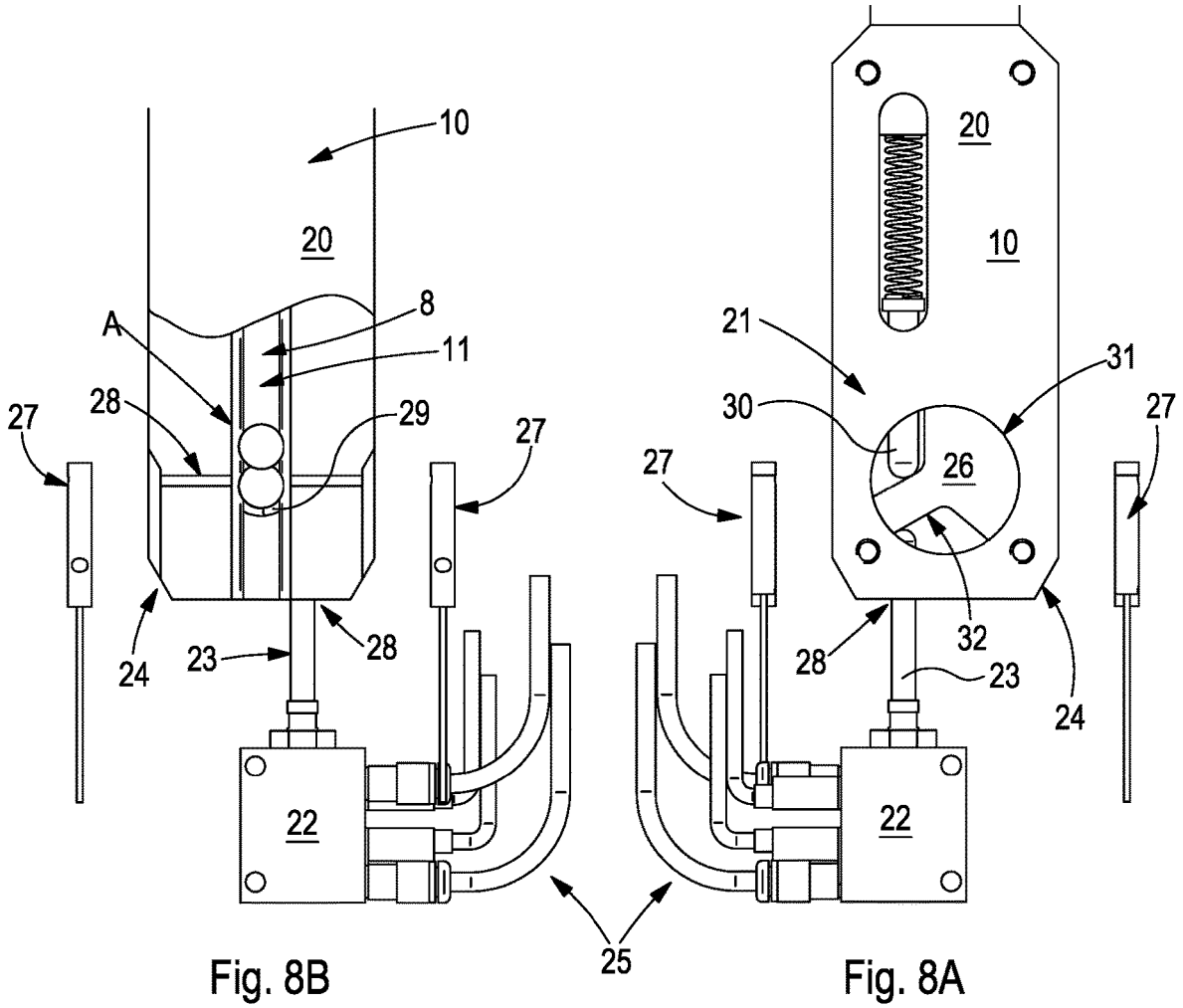
Fig. 8B
Fig. 8A
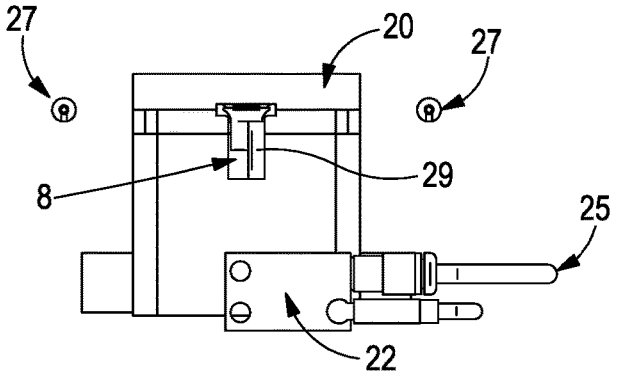
Fig. 8C

FASTENER MAGAZINES, AND RELATED SUPPLY SYSTEMS AND METHODS

CROSS REFERENCE TO RELATED APPLICATIONS

This application is a U.S. National phase application of International Application No. PCT/GB2018/053524 filed Dec. 5, 2018, which claims priority to Application No. GB 1720275.5 filed Dec. 5, 2017, the entire contents of both of which are incorporated by reference herein.

RELATED APPLICATIONS

The present application is being filed on the same date as applications titled "Nose Arrangements for Fastener Setting Machines, and Related Methods" (GB1720277.1) and "Fastener Handling Devices for Fastener Setting machines, and Related Methods" (GB1720248.2), the contents of which are fully incorporated herein by reference.

TECHNICAL FIELD

The present application relates to magazines for supplying fasteners such as rivets to a rivet setting tool. The present application also relates to systems for supplying rivets to a setting tool, the systems including one or more rivet magazines, and to related methods. In particular, the present application relates to magazines, systems and methods for supplying self-piercing rivets. More particularly, the present application relates to magazines, systems and methods of the type used for supplying rivets and/or self-piercing rivets to a setting tool having a nose arrangement and a punch for setting the rivets, the setting tool being mounted on a support such as a C-frame. The C-frame may be mounted on a movable arm, such as a robotic arm. These magazines store the fasteners in proximity of the setting tool, in readiness for any setting operations carried out by the setting tool. Although the focus of the present disclosure is on rivets (and, in particular, on self-piercing rivets), certain aspects are instead readily applicable to fasteners more generally, as it will be appreciated from the detailed description set out below.

BACKGROUND

Various systems and methods for setting fasteners such as rivets and self-piercing rivets are known which use a bulk-supply apparatus to supply the rivets to a setting tool. In some systems, the setting tool comprises a nose arrangement and a punch for setting the rivets. The setting tool is mounted on a support structure such as a C-frame. The C-frame can be mounted on a robotic arm so that a number of automatic operations can be carried out by the robot at the required locations.

The nose arrangement is generally disposed under the punch, and guides the punch and the rivets during a setting operation.

A die assembly is also usually provided on the support structure, opposite the nose arrangement, to react the force applied by the punch to the workpiece during a setting operation. In this way, the workpiece is sandwiched between the nose arrangement and the die assembly during a setting operation, and the punch is operated to set the rivet.

Systems of the type described herein typically feed the rivets to the nose arrangement through suitably profiled flexible delivery tubes. The rivets can thus be delivered to the setting tool by means of compressed air, and/or gravity.

The rivets are supplied singularly or in groups, and generally therefore require one or more rivet handling mechanisms along the supply lines so that only the required rivet or rivets are supplied when necessary. These mechanisms generally involve some form of mechanical interaction with the rivets, and this may happen at various stages along the path of the rivets from the bulk-supply apparatus to the setting tool.

The flexible delivery tubes may be connected to one or more magazines to locally store, closer to the setting tool, up to a predetermined number of rivets in readiness for installation. It is known to provide some sort of removable, replaceable magazines to simplify the supply operations. However, several problems are associated with the systems of the prior art.

The rivets, for example, are susceptible to jamming in the flexible delivery tubes due to ingress of dust or dirt, due to any portions of the flexible tubes presenting high curvature, or due to wear and tear of the tubes themselves. The flexible delivery tubes, for these very reasons, may require frequent replacement and this may cause unwanted downtime.

Further, the flexible delivery tubes may require a certain working envelope to operate flexibly, and this may necessitate special considerations about how to mount the setting tool on the robotic arm.

As a result, the systems of the prior art may operate not completely satisfactorily, and/or, at the very least, may lack the desired compactness.

It is therefore desirable to minimise, or do away with, the flexible delivery tubes.

It is also desirable to transfer the rivets with the least amount of disruption possible along the rivet supply lines.

It is also desirable to maintain the rivets on their path without dislocation.

It is also desirable to move the rivets seamlessly, so that they can, for example, be gently brought to a halt, and restarted, as and when necessary, along the rivet supply line.

If all the various communicating rivet-supply components in the rivet supply line are connected, and open to the transit of the rivets, it would be desirable to transfer the rivets to the nose arrangement in a continuous (ie uninterrupted), yet reliable, fashion.

There is accordingly also a desire to do away with any potential catch points for the rivets, especially in the above mentioned 'open' conditions.

When the rivets are supplied from the bulk-supply apparatus to the magazine, they typically pass through a docking interface that allows the magazine to be refilled when empty. The magazine may thus require a gate to open during the docking and/or loading operation, and close when full, to prevent any rivets from falling out, and to seal the magazine end, so that a compressed air source can then be coupled to the magazine to provide a rivet motive force, when required. Such gates are complex, particularly when the system is designed to operate under the motive force of compressed air, and may add considerable cycle time, and cost, to the operations.

It is also desirable to provide an improved design of magazine which does away with, or that at least reduces, any sealing requirements and/or which may work equally adequately under pressure or suction, or at atmospheric pressure.

There is accordingly also a desire to provide a rivet supply line, or at least a portion thereof, that can be effortlessly, or at least advantageously, sealed against air leakage and/or dust ingress.

After the rivets have completed their path through the rivet supply system, a rivet transfer system is typically provided to transfer the rivets to a stand-by position under the punch, in readiness for the setting operations. The transfer system may involve direct transfer by gravity, air propulsion, a mechanical pusher or probe and/or a dedicated transfer mechanism that traps and senses the rivets presence. Such a dynamic delivery of the rivets from the rivet supply system to the stand-by position is generally problematic in terms of rivet stability, dust ingress and sensing, and typically requires a number of moving mechanical parts that may also suffer wear and tear. This is undesirable, as it may lead to faults or can constitute another source of downtime.

It is therefore also desirable to improve the rapidity, efficiency and/or reliability of the transfer of the fasteners to the stand-by position, under the punch, in readiness for installation.

Known rivet supply systems and methods have only limited capabilities to handle different types of rivets and/or different sizes thereof.

It is thus also desirable to provide magazines, rivet delivery systems and methods which can simultaneously or interchangeably handle a variety of rivet types and/or sizes to provide maximised flexibility and customisation potential for the end user.

It is also, more generally, desirable to reduce the number of moving parts in the systems in question.

It is also, more generally, desirable to improve the performance of the systems referred to herein with respect to the prior art.

SUMMARY

According to an aspect of the present disclosure, there is provided a rivet supply system for supplying rivets to a rivet setting tool comprising a punch for setting the rivets, a nose arrangement defining at least one rivet-receiving zone for receiving the rivets in preparation for setting operations, and a die provided opposite the nose arrangement for reacting the punch, the nose arrangement being movable towards the die to engage with a workpiece, the rivet supply system comprising:

- at least one rivet delivery track for delivering the rivets to the rivet-receiving zone;
- at least one rivet transfer device for holding or releasing the rivets received at the rivet-receiving zone;
- at least one refillable magazine for storing the rivets in proximity of the setting tool,
- the magazine comprising at least a magazine portion of said rivet delivery track, wherein the rivets can be stored within the magazine, or can transit through the magazine,
- the magazine comprising at least one docking interface for docking the magazine to a bulk-supply apparatus for refilling the magazine,
- wherein the magazine is in rivet-supply relation with the nose arrangement and is supported so as to be moveable together with the nose arrangement; and,
- wherein a substantially undeformable rivet delivery track length extends to said rivet-receiving zone.

Therefore, the rivet supply system minimizes or does away with any lengths of flexible feed tubing.

Where it is said that at least one rivet transfer device is for holding or releasing (or configured to hold or release) the rivets received at the rivet-receiving zone, the at least one rivet transfer device may be configured to hold, and subsequently release, the rivets received at the rivet-receiving zone;

The rivet-receiving zone refers to a zone in which a rivet awaits transfer under the punch in preparation for a setting operation.

The delivery track (and hence rivet delivery track length) is upstream of the rivet-receiving zone. The rivet transfer device is upstream of the rivet-receiving zone.

Optionally the magazine further comprises the rivet transfer device. Optionally the rivet transfer device is disposed at a distal end of the magazine.

The rivet supply system may be adapted to be operated by gravity.

The rivet supply system may be adapted to be operated by suction generated by a vacuum pump.

The docking interface may comprise an inlet for receiving the rivets which is fluidly open to atmosphere.

The magazine may be removably supported on the setting tool and/or on a C-frame that supports the setting tool.

The magazine may be replaceably supported such that a replacement magazine can replace said replaceable magazine.

The magazine may otherwise be permanently installed on the setting tool.

The system may comprise two such magazines and two such undeformable lengths disposed in mirror configuration on opposed sides of the setting tool.

Each magazine may comprise a first elongated body part extending generally parallel to an axial direction defined by the punch and/or the setting tool.

Each magazine may comprise a second elongated body part disposed downstream of the first elongated body part and angled towards said nose arrangement.

Said first and/or second elongated body parts may comprise at least a portion of said undeformable rivet delivery track length.

The first elongated body part of the magazine and/or the magazine portion of the rivet delivery track may be substantially parallel to said axial direction.

The rivet supply system may further comprise a chute, the chute comprising a chute portion of the rivet delivery track which comprises at least part of said substantially undeformable rivet delivery track length, wherein the magazine is in rivet-supply relation with the nose arrangement via said chute.

The magazine may be directly coupled to the chute.

The magazine and the chute may be coupled via a flexible feed tube.

The magazine may be pivotally supported on the setting tool.

The magazine may comprise multiple independent magazine portions of the rivet delivery track.

The multiple rivet delivery track portions may be selectable for supplying the rivets to the rivet-receiving zone according to corresponding angular orientations of the magazine on the setting tool.

At least one of the multiple rivet delivery track portions may have a curved longitudinal extension to facilitate the refilling of the rivets into the magazine and/or the supply of the rivets from the magazine to rivet receiving zone in the nose arrangement.

At least two of the multiple rivet delivery track portions may be provided with said curved longitudinal extension.

The respective curves may define opposed concavities that tend to converge towards a pivot of the magazine.

The pivot may be generally located at a centre of the magazine.

The magazine may comprise three of said multiple rivet delivery track portions.

The three portions may comprise a first straight portion extending substantially longitudinally. The second and third portions may have said curved longitudinal extensions. The second and third portions may be disposed on either side of the first portion.

The magazine may comprises two or more rivet handling devices each associated with one of said multiple magazine rivet delivery track portions for selectively stopping, trapping and/or releasing one or more rivets on the respective magazine portion of the rivet delivery track.

The rivet handling devices may be disposed at a distal end of the magazine.

The rivet handling devices may each be in the form of an actuated in-line rivet selection device.

The actuated in-line rivet selection device may comprise a rotary cam escapement for selectively stopping, trapping and/or releasing one or more rivets on the respective magazine portion of the rivet delivery track based on a rotation angle of the rotary cam escapement.

The rotary cam escapement may comprise a rotatable cam member for selectively stopping, trapping and/or releasing one or more rivets on said respective magazine portion of the rivet delivery track based on a rotation angle of said rotatable cam member.

The rotatable cam member may comprise an arcuate cam.

The actuated in-line rivet selection devices may be each resiliently biased to a default configuration.

The default configuration may optionally be a default rotary configuration of the rotary cam escapement and/or of the rotatable cam member, for stopping and/or trapping the rivets on said respective magazine portion of the rivet delivery track.

Each rivet handling device may be generally disposed at a distal end of the magazine.

Each rivet handling device may be configured to be actuated via an actuated pin mechanism disposed on said chute.

The actuated pin mechanism may be received on corresponding one or more apertures also provided at the distal end of the magazine.

The actuated pin mechanism may be configured to register the magazine in place according to a predetermined angular orientation.

The actuated pin mechanism may be configured to actuate the rivet handing device.

The magazine may comprises at least one rivet handling device associated with the magazine portion of the rivet delivery track for selectively stopping, trapping and/or releasing one or more rivets.

The one or more rivets may be stopped, trapped and/or released on said rivet delivery track portion.

The rivet handling device may be located at a distal end of the magazine.

The rivet handling device may be in the form of an active in-line rivet selection device.

The active in-line rivet selection device may be as described hereinabove.

The active in-line rivet selection device may be resiliently biased to a default configuration.

The default configuration may be a default rotary configuration of the rotary cam escapement and/or of the rotatable cam member and/or of the arcuate cam, for stopping and/or trapping one or more rivets.

The rivet handling device may be generally disposed at a distal end of the magazine.

The rivet handling device may be configured to be actuated via an actuated pin mechanism disposed on said chute and received on a corresponding aperture also provided at the distal end of the magazine.

The actuated pin mechanism may be configured to register the magazine in place.

The actuated pin mechanism may be configured to actuate the rivet handing device.

The rivet handling device may be disposed part-way along the magazine portion of the rivet delivery track.

The system may comprise two or more independent magazine portions of the rivet delivery track.

Two or more independent rivet handling devices may be associated one with each of the two or more magazine portions of the rivet delivery track for selectively stopping, trapping and/or releasing one or more rivets.

The one or more rivets may be stopped, trapped and/or released on the two or more portions.

The two or more independent magazine portions of the rivet delivery tracks may be upper magazine portions.

The upper magazine portions may be configured to supply rivets to a common lower segment of the rivet delivery track.

At least part of said common lower segment of the rivet delivery track may be disposed within the magazine.

The magazine may comprise an actuated track selection device for selecting one of the two or more independent upper magazine portions of the rivet delivery tracks for supplying the rivets to said common lower segment of the rivet delivery track.

The magazine may comprise a docking device disposed at the docking interface for permitting or inhibiting refilling of the rivets into the magazine from the bulk-supply apparatus.

The docking device may be a passive in-line rivet release device adapted to permit said refilling when the magazine is docked to the bulk-supply apparatus.

The docking device may be adapted to inhibit flow of refilled rivets out of the magazine when the magazine is undocked from the bulk-supply apparatus.

The passive in-line release device may comprises at least one resiliently biased jaw member disposed on a side of the magazine portion of the rivet delivery track.

The release device may be disposed at a proximal end of the rivet delivery track and/or at a proximal end of the magazine.

The passive in-line release device may comprise a pair of opposed resiliently biased jaw members.

The resiliently biased jaw members may be disposed on opposed sides of the magazine portion of the rivet delivery track.

The resiliently biased jaw members may be disposed at a proximal end of the rivet delivery track and/or of the magazine.

The system may further comprise a docking block comprising one or more delivery or feed tubes for connecting the magazine to the bulk-supply apparatus.

The docking block may be adapted to dock with said magazine via said docking interface.

The delivery or feed tubes may be flexible, rigid or semi-rigid.

The rivet transfer device may be a passive in-line rivet release device adapted to hold or release the rivet at the rivet-transfer zone. The rivet transfer device may be a passive in-line rivet release device adapted to hold, and subsequently release, the rivet at the rivet-transfer zone.

The rivet release device may comprise at least one resiliently biased jaw member as described herein. The resiliently biased jaw member may be disposed on a side of the rivet delivery track. The resiliently biased jaw member may be disposed at a distal end of the rivet delivery track.

The rivet transfer device may be in the form of an active in-line rivet selection device configured to selectively stop, trap and/or release one or more rivets at the rivet transfer zone.

The rivet selection device may comprise a linear-pin escapement.

According to an aspect of the present disclosure, there is provided a machine for setting rivets comprising the rivet supply system as described herein.

According to an aspect of the present disclosure, there is provided a method of supplying rivets to a rivet setting tool having a punch for setting the rivets, a nose arrangement defining at least one rivet-receiving zone for receiving the rivets in preparation for setting operations, and a die provided opposite the nose arrangement for reacting to the punch, the nose arrangement being movable towards the die to engage with a workpiece, the method comprising:

feeding at least one rivet through at least one rivet delivery track for delivering the rivet to the rivet-receiving zone;

holding and/or releasing the rivet at the rivet-receiving zone by means of at least one rivet transfer device;

storing and/or transiting the rivet in a refillable rivet magazine in proximity of the setting tool, the magazine comprising at least a magazine portion of said rivet delivery track, the magazine comprising at least one docking interface for docking the magazine to a bulk-supply apparatus for refilling the magazine, wherein the magazine is in rivet-supply relation with the nose arrangement and is supported so as to be moveable together with the nose arrangement;

wherein a substantially undeformable rivet delivery track length extends to the rivet-receiving zone.

According to an aspect of the present disclosure, there is provided a refillable replacement magazine for storing and supplying rivets to a rivet setting tool having a punch for setting the rivets, and a nose arrangement for receiving the rivets in preparation for setting operations, the magazine comprising:

at least one inlet for receiving the rivets disposed at a proximal end of the magazine;

at least one outlet for supplying the rivets to the nose arrangement of the setting tool, the outlet being disposed at a distal end of the magazine;

at least one rivet delivery track extending from said inlet to said outlet, wherein the rivets can be stored within the magazine, or can transit through the magazine, said rivet delivery track being substantially undeformable;

at least one docking device generally located at said proximal end of the magazine and arranged to cooperate with said inlet for refilling the magazine from a bulk-supply apparatus;

at least one rivet dispensing device for dispensing the rivets to or towards the nose arrangement through said outlet. This design of replaceable yet serviced magazine allows many control options for feeding the rivets as and when required.

The magazine may be adapted to be directly coupled to the nose arrangement.

The magazine may be adapted to be couplet to a chute.

The chute may be directly coupled to the nose arrangement.

The nose arrangement may be movable and the magazine may be adapted to be supported so as to be moveable together with the nose arrangement generally in the direction defined by the punch.

The magazine may be adapted to be supported on the setting tool and/or on a C-frame for supporting the setting tool.

The magazine may be adapted to be slidably guided within a bracket provided on, or supported by, the C-frame as the magazine moves together with the nose arrangement.

To move the rivets within the magazine, the magazine may be adapted to accept as a rivet motive force:

gravity;

and/or, suction.

The suction may be originated by a vacuum pump in fluid communication with the rivet delivery track at the distal end of the magazine.

The magazine may thus be unsealed.

The magazine may comprise a first elongated body part extending generally longitudinally.

The rivet delivery track may also extend generally longitudinally through said first elongated body part.

The magazine may comprise a second elongated body part disposed downstream of the first elongated body part and forming an angle therewith.

The angle may be more than 90 degrees and less than 180 degrees.

The first and second elongated body parts may be connected by a curved elbow.

The magazine may comprise a pivotal attachment for attaching the magazine to the setting tool.

The magazine may comprise two or more of the rivet delivery tracks.

The rivet delivery tracks may be independent and may be arranged to be selectable for supplying the rivets to the nose arrangement depending on an angular orientation of the magazine on the setting tool.

At least one of said multiple rivet delivery tracks may have a curved longitudinal extension to facilitate the refilling of the rivets into the magazine and/or the supply of the rivets from the magazine towards the nose arrangement.

At least two of said multiple rivet delivery tracks may have the curved longitudinal extension, and the respective curves have opposed concavities tending to converge towards said pivot attachment.

The pivotal attachment may be generally located at a centre of the magazine.

The magazine may comprise three of said multiple rivet delivery tracks.

The three tracks may comprise a first straight track extending substantially longitudinally.

The second and third tracks may have the curved longitudinal extensions and may be disposed on either side of the first track.

The magazine may comprise two or more rivet dispensing devices each associated with one of said rivet delivery tracks.

The rivet dispensing devices may be each in the form of a rivet handling device for selectively stopping, trapping and/or releasing one or more rivets on a respective track as described herein.

Alternatively, the rivet dispensing device may be in the form of a rivet handling device associated with the rivet delivery track for selectively stopping, trapping and/or releasing one or more rivets on said track as described herein.

Alternatively, the rivet dispensing device may be in the form of a passive in-line rivet release device adapted to hold or release the rivet to the nose arrangement as described herein.

The magazine may further comprise a rivet handling device disposed part-way through the rivet delivery track for selectively stopping, trapping and/or releasing the rivets on said track as described herein.

The rivet handling device may define upper and lower portions of the rivet delivery track.

The magazine may comprise two or more independent upper portions of the rivet delivery track.

Two or more respective rivet handling devices may each associated with one of the independent upper portions.

The magazine may be configured such that said two or more independent upper portions can each feed one or more rivets onto the lower portion of the rivet delivery track.

The magazine may comprise an actuated track selection device for selecting one of the two or more independent upper rivet delivery track portions to supply the one or more rivets to the lower portion of the rivet delivery track.

The docking device may be in the form of a passive in-line rivet release device. This device may be adapted to permit said refilling when the magazine is docked to the bulk-supply apparatus. This device may be adapted to inhibit flow of refilled rivets out of the magazine when the magazine is undocked from the bulk-supply apparatus.

The rivet release device may comprise at least one resiliently biased jaw member as described herein. This may be disposed at the proximal end of the magazine.

The magazine may comprise one or more magnetically patterned surfaces.

The magazine may comprise a patterned magnet, which may be a permanent magnet.

The magnetically patterned surface may be a first correlated-magnets surface for magnetic interaction with one or more second correlated-magnets surfaces. These may be disposed on a support structure for supporting the magazine. The support structure for supporting the magazine may be provided on the setting tool. Alternatively, the support structure may be provided as an independent support structure, other than the setting tool.

According to an aspect of the present disclosure, there is provided a rivet supply system comprising the magazine as described herein.

According to an aspect of the present disclosure, there is provided a rivet setting tool comprising the rivet supply system as described herein.

According to an aspect of the present disclosure, there is provided a method of supporting the magazine, the method comprising:

providing a support structure comprising one or more of said second correlated-magnets surfaces for supporting the magazine on said support structure;

disposing said first and second correlated-magnets surfaces in magnetic engagement;

optionally, wherein said support structure for supporting the magazine is provided on the setting tool;

optionally, wherein said method of supporting the magazine further comprises docking the magazine in rivet-supply relation on the setting tool;

optionally, wherein said method of supporting the magazine further comprises replacing a magazine on the setting tool with the supported magazine;

optionally, wherein said support structure for supporting the magazine is provided as a bracket provided on a C-frame that supports the setting tool;

alternatively, wherein said support structure is provided as an independent support structure for supporting the magazine, other than on the setting tool;

optionally, wherein said method of supporting the magazine further comprises refilling the supported magazine.

According to an aspect of the present disclosure, there is provided apparatus for replacing a rivet or other fastener magazine on a rivet or other fastener setting tool, the apparatus comprising:

a rivet or other fastener setting tool;

first and second rivet or other fastener magazines having respective first and second connection features for connecting each magazine to a complementary connection feature, the first magazine being mounted on the setting tool;

a robotic arm for moving the setting tool and the first magazine within a work area, the setting tool being mounted on said robotic arm;

a first support structure located within said work area and comprising a first such complementary connection feature;

a second support structure also located within said work area and comprising a second such complementary connection feature, said second magazine being supported on said second support structure by the respective second connection features;

wherein, the robotic arm is operable to cause the first magazine to transfer from the setting tool to the first support structure in cooperation with the first connection features of, respectively, the first magazine and the first support structure; and/or the robotic arm is operable to cause the second magazine to transfer from the second support structure to the setting tool in cooperation with the second connection features of, respectively, the second magazine and the second support structure. Thus automatic replacement of the magazines may be enabled or facilitated.

The first and/or second support structures may be fixed support structures.

The magazine may be a rivet magazine.

The setting tool may be a rivet setting tool.

The fixed support structures may comprise one or more stands or posts.

The stands or posts may be grouped to form one or more racks for supporting a plurality of magazines.

The one or more stands or posts may be remote stands or posts for refilling the magazines from a bulk-supply apparatus.

The first and/or second support structures may be movable support structures. The movable support structures may be provided on one or more carousels. Each carousel may be adapted to support a plurality of magazines.

The setting tool may comprise one or more brackets adapted to support the first magazine on the setting tool.

The first magazine may be adapted to be magnetically supported on said brackets.

A pair of correlated-magnets surfaces may one be provided one on an external surface of said first magazine, and the other on at least one of said brackets.

The setting tool may comprise a C-frame.

The setting tool and the C-frame may be mounted on the robotic arm.

At least one of said brackets may be disposed on said C-frame.

The one or more brackets may be disposed on a longitudinally extending body portion of the C-frame.

The first magazine may be disposed in a rivet supply engagement on the setting tool.

The setting tool may comprises a punch for setting the rivets, a nose arrangement for receiving the rivets in preparation for setting operations, and a die provided opposite the nose arrangement for reacting the punch.

The nose arrangement may be movable towards the die to undock the first rivet magazine from the rivet supply engagement on the setting tool, thereby facilitating the transfer of the first rivet magazine from the setting tool to the first support structure.

The first rivet magazine may be supported so as to be movable together with the nose arrangement.

The nose arrangement may be movable towards the die to undock the first rivet magazine from rivet supply engagement on the setting tool when the first rivet magazine is supported on the first support structure.

The first and/or second magazine connection features may each comprise a magazine plate-like structure.

The magazine plate-like structure may be in the form of a magazine pad provided on said magazine.

The magazine pad may comprise a layer of a compliant material.

The magazine plate-like structure may be grooved or ridged so as to form a key-like profile.

The magazine plate-like structure may be magnetic.

The magazine magnetic plate-like structure may comprise a permanent magnet.

The magazine magnetic plate-like structure may comprise a magnetically patterned surface.

The first and second complementary connection features may each comprise a support plate-like structure.

The support plate-like structure may be in the form of a support pad provided on said first and/or second support structure.

The support pad may comprise a layer of a compliant material.

The support plate-like structure may be complementarily respectively ridged or grooved with respect to the magazine plate-like structure so as to form a complementary key-like profile.

The support plate-like structure may be magnetic.

The magnetic plate-like structure may comprise a permanent magnet.

The magnetic plate-like structure may comprise a magnetically patterned surface.

The magazine and support plate-like structures may comprise at least one further pair of correlated-magnets surfaces.

The further pair of correlated-magnets surfaces may be adapted to magnetically align the first rivet magazine in place on the first support structure and/or the second rivet magazine in place on the second support structure.

The further pair of correlated-magnets surfaces may be adapted to magnetically latch the first magazine in place on the first support structure and/or the second magazine in place on the second support structure.

The further pair of correlated-magnets surfaces may be adapted to magnetically release the first magazine from the first support structure when the first magazine and the first support structure are brought in misalignment one with respect to the other.

The further pair of correlated-magnets surfaces may be adapted to magnetically release the second magazine from the second support structure when the second magazine and the second support structure are brought in misalignment one with respect to the other.

The apparatus may further comprise at least one further magazine having a further connection feature for connecting the further magazine to a further complementary connection feature different than, and not compatible with, the complementary connection feature related to the first and second magazines, and at least one further support structure located within said work area, said further support structure comprising one such further complementary connection feature.

The further connection features may comprise a pair of magnetically repulsive surfaces.

The magnetically repulsive surfaces may each comprise a magnetically patterned surface.

According to an aspect of the present disclosure, there is provided a method of replacing a rivet or other fastener magazine on a rivet or other fastener setting tool, the method comprising:

providing first and second rivet or other fastener magazines having respectively first and second connection features for connecting each magazines to a complementary connection feature, wherein the first magazine is mounted on the setting tool;

providing a robotic arm for moving the setting tool and the first magazine within a work area, the setting tool being mounted on said robotic arm;

providing a first support structure located within said work area and comprising a first such complementary connection feature;

providing a second support structure also located within said work area and comprising a second such complementary connection feature, said second magazine being supported on said second support structure by the respective second connection features;

operating the robotic arm to cause the first magazine to transfer from the setting tool to the first support structure in cooperation with the first connection features of, respectively, the first magazine and the first support structure; and/or operating the robotic arm to cause the second magazine to transfer from the second support structure in cooperation with the second connection features of, respectively, the second magazine and the second support structure.

According to an aspect of the present disclosure, there is provided a replacement magazine for storing rivets or other fasteners for supply to a rivet or other fastener setting tool, the magazine comprising:

at least one magnetically patterned surface.

The magazine may have an elongated, generally tubular shape.

At least one rivet delivery track may extend internally through the magazine.

The magnetically patterned surface may be provided on an external surface of the magazine.

The magnetically patterned surface may be provided on a plate-like structure provided on the magazine.

The plate-like structure may be in the form of a magazine pad comprising a layer of a compliant material.

The magnetically patterned surface may be a first correlated-magnets surface for coupling with a second correlated-magnets surface provided on a magazine complement.

According to an aspect of the present disclosure, there is provided a magazine as described herein, in combination with the magazine complement.

The magazine complement may be a magazine refill device.

The refill device may comprise a rivet feed tubular member.

The magazine may comprise a plurality of upper tracks.

The rivet feed tubular member may comprise a corresponding plurality of rivet feed passageways.

The first correlated-magnets surface may be provided on a magazine docking interface provided on the magazine for docking/undocking the magazine to a rivet supply line extending through said magazine refill device.

The magazine docking interface may be provided on an upper face of the magazine.

The magazine docking interface and refill device may be adapted to sealing engage to reduce or prevent air loss therebetween during magazine refill operations that use compressed air as a rivet motive force.

Said second correlated-magnets surface may be disposed on a refill docking interface provided on said refill device.

The refill docking interface may be provided on a lower face of the refill device.

The first and second correlated-magnets surfaces may be adapted to generate an alignment force between the magazine and the refill device upon magnetic engagement thereof, such that rivets can be transferred from the refill device to the magazine.

The first and second correlated-magnets surfaces may be adapted to generate a repulsive release force between the magazine and the refill device upon magnetic disengagement thereof.

The rivet refill device may be supported on at least one compliant mount.

The rivet refill device may be supported on a plurality of compliant mounts.

The rivet refill device may comprise a first support structure and a second support structure, and the one or more compliant mounts may be disposed between respective distal and proximal ends of the first and second support structures.

The first support structure may be a tripod, and the three compliant mounts may be disposed between said tripod and the second support structure.

The first support structure may comprise at least one first rhomboid plate and the second support structure may comprise at least one second rhomboid plate disposed externally with respect to said first rhomboid plate.

The one or more compliant mounts may be adapted to absorb a force generated by contact between the refill device and the magazine when the magazine and the rivet refill device are coupled to refill the magazine with rivets.

The one or more compliant mounts may be adapted to return the refill device to an initial position of equilibrium after that the refill device has been displaced from said initial position of equilibrium.

The refill device may comprise stop means for constraining movement of the refill device within a predetermined range of positions in at least one direction.

The stop means may comprise two spaced apart ring members for limiting vertical positions of the rivet feed tubular member.

The magazine complement may be a chute for docking the magazine to a nose arrangement of the rivet setting tool.

The first correlated-magnets surface may be provided on a magazine docking interface provided on the magazine for docking/undocking the magazine to a rivet supply line extending through said chute.

The magazine docking interface may be provided on a lower face of the magazine.

The second correlated-magnets surface may be disposed on a chute docking interface provided on said chute.

The chute docking interface may be provided on an upper face of the chute.

The magazine complement may comprise a bracket.

The first correlated-magnets surface may be provided on a setting tool-facing side of the magazine.

The bracket may be provided on the setting tool or on a C-frame supporting the setting tool.

The second correlated-magnets surface may be provided on a recess for accommodating the magazine provided on said bracket.

The magazine complement may comprise an independent support structure, other than the setting tool.

The magazine support structure may comprise a support plate-like structure as described herein.

The first correlated-magnets surface may be provided on an outwardly facing side of the magazine.

According to an aspect of the present disclosure, there is provided a method of supporting a replacement magazine on a structure, the method comprising:

- providing a first magnetically patterned surface on said magazine;
- providing a second complementary magnetically patterned surface on said structure;
- magnetically engaging said surfaces to connect the magazine to said structure.

The magazine and said structure may be adapted to define a mechanical engagement designed to facilitate said magnetically engaging said surfaces to connect the magazine to said structure, such that the magazine and the structure are mechanically connected in addition to being magnetically connected when the replacement magazine is supported on said structure.

The mechanical engagement may comprise an abutment between said magazine and said structure.

The abutment may comprise first and second complementary key-like profiles provided respectively on the magazine and on said structure.

The first and second key-like profiles may be provided respectively on said first and second magnetically patterned surfaces.

The mechanical engagement may define at least one possible direction for magnetically engaging said surfaces to connect the magazine to said structure.

The mechanical engagement may define a sole direction for magnetically engaging said surfaces to connect the magazine to said structure.

The magnetically patterned surfaces may be adapted to magnetically engage one with the other if said surfaces are spaced apart within a predetermined maximum distance.

The magnetically patterned surfaces may be adapted to magnetically align said magazine and said structure upon engagement.

According to an aspect of the present disclosure, there is provided a method of disconnecting a replacement magazine from a structure, the method comprising:

- providing a first magnetically patterned surface on said magazine;
- providing a second complementary magnetically patterned surface on said structure;
- wherein said magazine and said structure are magnetically connected by said surfaces;
- magnetically disengaging said surfaces to disconnect the magazine from said structure.

The magazine and the structure may be adapted to define a mechanical engagement as described herein designed to facilitate said magnetically disengaging said surfaces to disconnect the magazine from said structure, such that the magazine and the structure are mechanically disconnected in addition to being magnetically disconnected when the replacement magazine is disconnected from said structure.

The mechanical engagement may define at least one possible direction for magnetically disengaging said surfaces to disconnect the magazine from said structure.

The mechanical engagement may define a sole direction for magnetically disengaging said surfaces to disconnect the magazine from said structure.

The method may further comprise moving the magazine and/or said structure relative to each other further than a predetermined minimum distance.

The magnetically patterned surfaces may be adapted to magnetically mutually repel said magazine and said structure upon disengagement.

According to an aspect of the present disclosure, there is provided riveting apparatus comprising:

a rivet setting tool;

one or more magazines for storing rivets, each magazine carrying information associated with a type and/or size of the rivets stored in the magazine;

a reader for reading said information carried on the magazines;

a controller operably associated with said rivet setting tool and said reader; wherein, the controller is configured to control the rivet setting tool in response to a signal received from the reader.

The one or more magazines may be in rivet-supply engagement on the rivet setting tool.

The one or more magazines may be each as described herein.

Each magazine may comprise an electronically readable tag carrying said information.

The reader may comprise an electronically readable tag reader.

The electronically readable tag may be located on a tool-facing side of the magazine.

The electronically readable tag reader may be located on a bracket for supporting said one or more magazines in said rivet-supply engagement on the rivet setting tool.

The rivet setting tool may be mounted on a robotic arm.

The controller may be configured to control the robotic arm.

The magazine may be replaceable.

The controller may be configured to control said robotic arm to carry out a magazine replacement operation.

The controller may be configured to control said robotic arm to carry out a magazine replacement operation as described herein.

The rivet setting tool may comprise a replaceable and/or adjustable die assembly.

The controller may be configured to control the setting tool to replace and/or adjust said replaceable and/or adjustable die assembly.

According to an aspect of the present disclosure, there is provided a method of riveting, the method comprising:

providing a riveting apparatus as described herein;

reading by means of said reader said information carried on the one or more magazines;

controlling via said controller the setting tool in response to a signal received from the reader.

According to an aspect of the present disclosure, there is provided a method of riveting, the method comprising:

providing a riveting apparatus as described herein;

reading by means of said reader said information carried on the one or more magazines;

controlling via said controller the robotic arm in response to a signal received from the reader to carry out a magazine replacement operation.

According to an aspect of the present disclosure, there is provided a method of riveting, the method comprising:

providing a riveting apparatus as described herein;

reading by means of said reader said information carried on the one or more magazines;

controlling via said controller the setting tool to replace and/or adjust said replaceable and/or adjustable die assembly in response to a signal received from the reader.

According to an aspect of the present disclosure, there is provided a method of riveting as described herein, the method further comprising:

identifying a joint for riveting.

According to an aspect of the present disclosure, there is provided a method of manufacturing a vehicle or a part thereof by setting one or more rivets, wherein said method comprises any of the procedures described herein.

The present invention will now be described in connection with the appended drawings in which:

DRAWINGS

Figure 3:
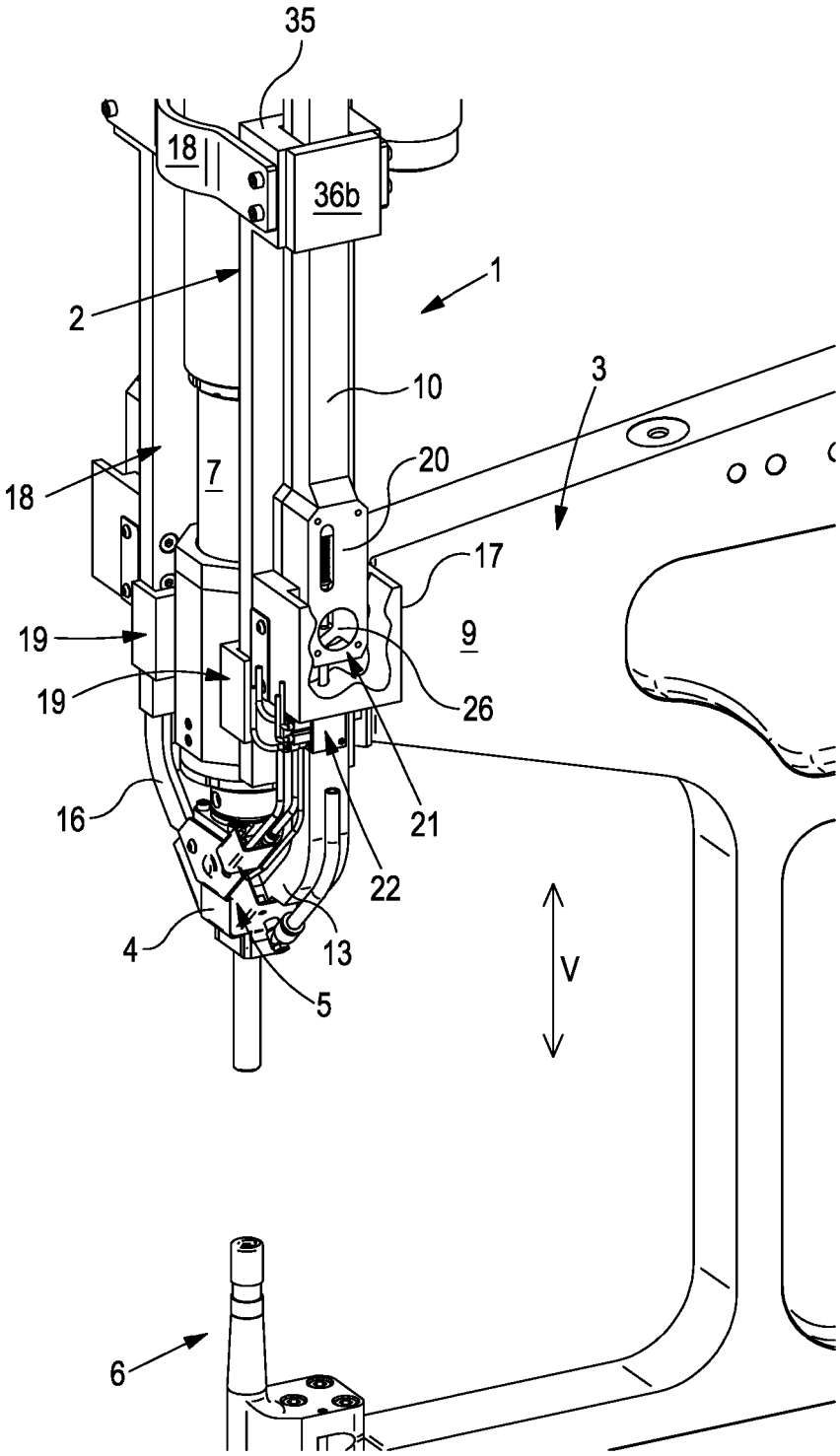
FIG. 3 is a side perspective view of the setting tool of FIGS. 1 and 2 with the magazines partially undocked from the supply system, with a front cover portion cut away to reveal a rotary cam escapement incorporated in the magazines.
Figure 4:
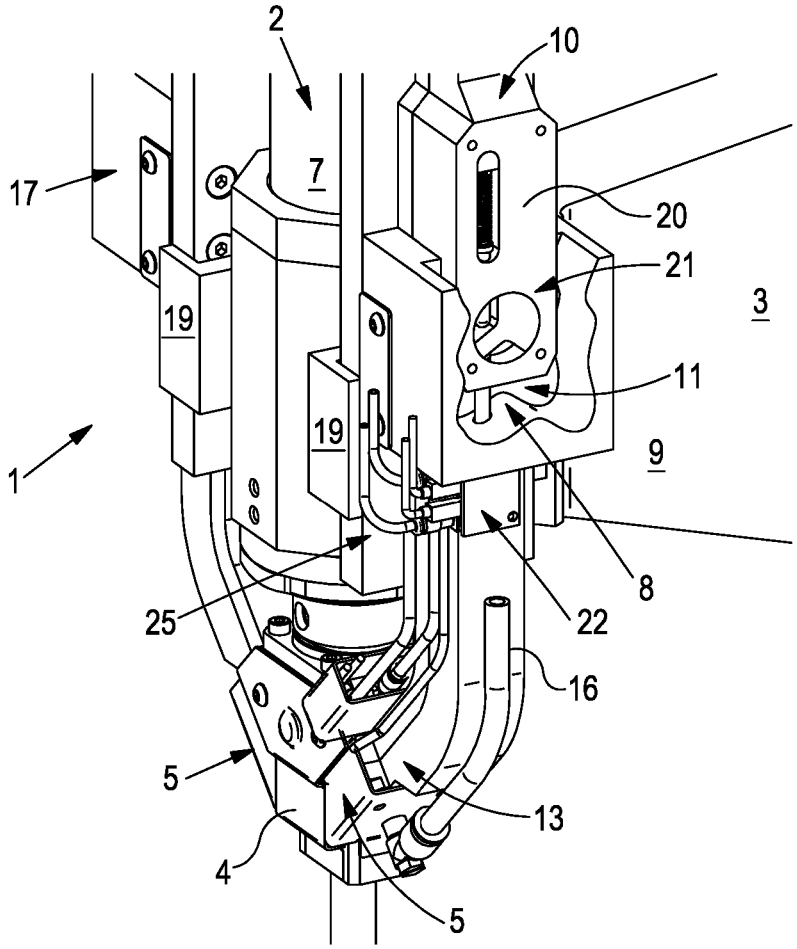
FIG. 4 is a an enlarged side perspective view of the setting tool of FIG. 3.
Figure 7A:
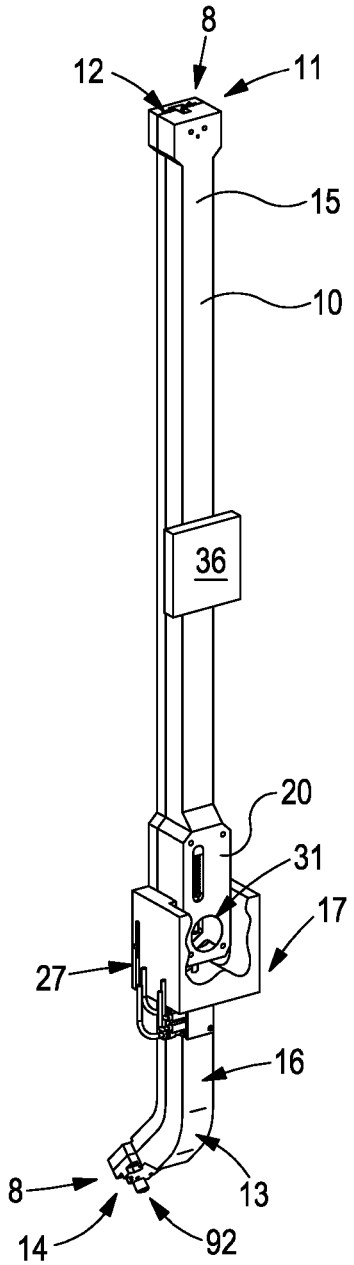
Figure 7B:
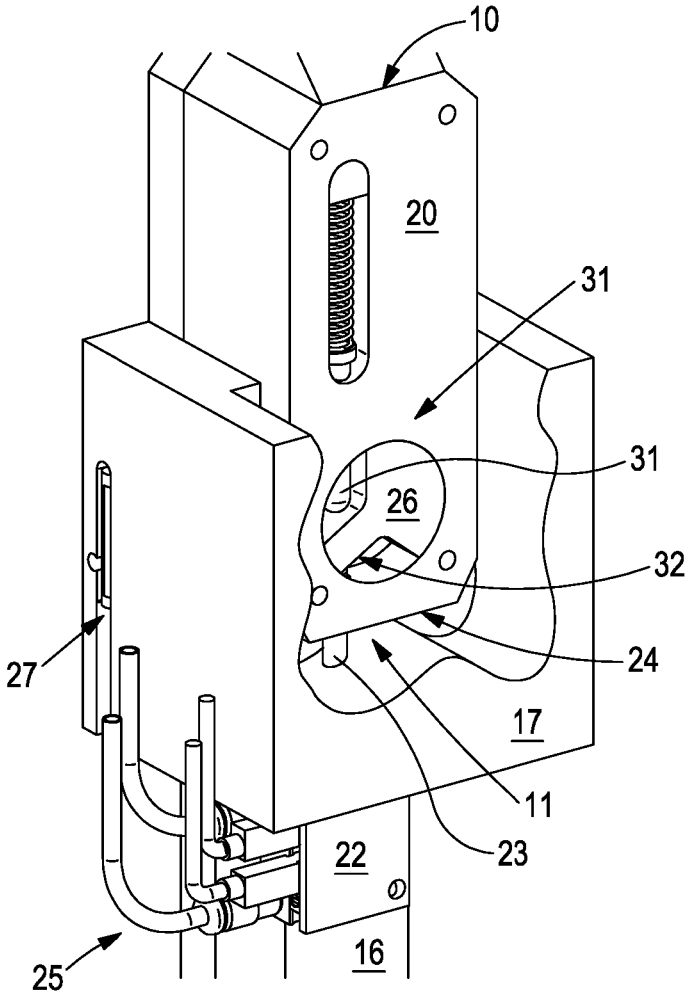
Figure 9B:
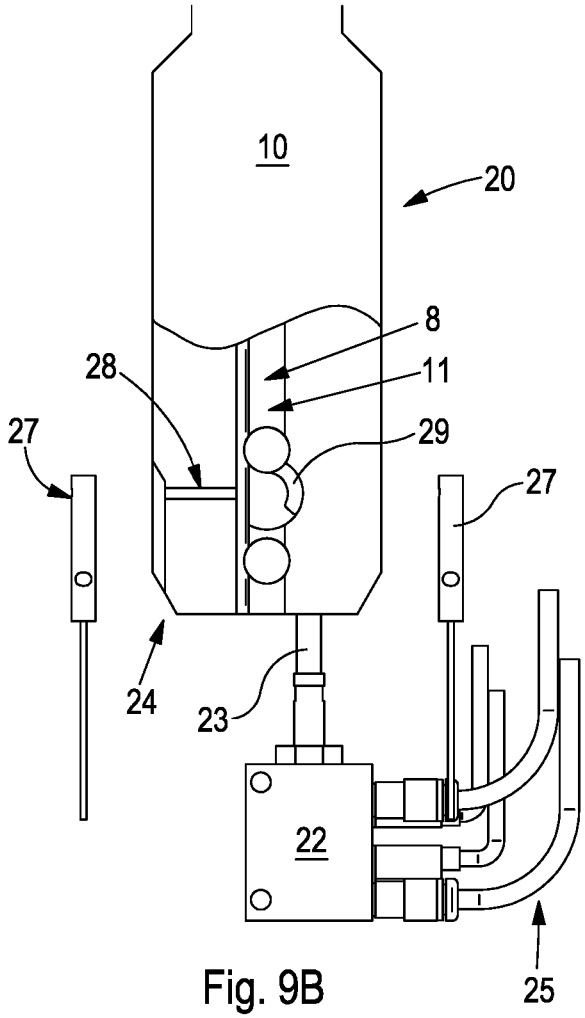
Figure 9A:
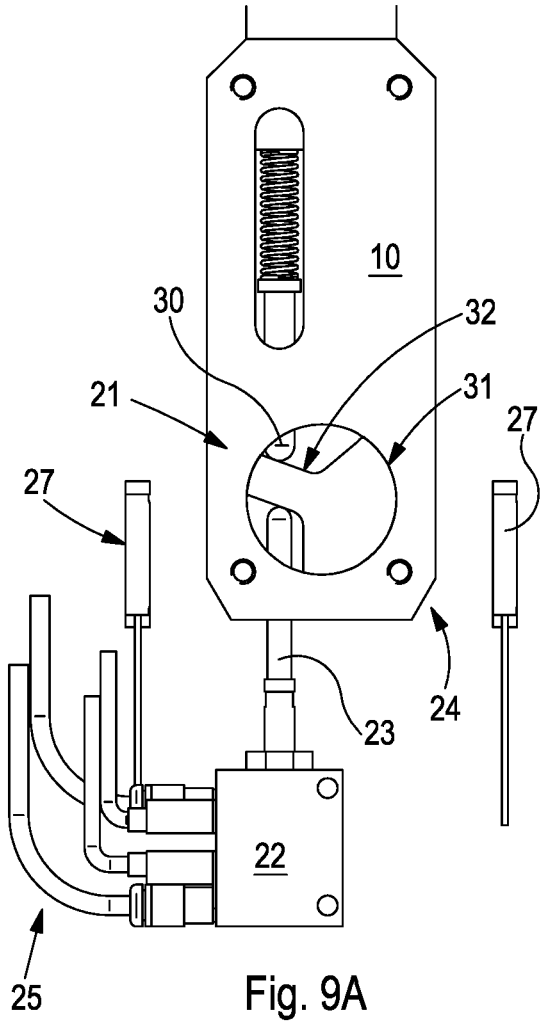
Figure 9C:
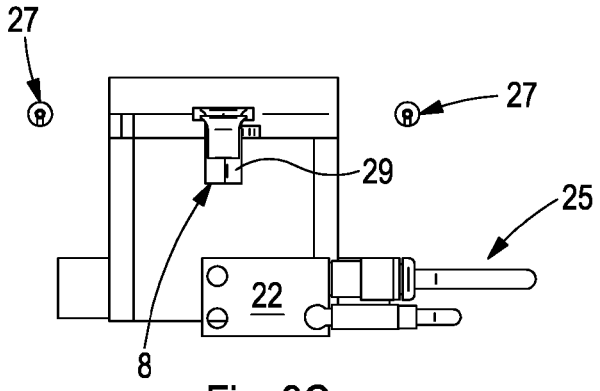
Figure 10B:
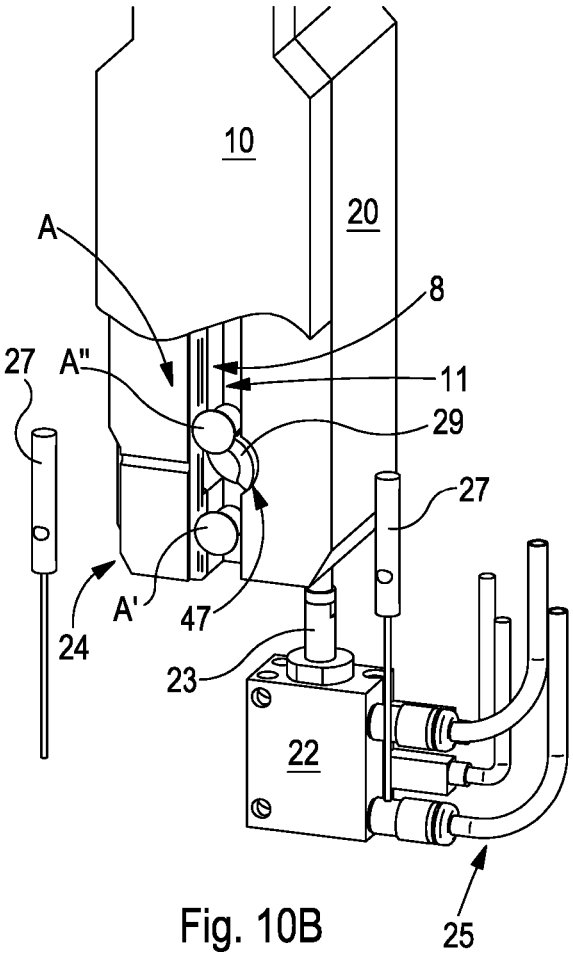
Figure 10A:
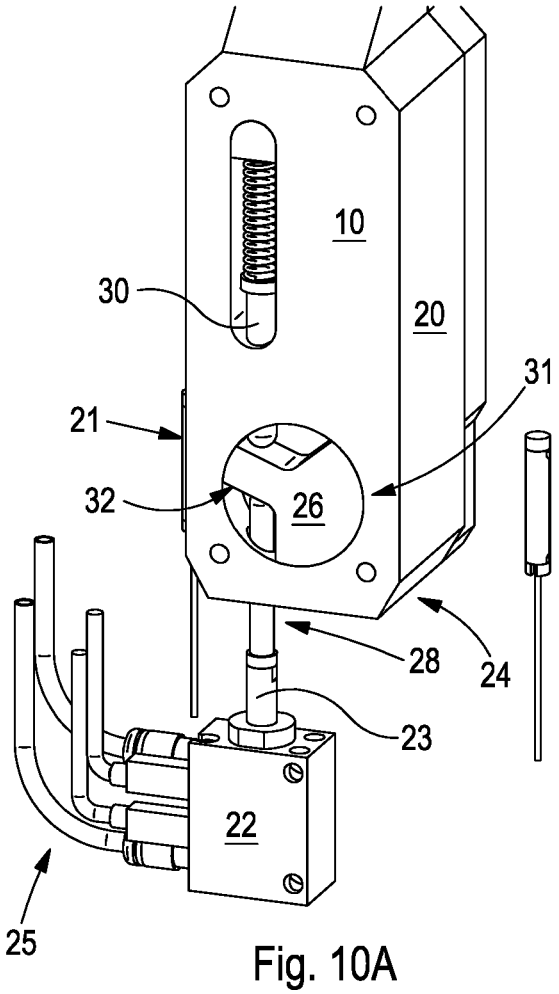
Figure 11A:
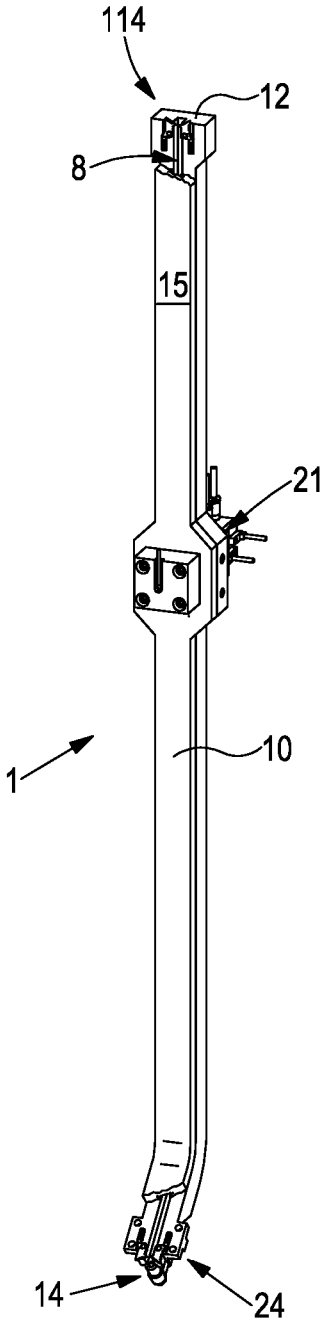
Figure 11B:
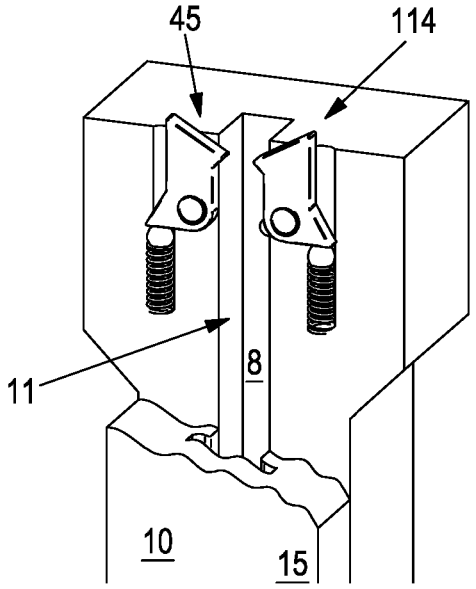
Figure 11C:
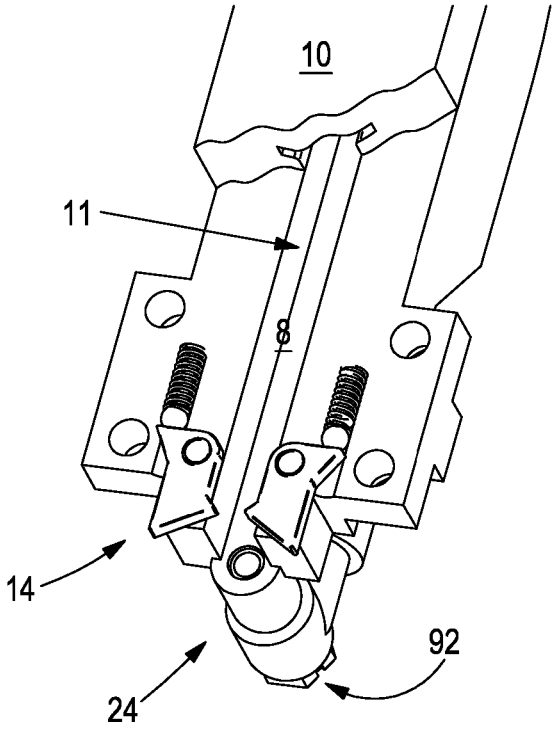
Figure 12:
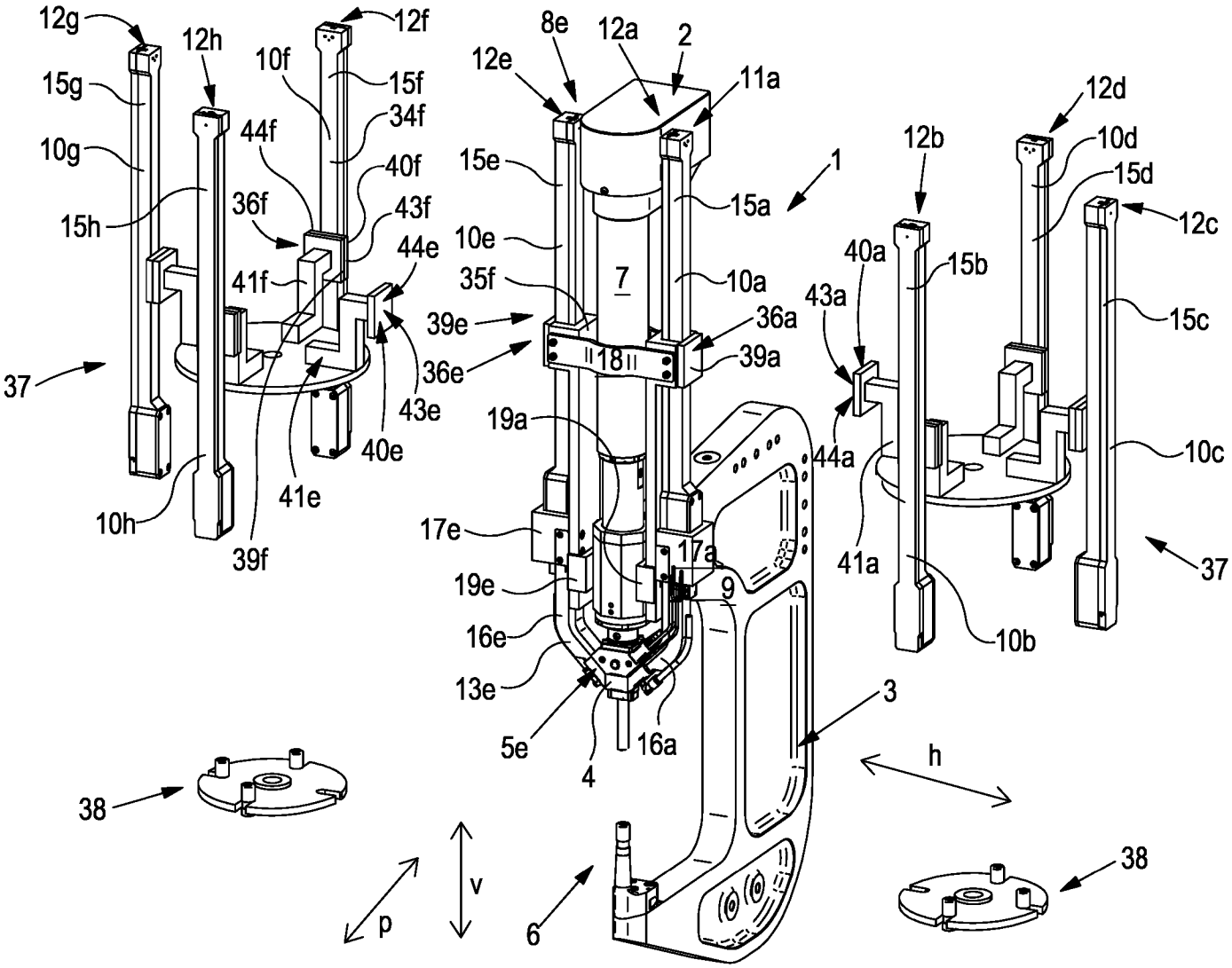
Figure 13:
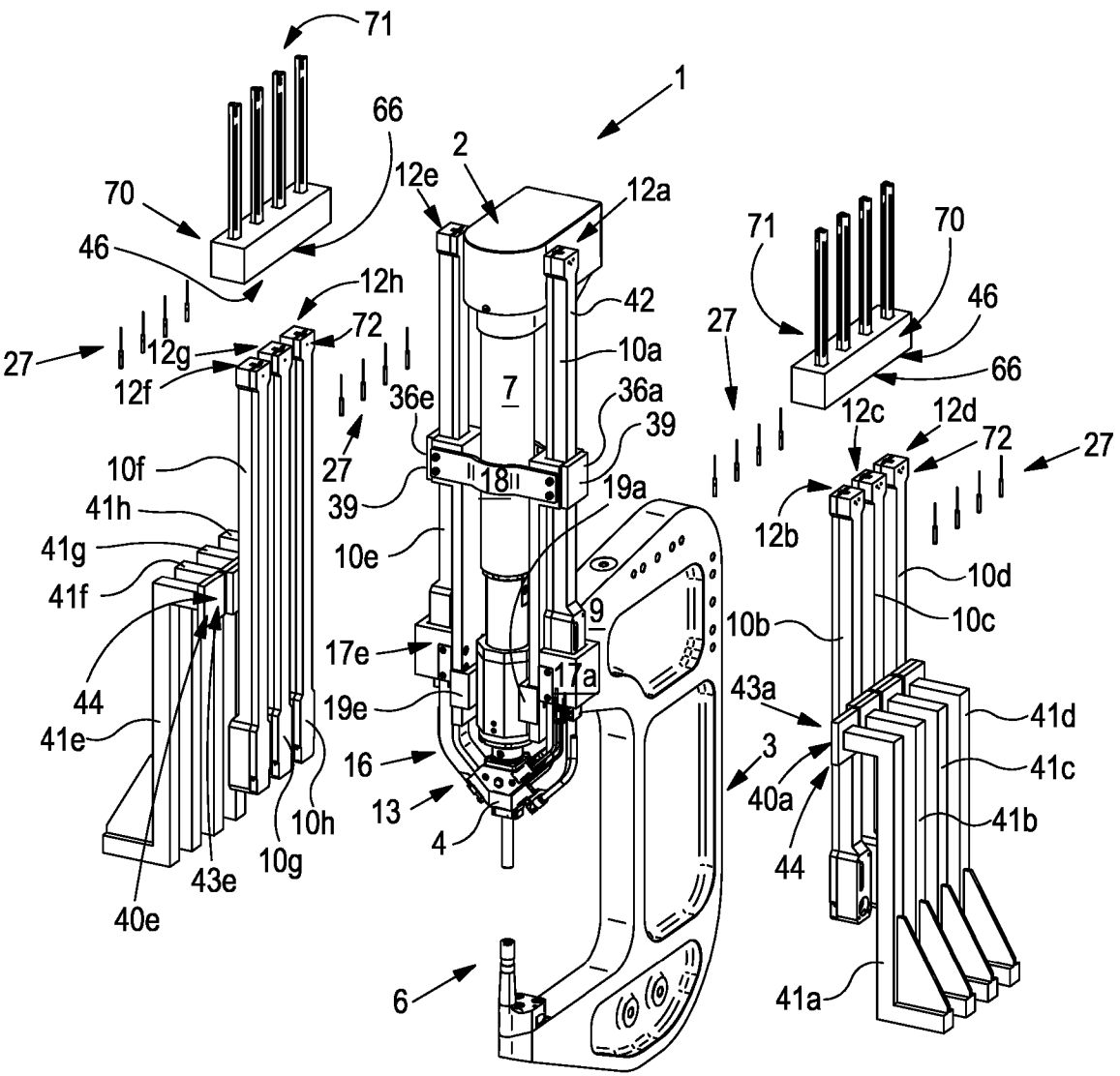
Figure 14:
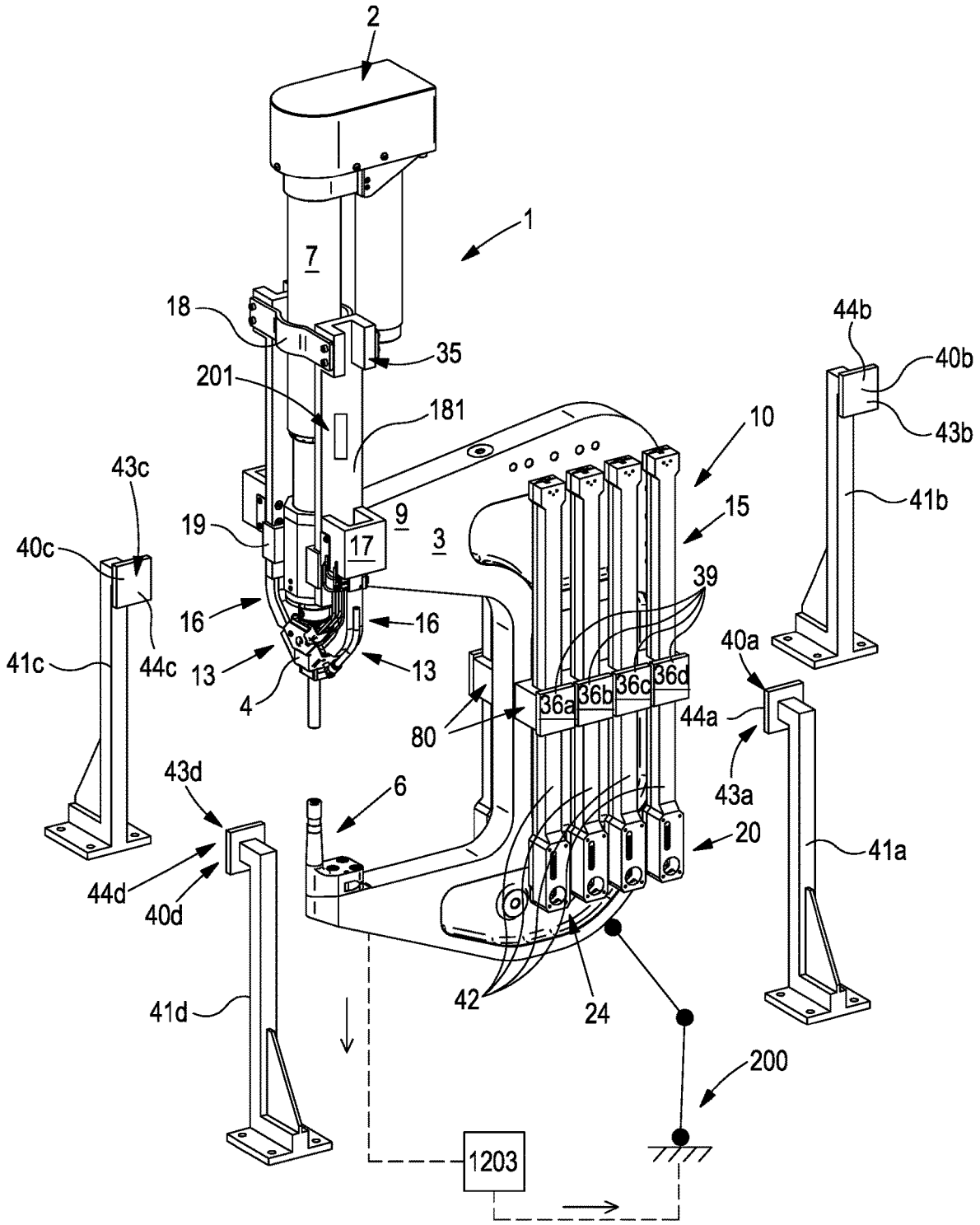
Figure 15:
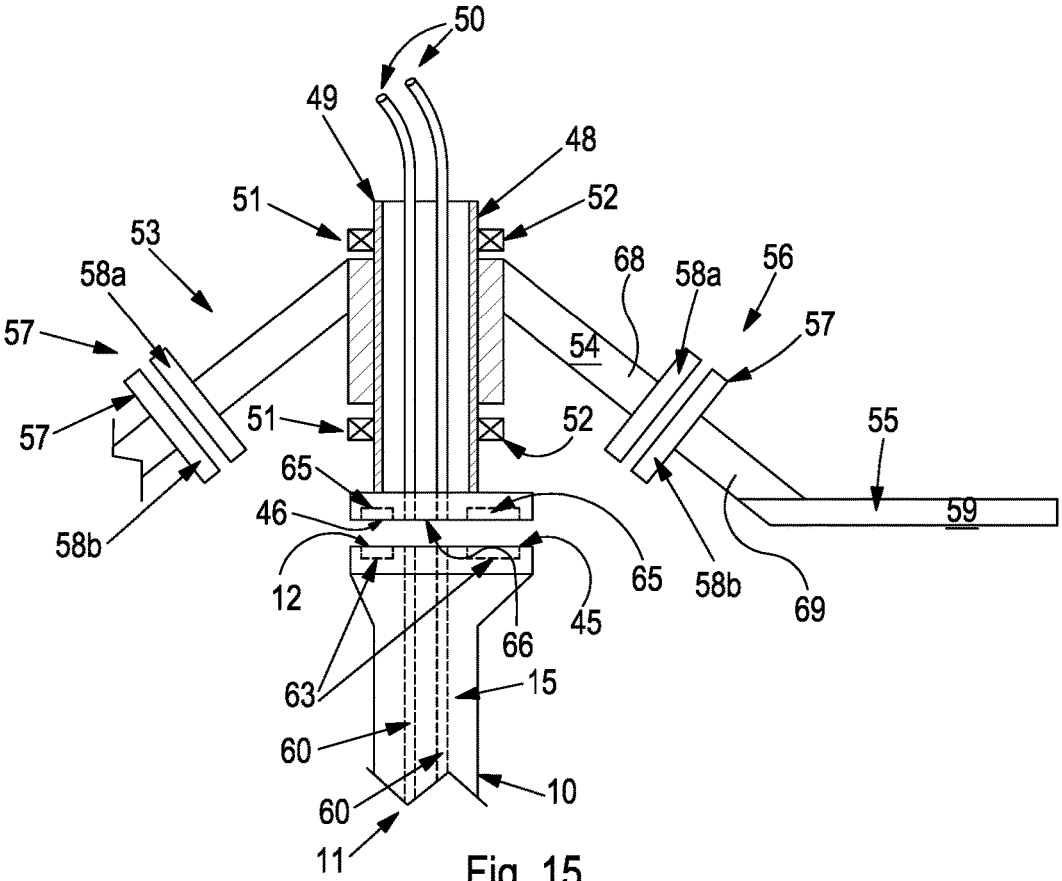
Figure 16:
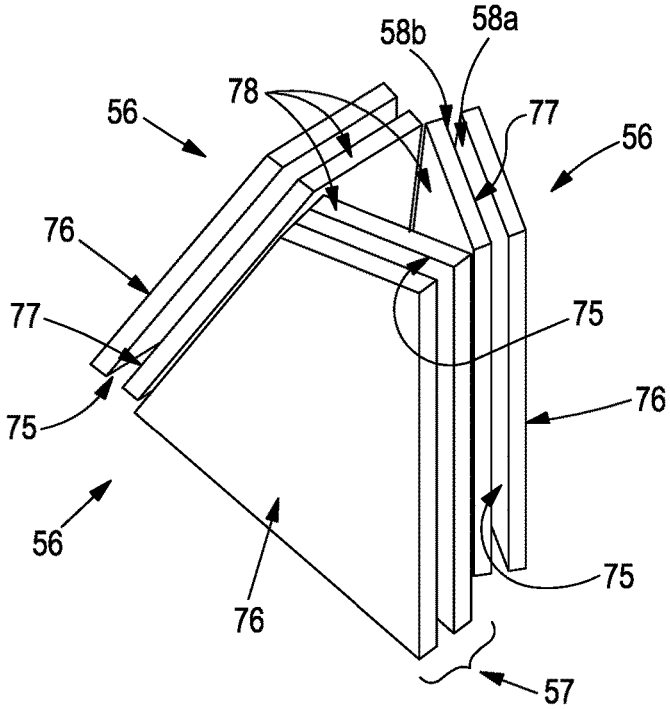
Figure 17A:
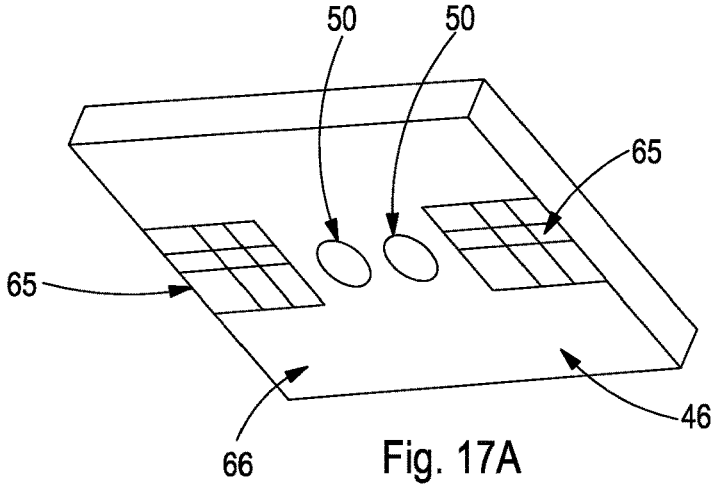
Figure 17B:
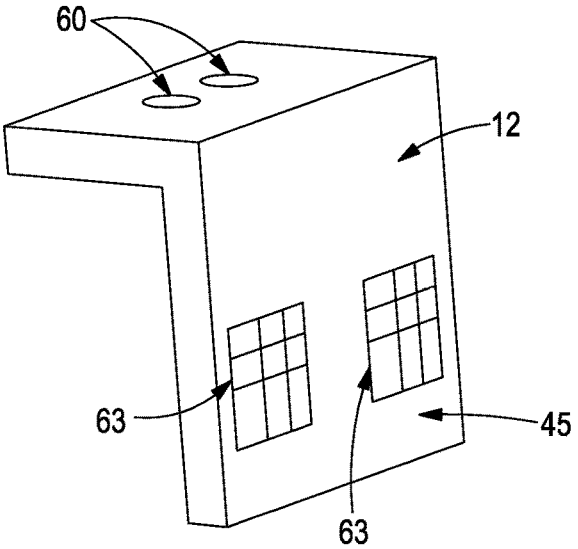
Figure 17C:
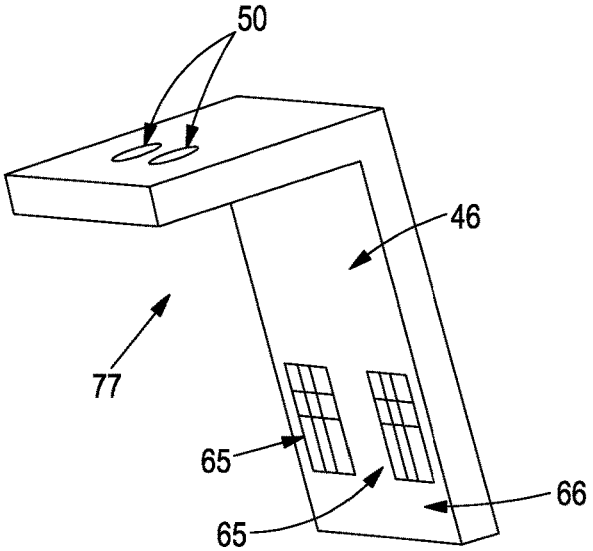
Figure 18:
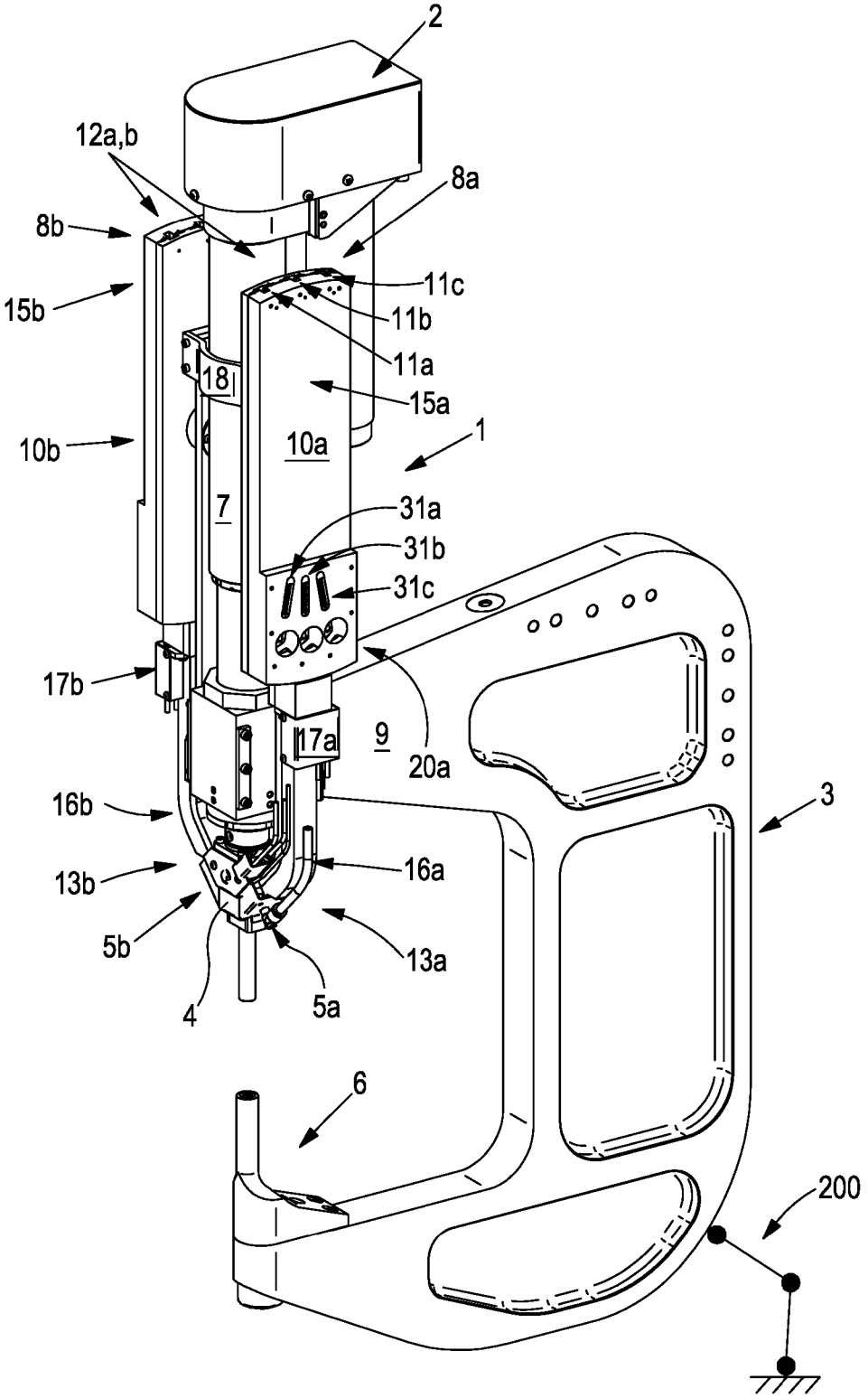
Figure 19:
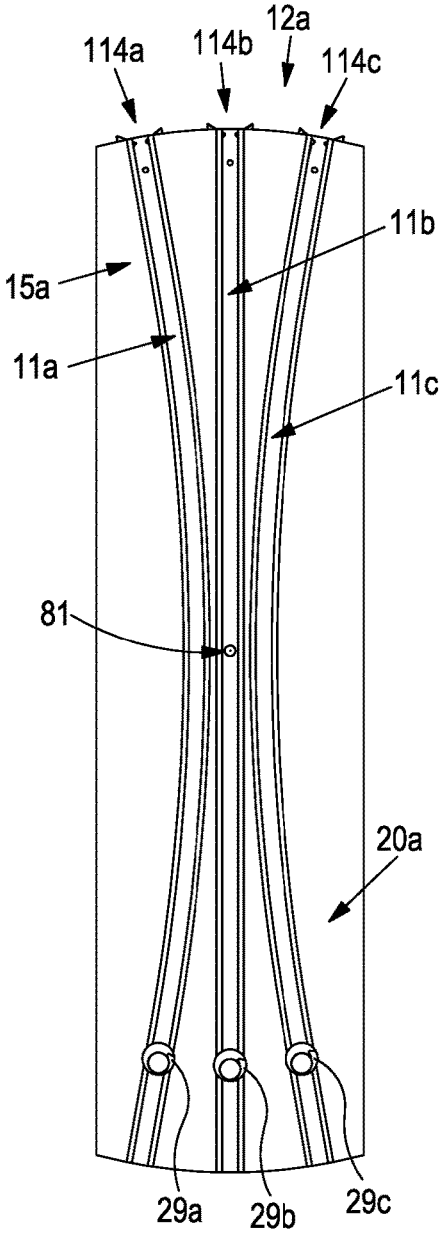
Figure 20A:
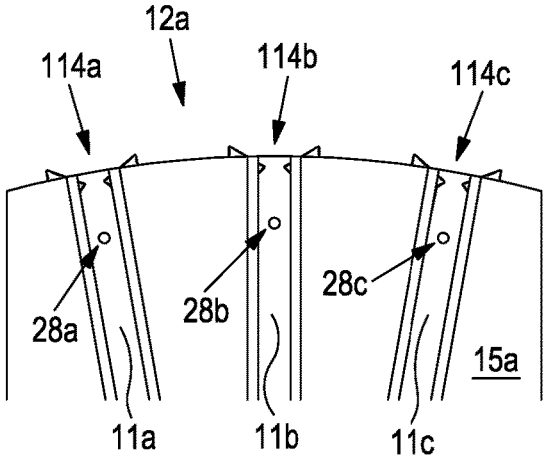
Figure 20B:
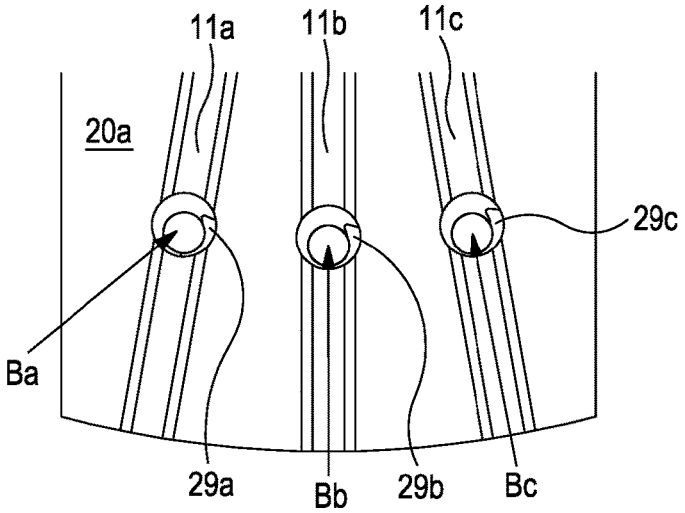
Figure 21:
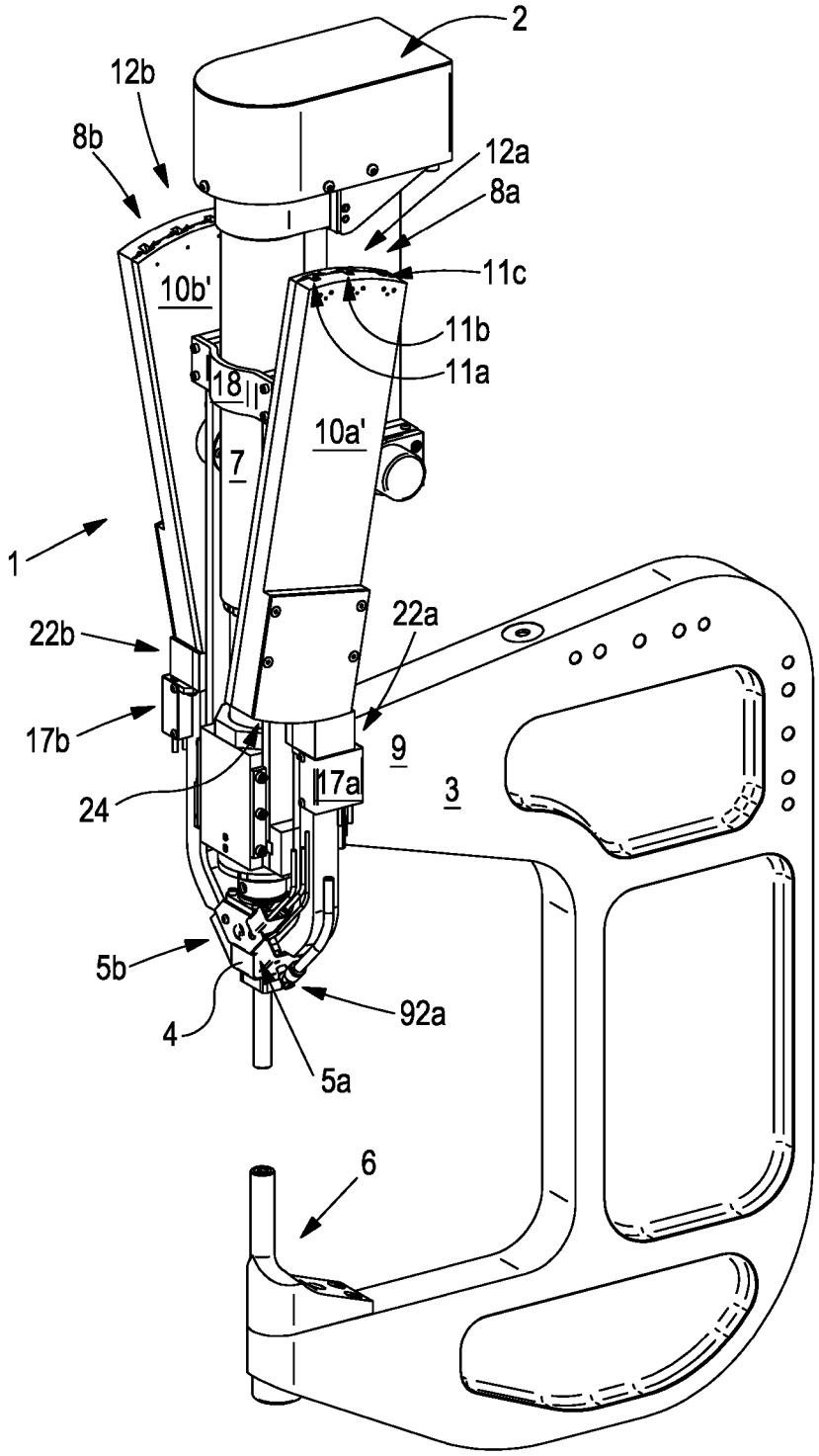
Figure 22:
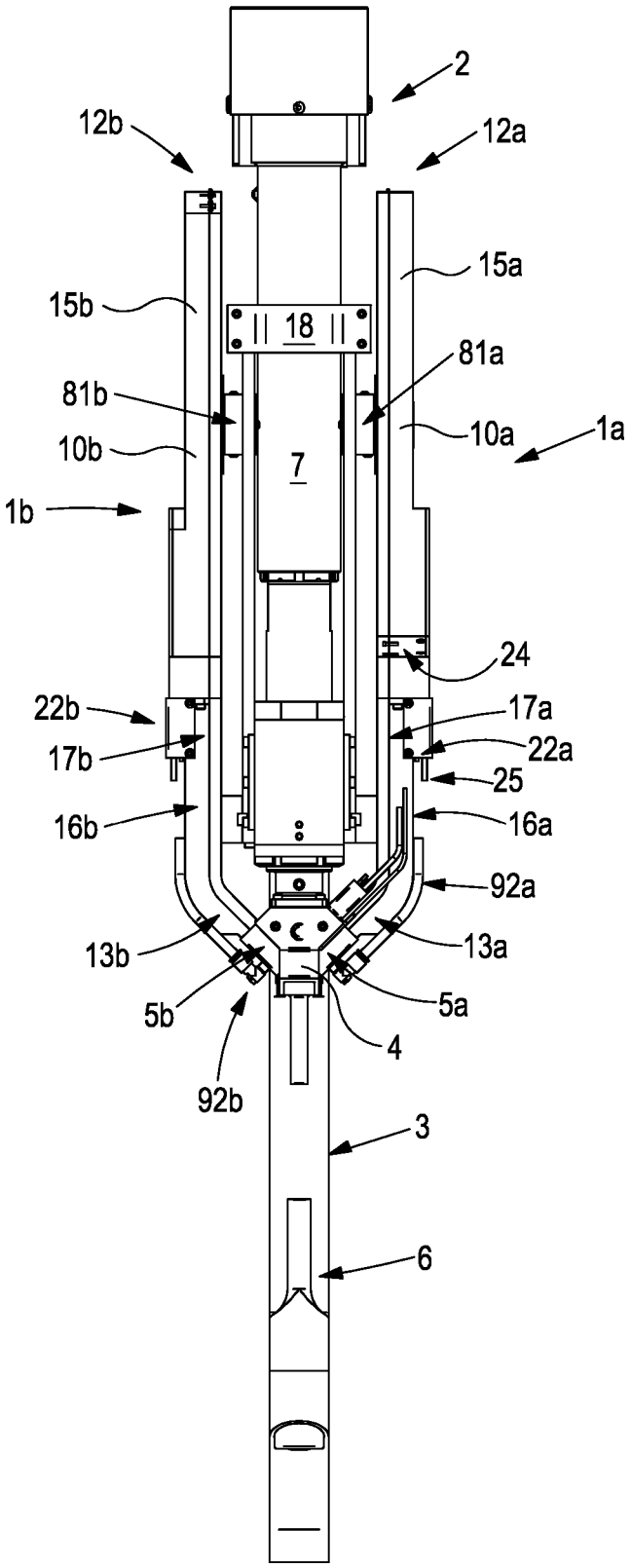
Figure 23:
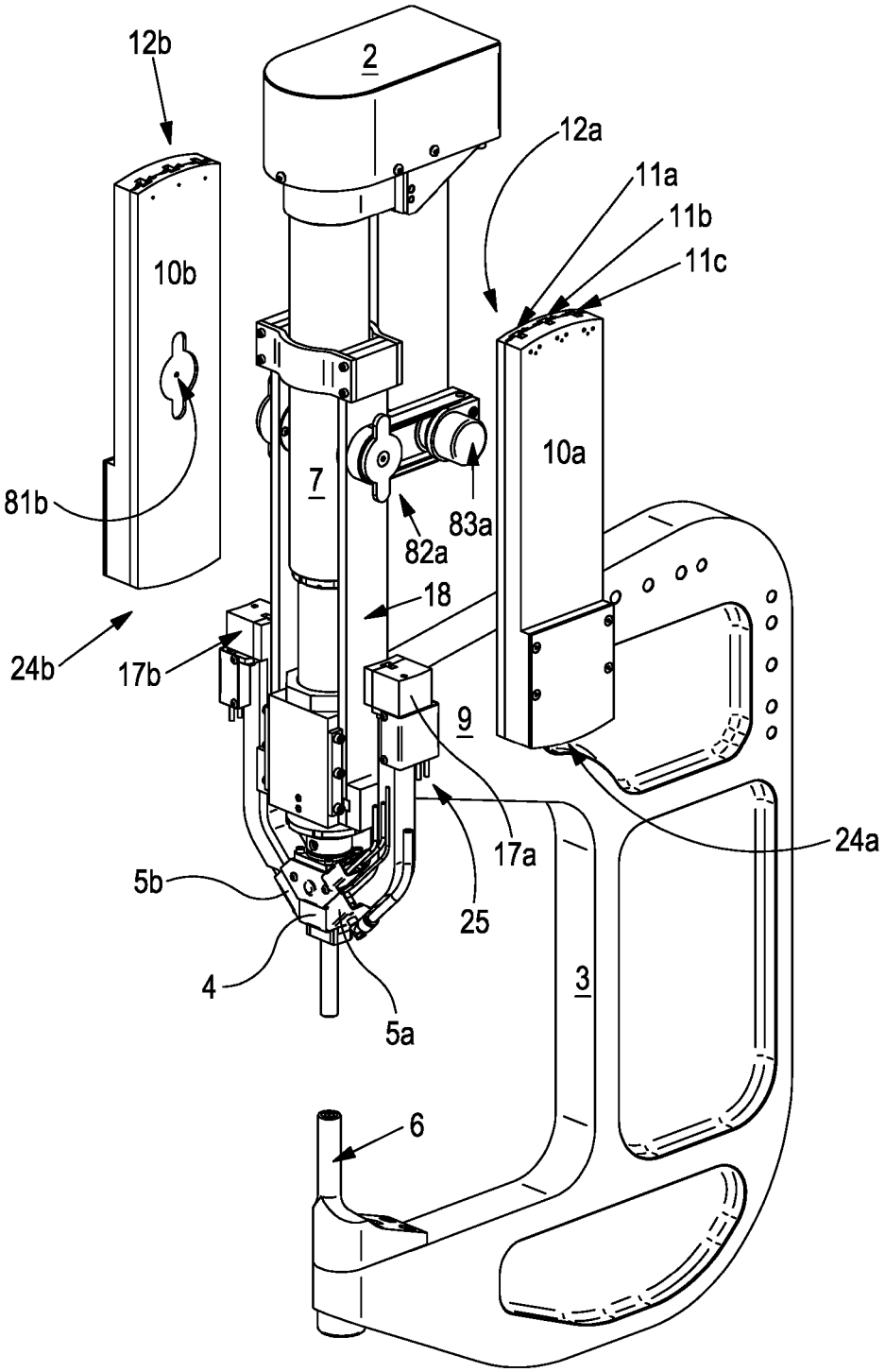
Figure 24:
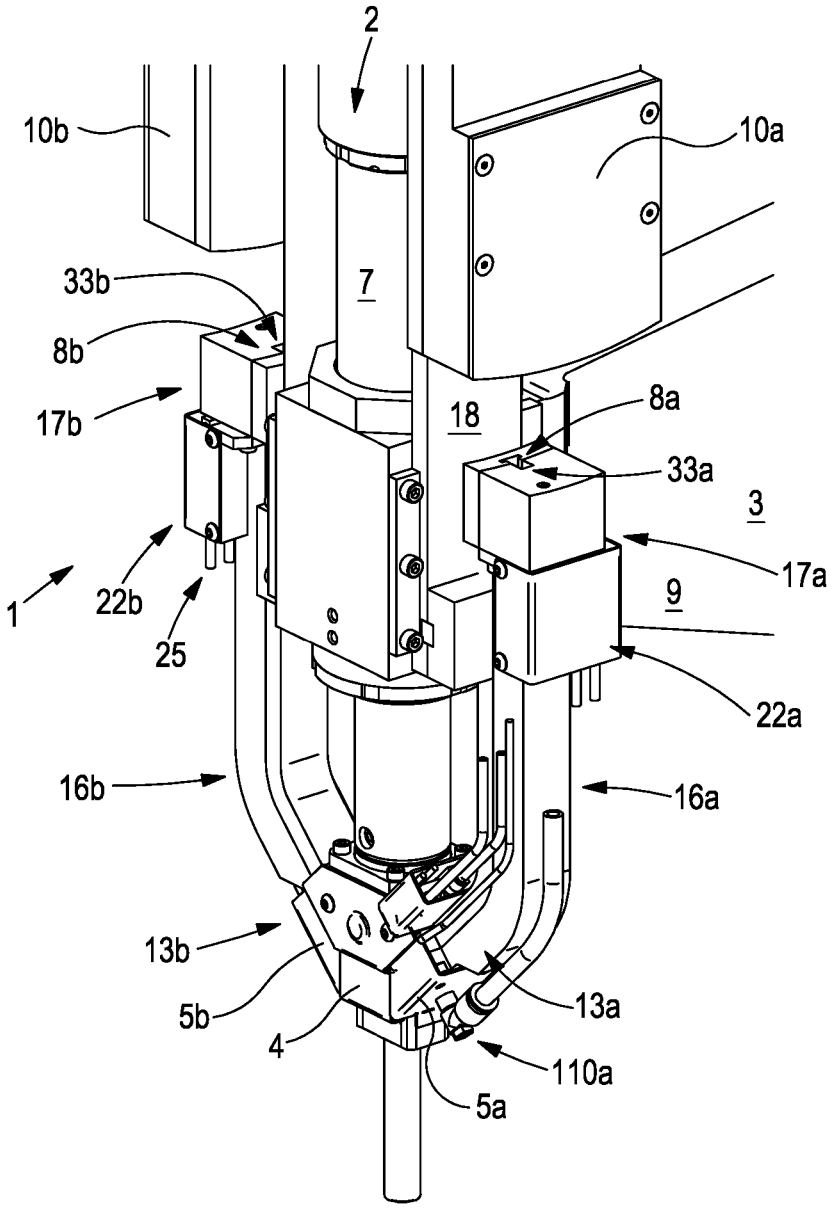
Figure 25:
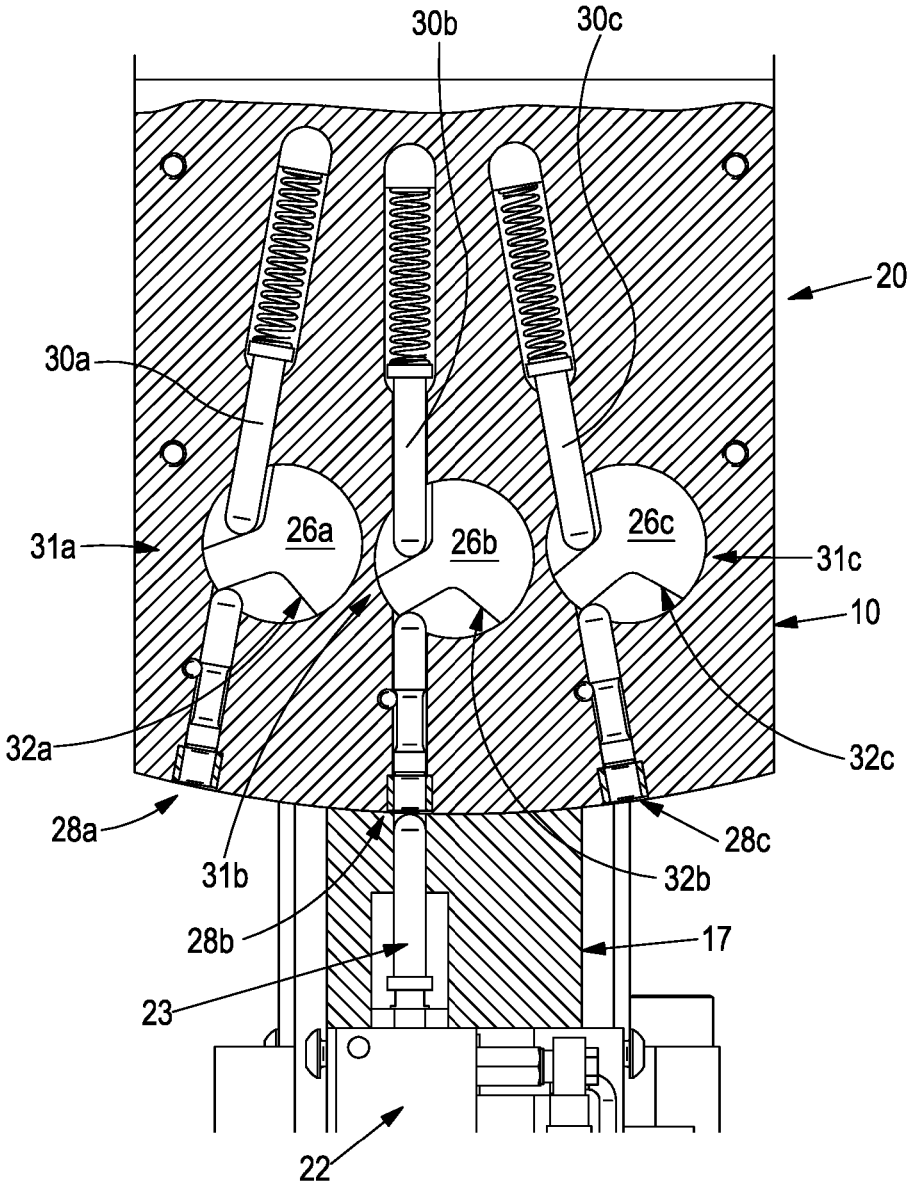
Figure 26:
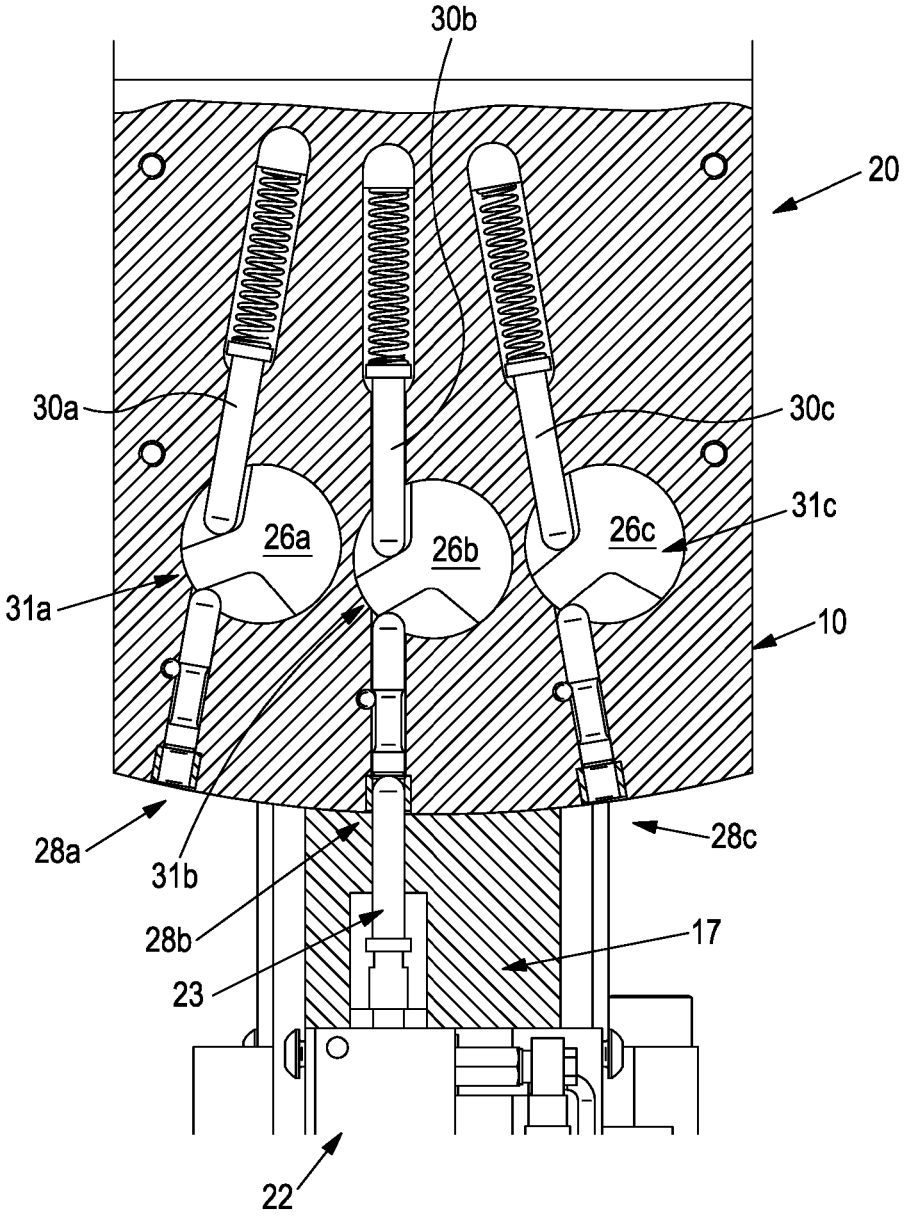
Figure 27:
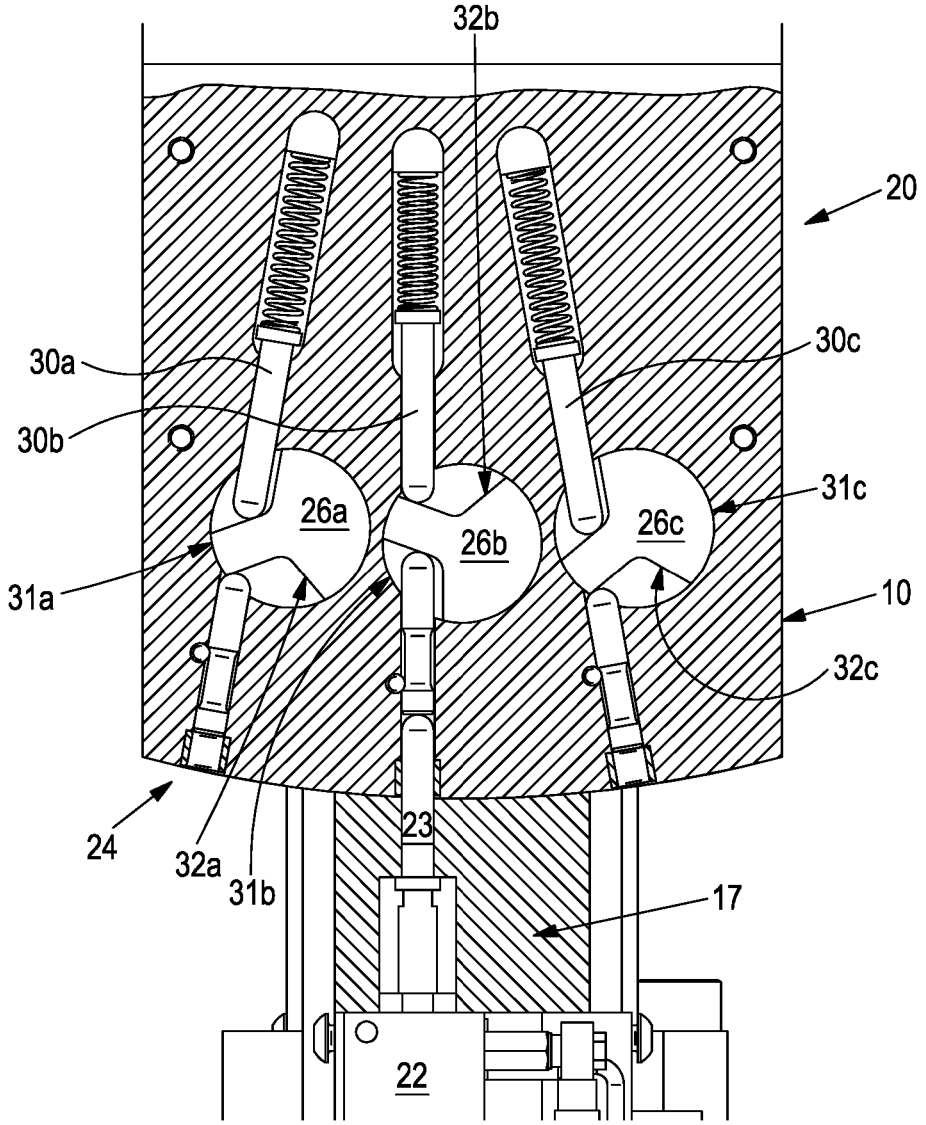
Figure 28:
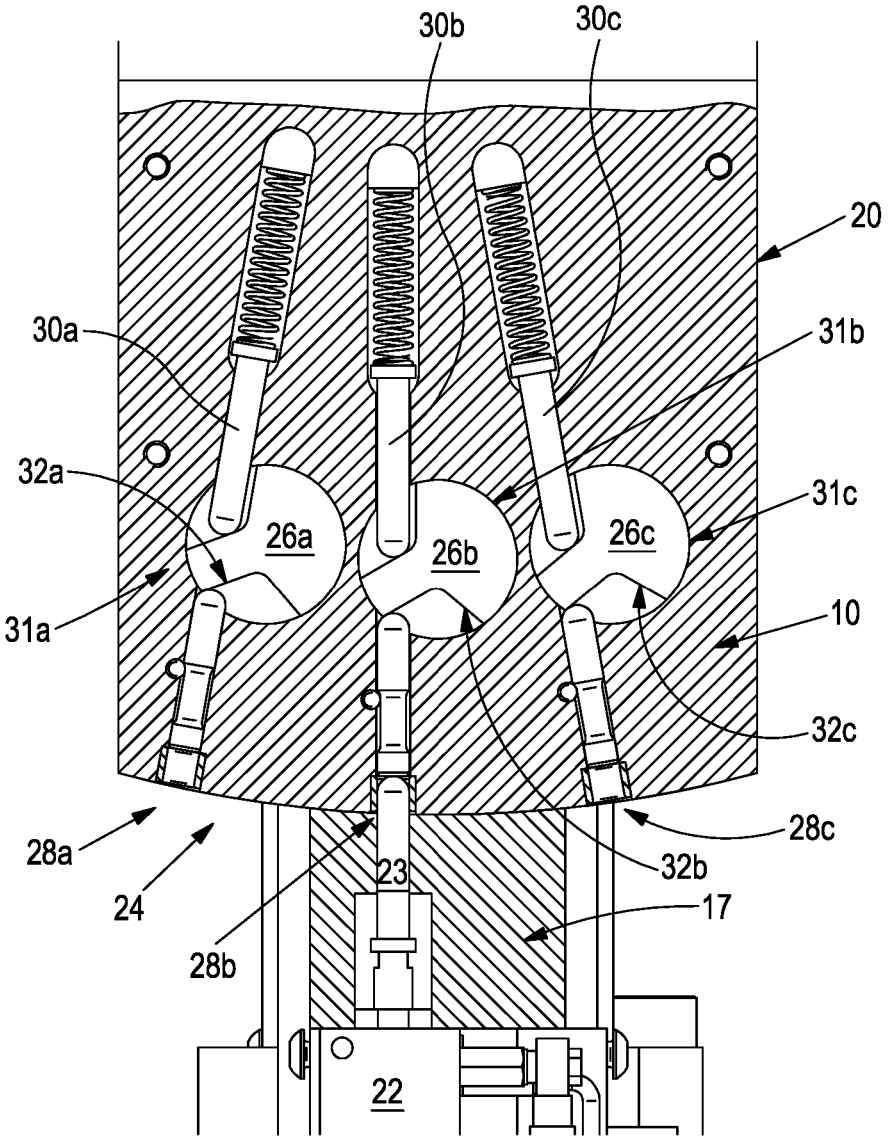
Figure 29:
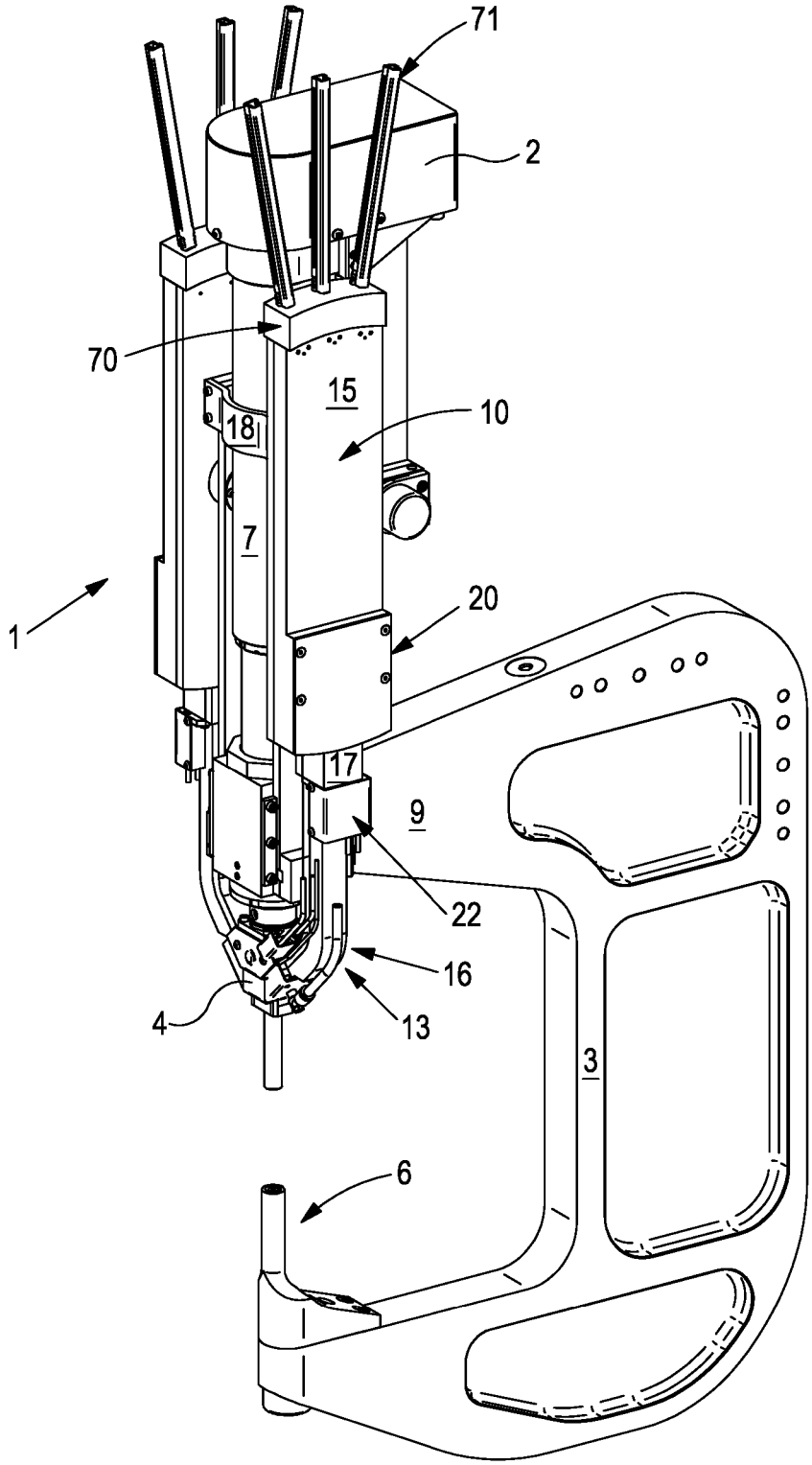
Figure 30:
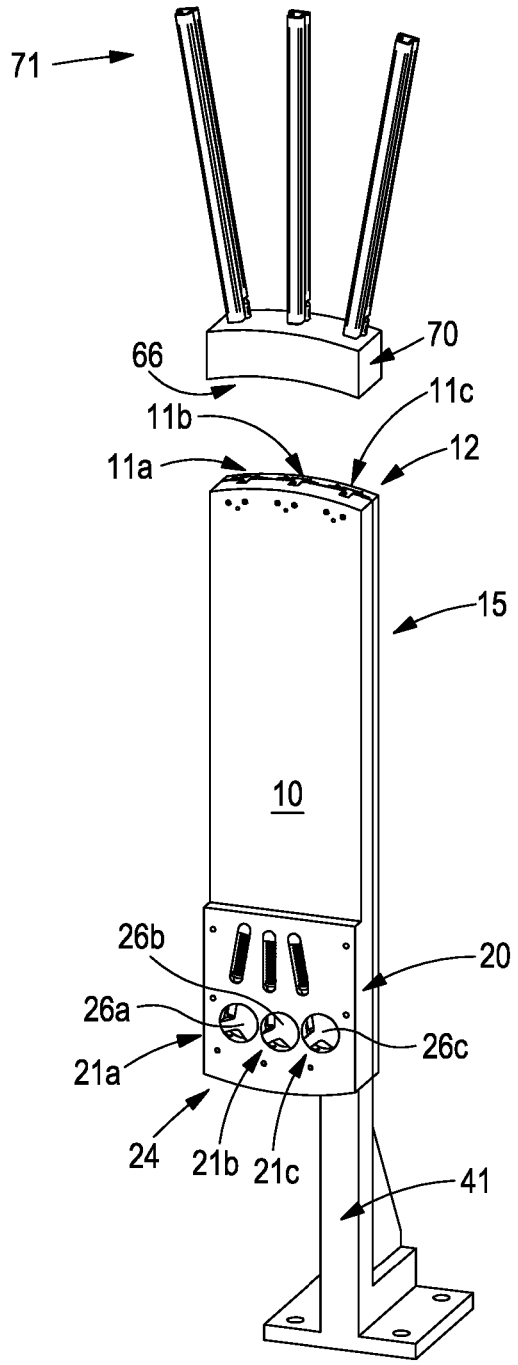
Figure 31:
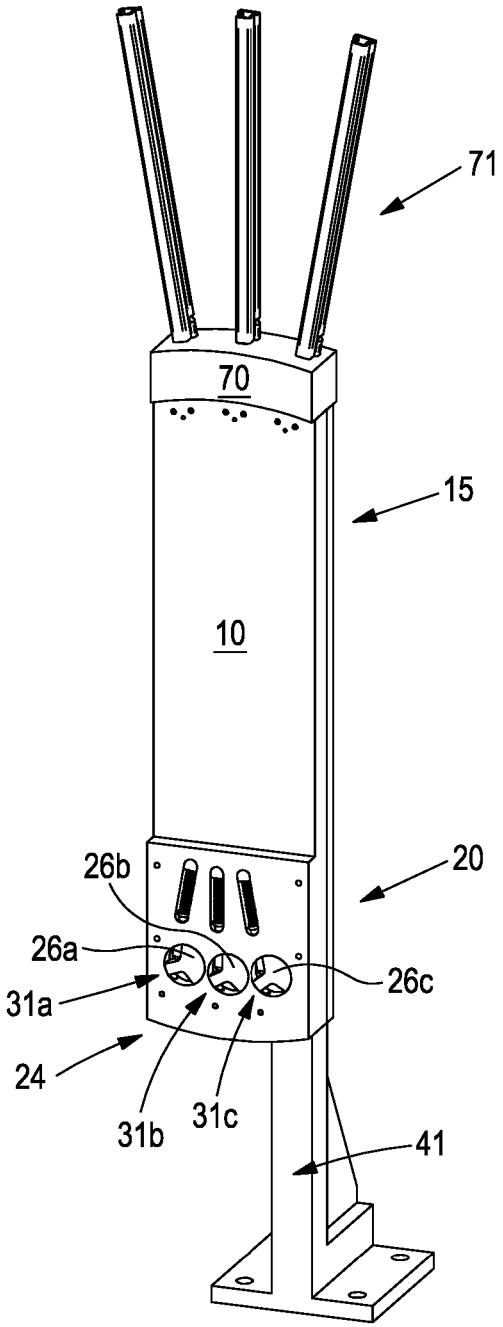
Figure 35:
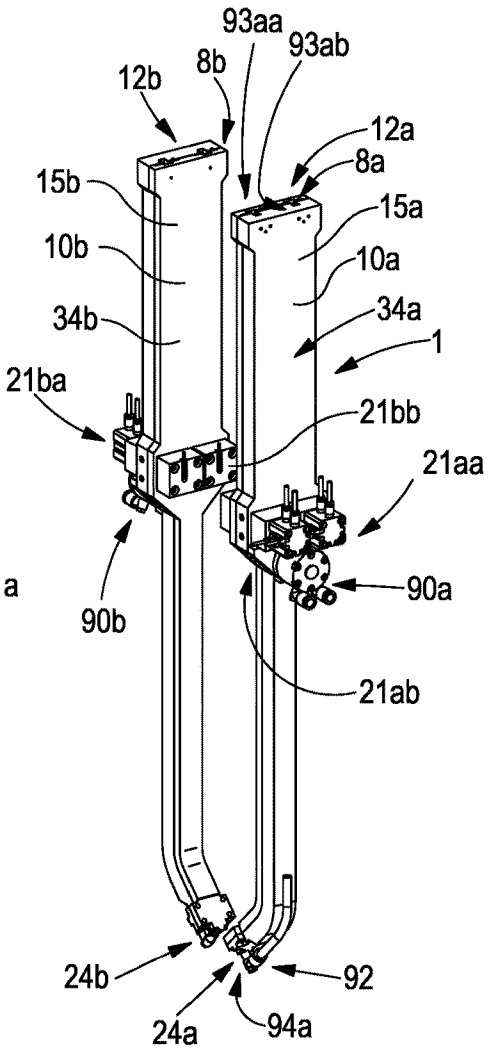
Figure 34:
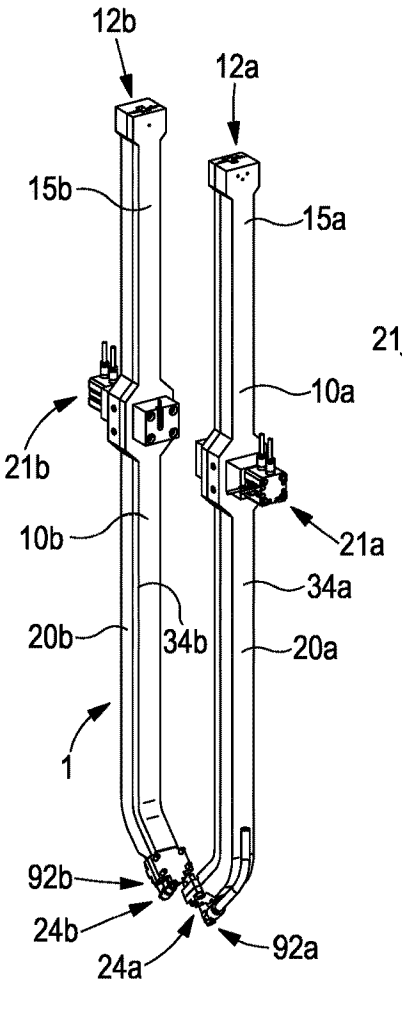
Figure 33:
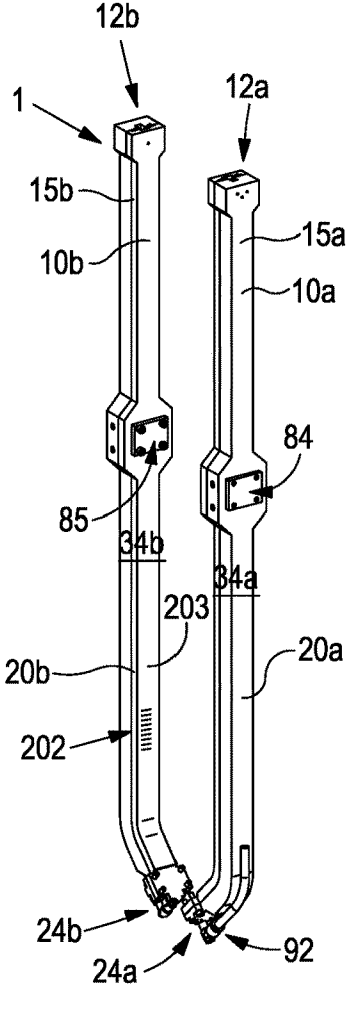
Figure 32:
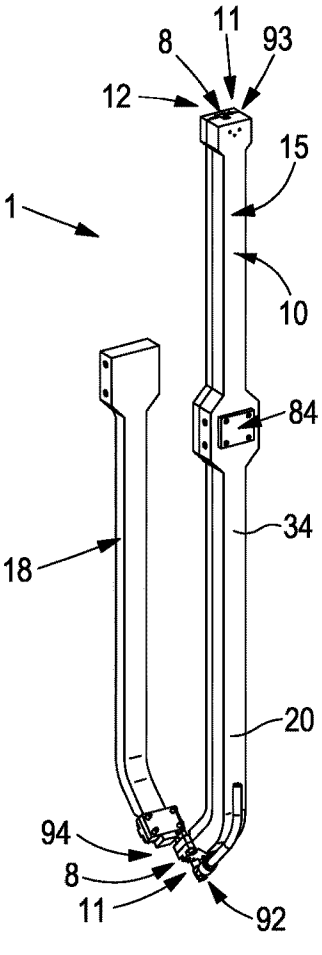
Figure 36:
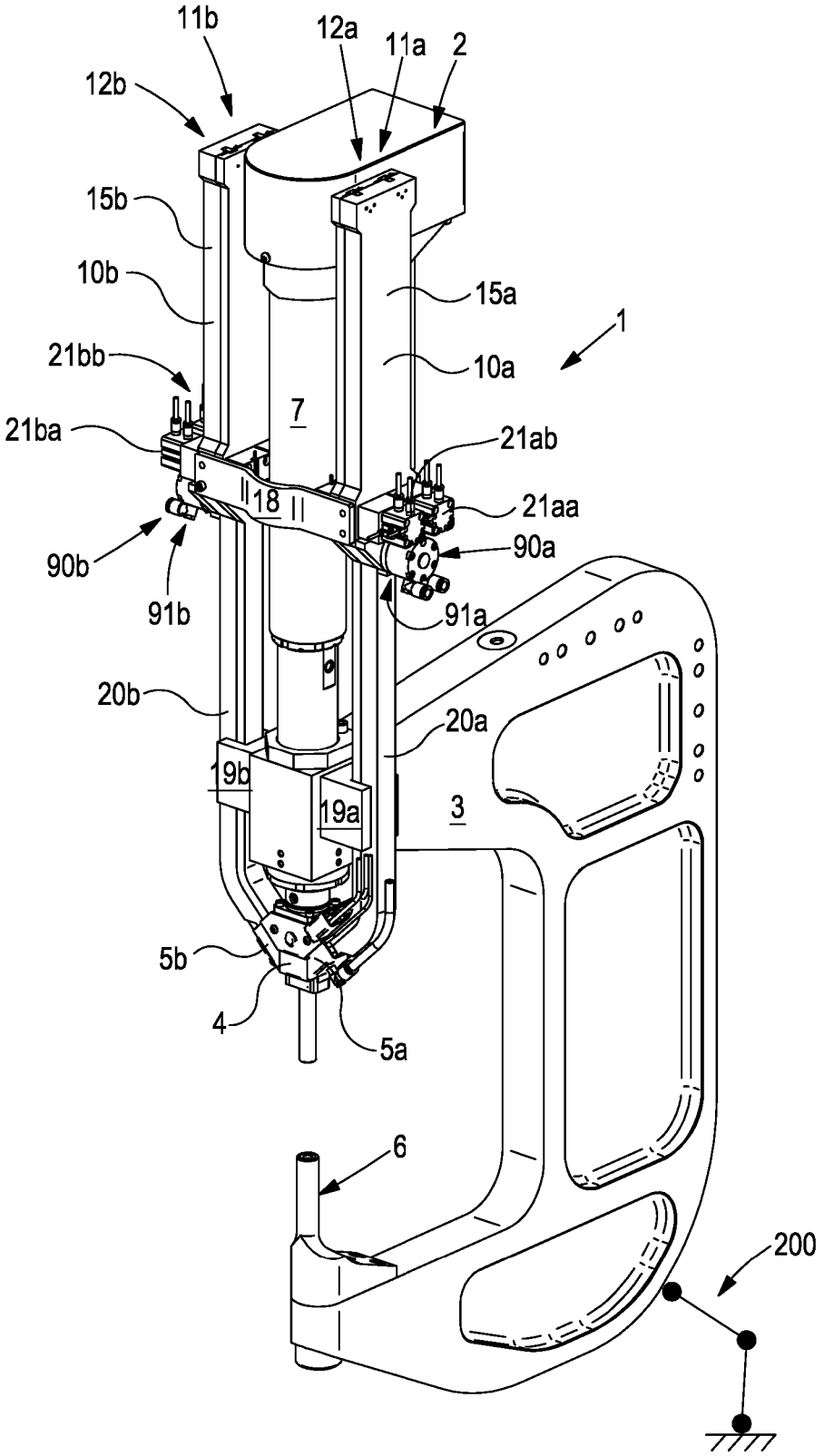
Figure 37A:
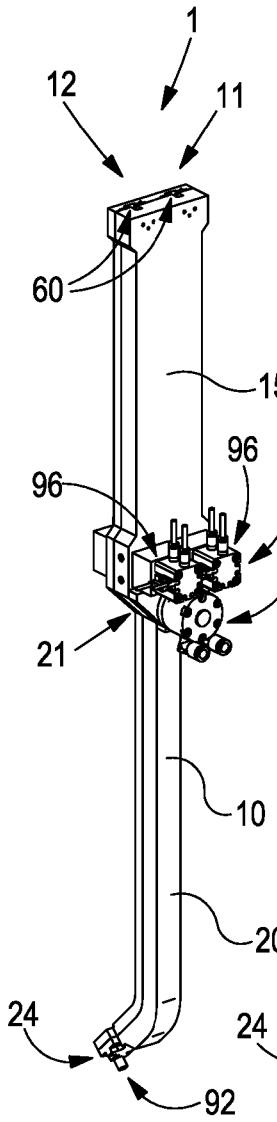
Figure 38A:
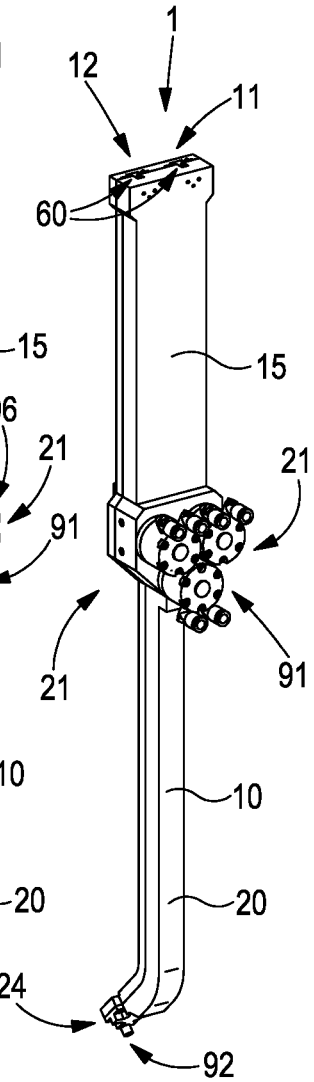
Figure 37B:
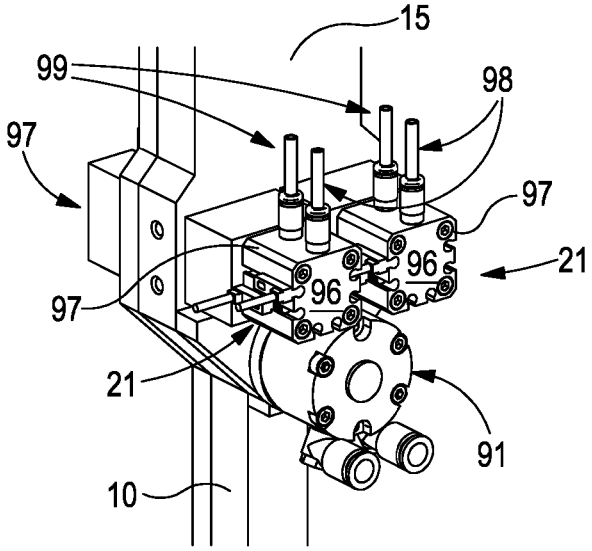
Figure 38B:
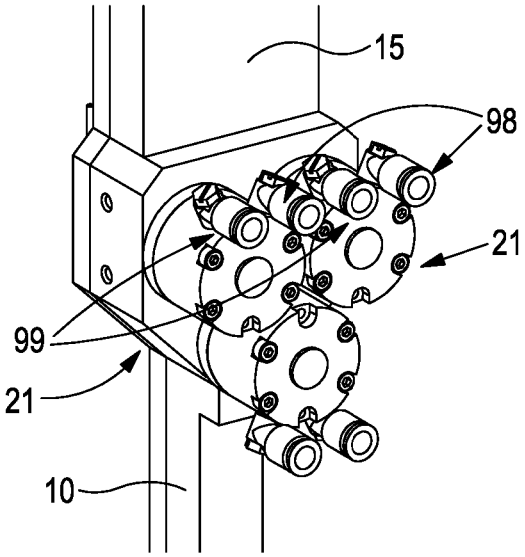
Figure 39A:
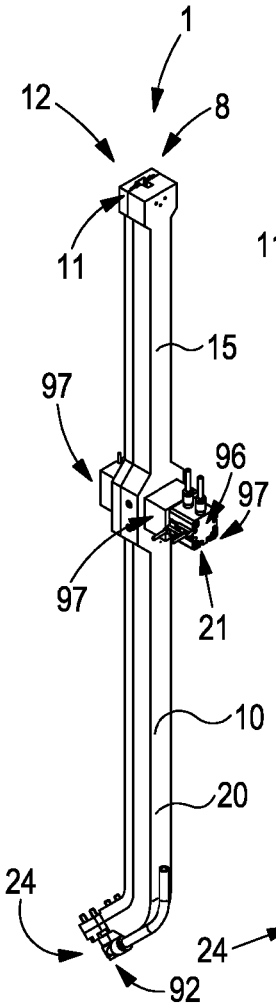
Figure 40A:
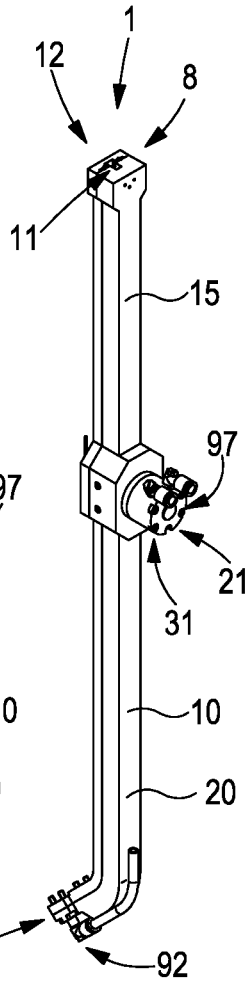
Figure 39B:
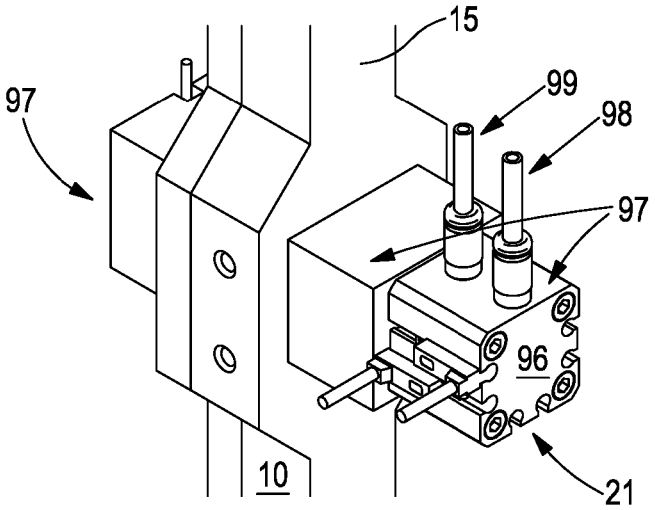
Figure 40B:
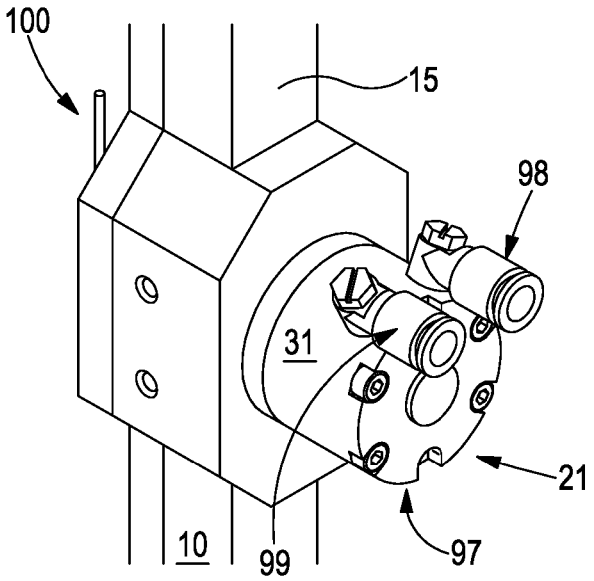
Figure 41:
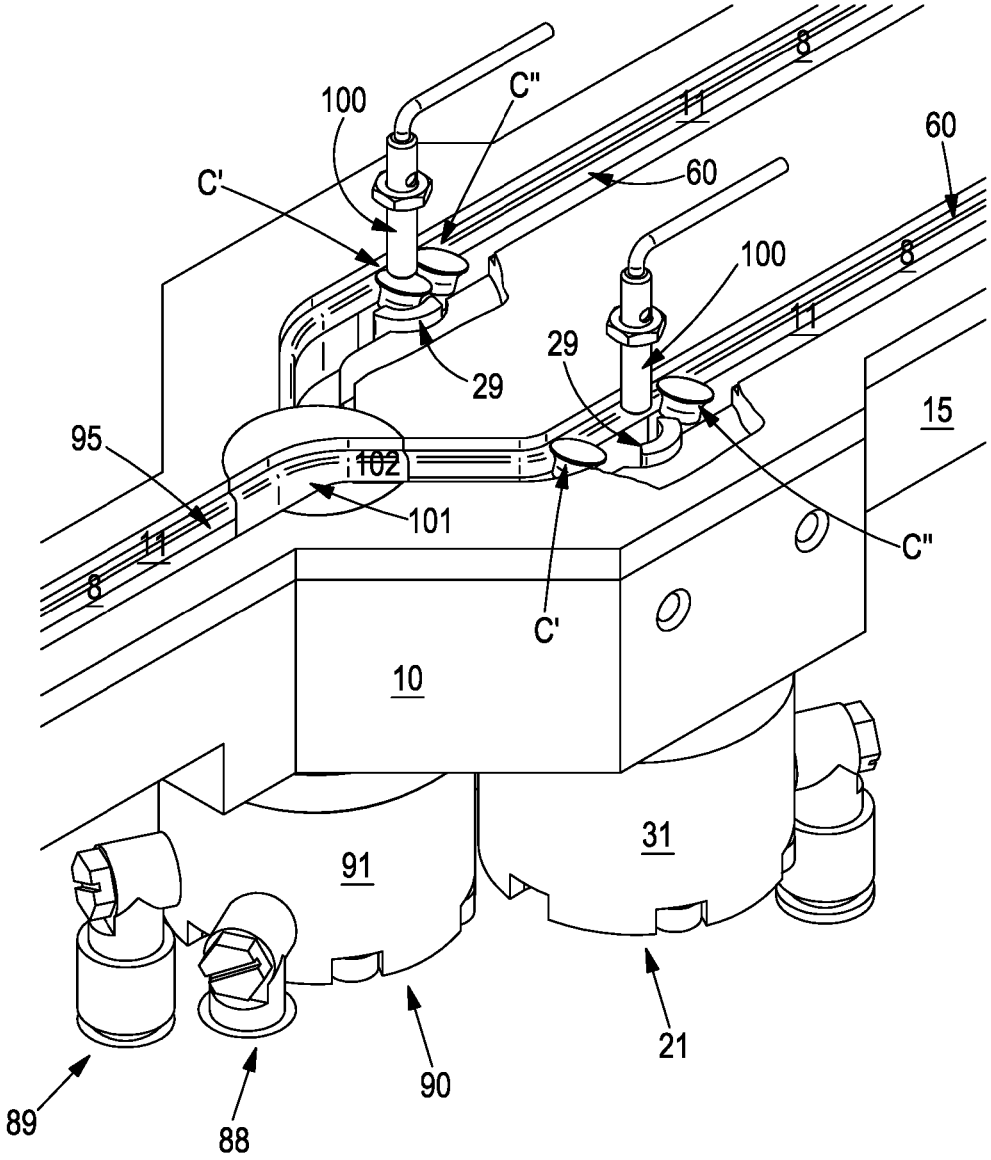
Figure 42A:
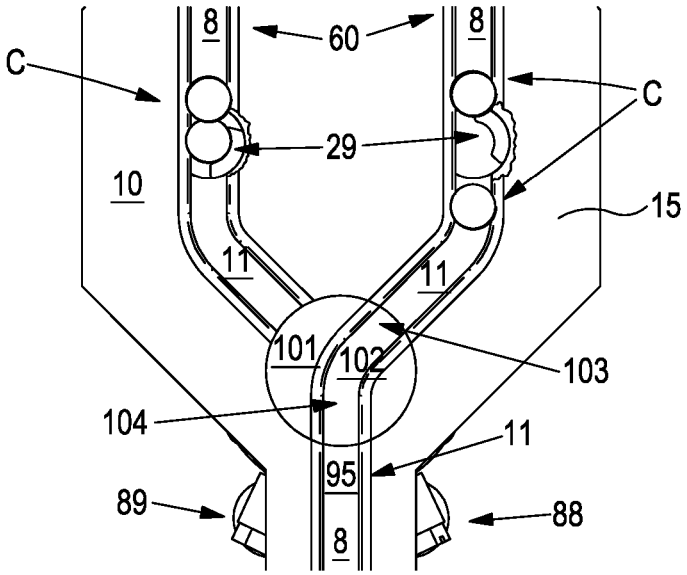
Figure 42B:
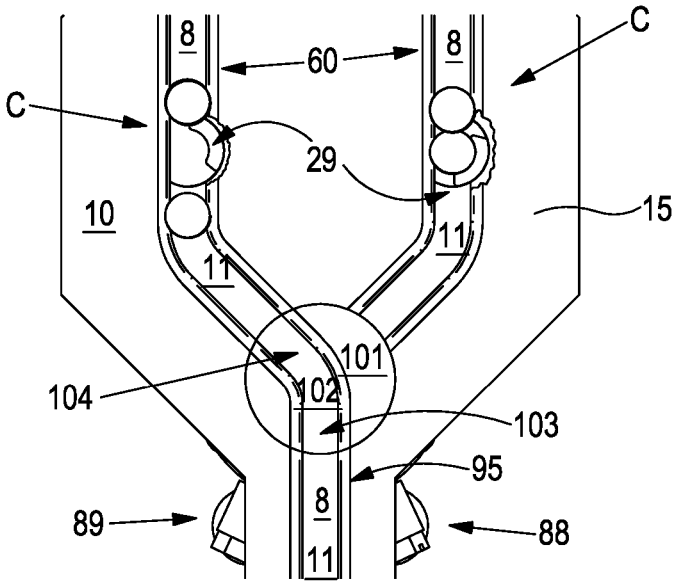
Figure 43A:
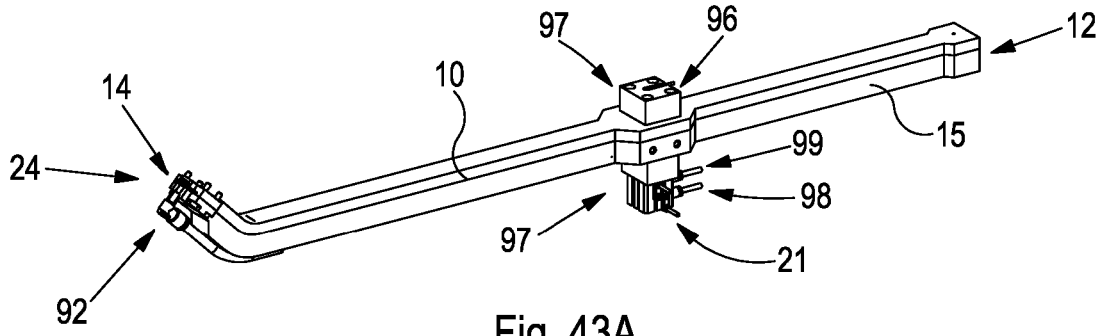
Figure 43B:
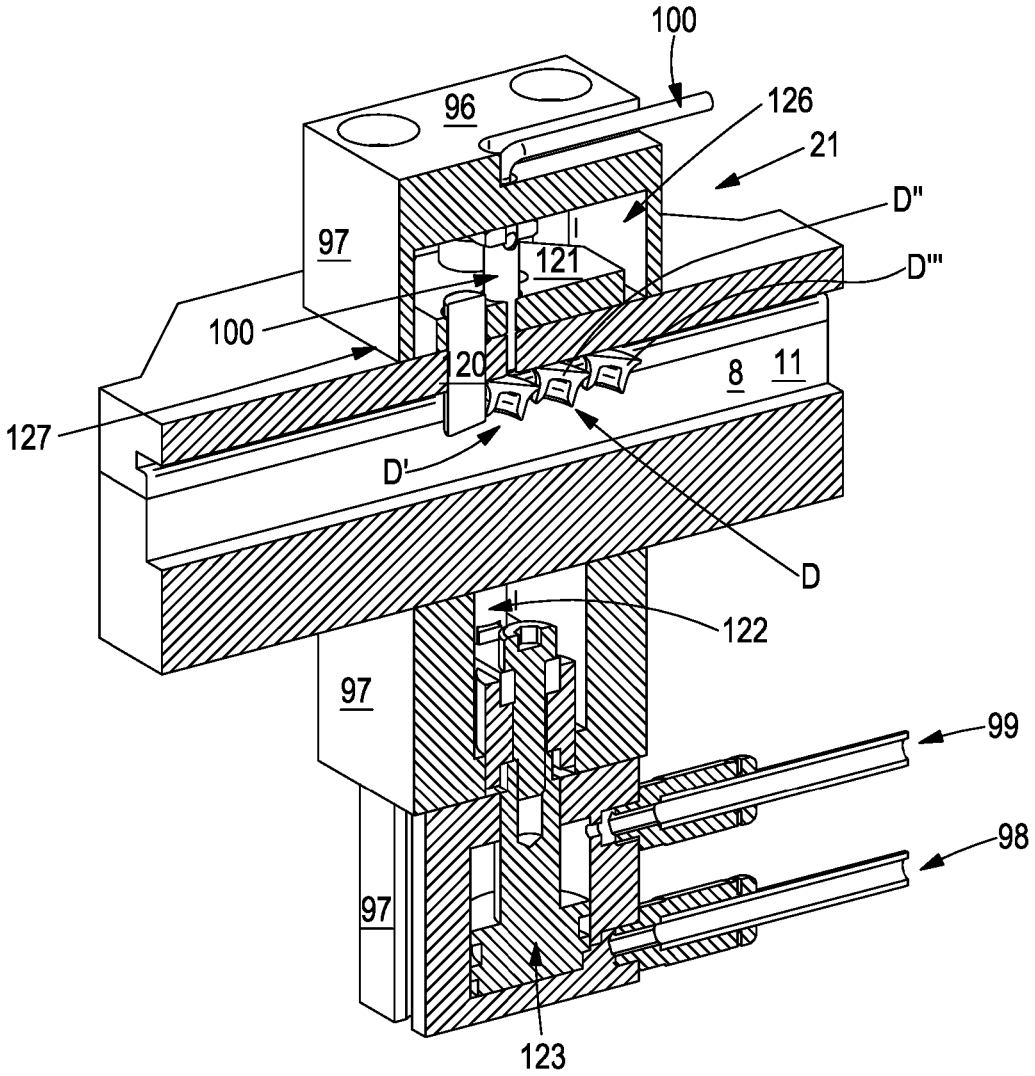
Figure 44B:
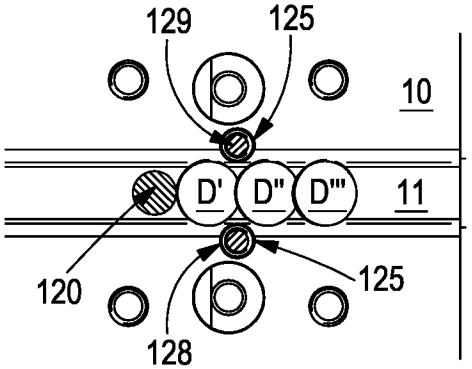
Figure 44C:
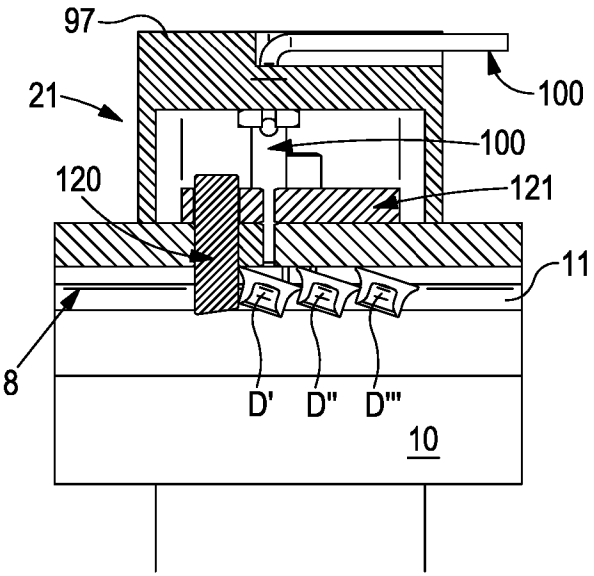
Figure 44A:
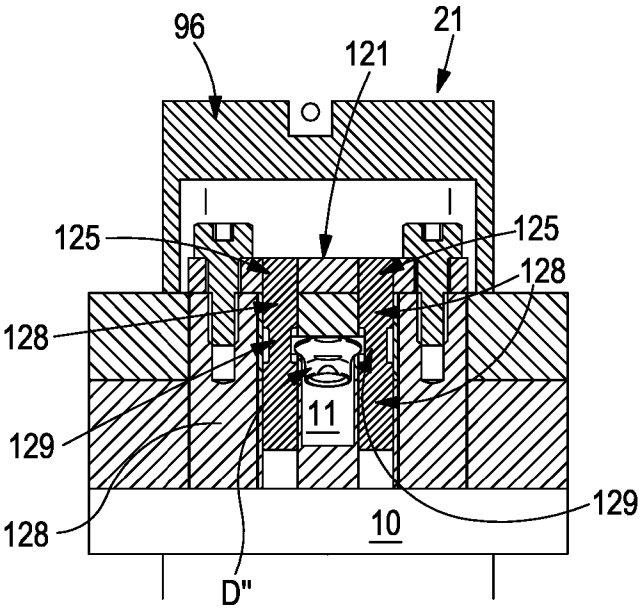
Figure 45B:
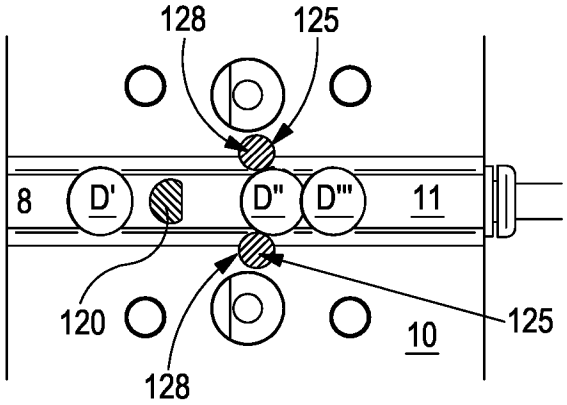
Figure 45C:
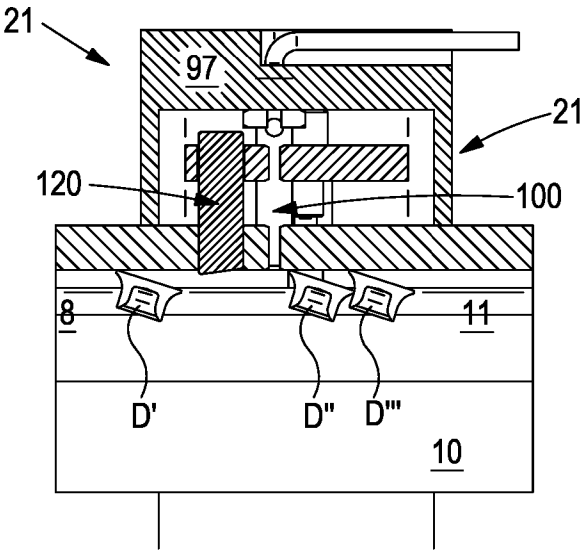
Figure 45A:
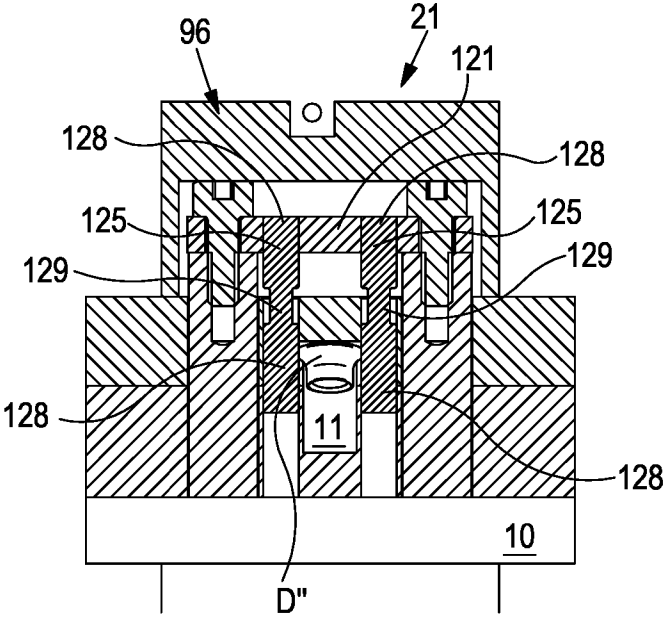
Figures 46, 47, 48:
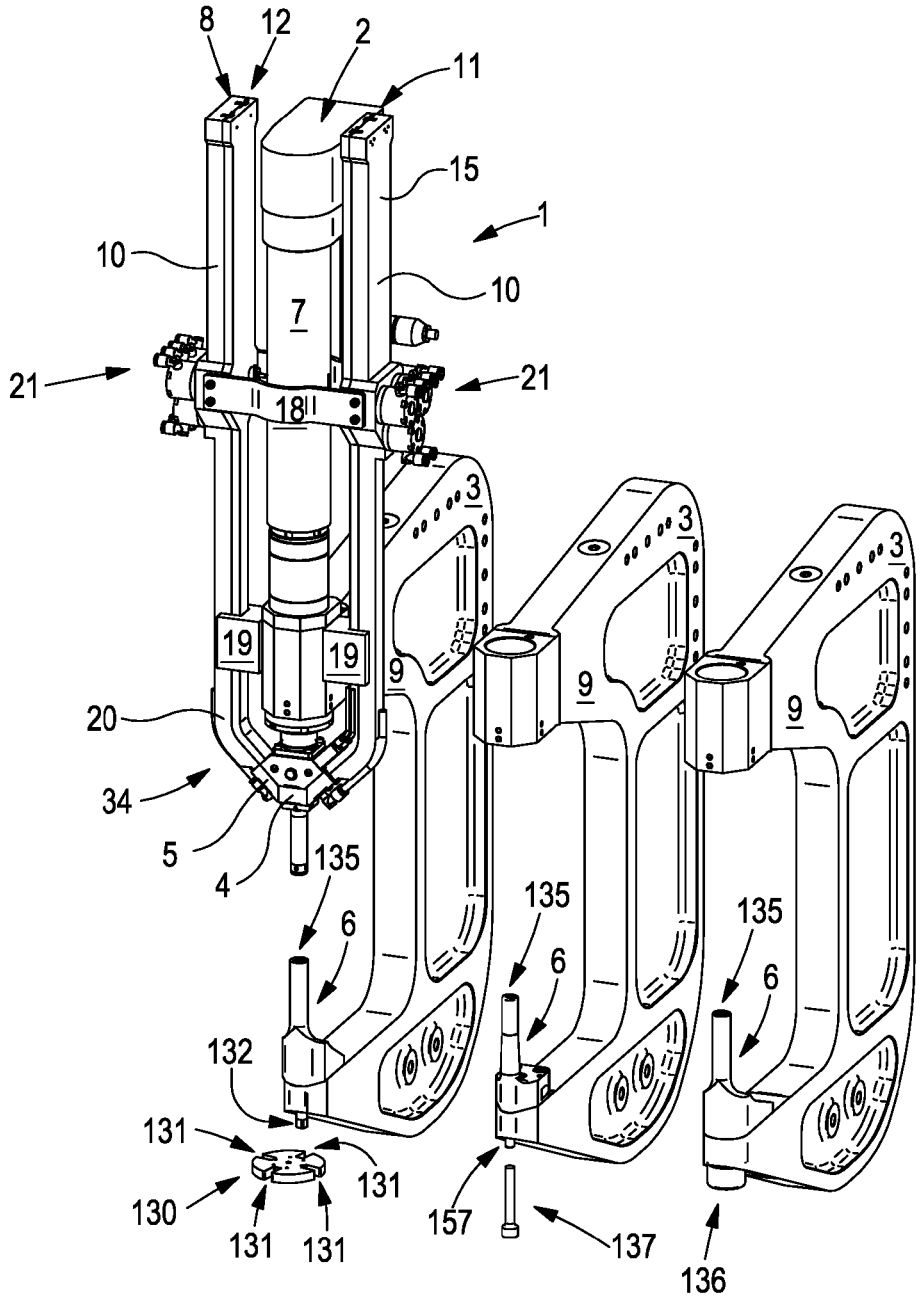
Figure 49A:
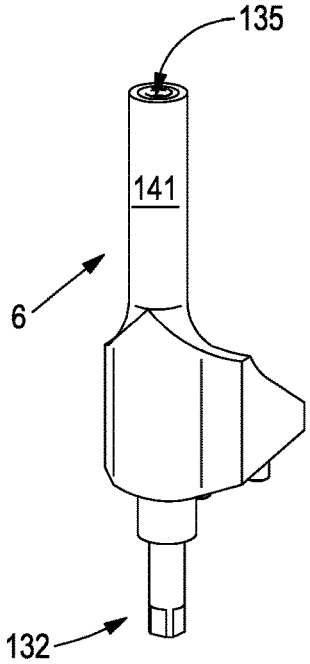
Figure 49B:
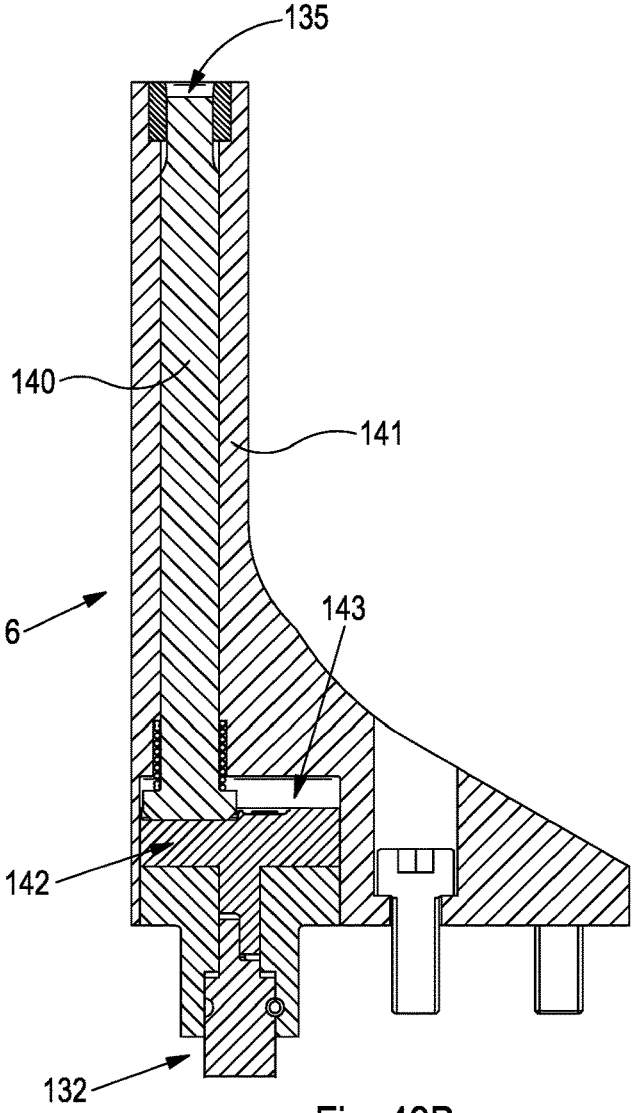
Figure 49C:
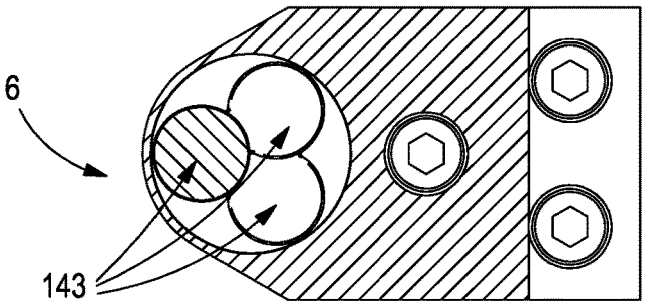
Figure 50A:
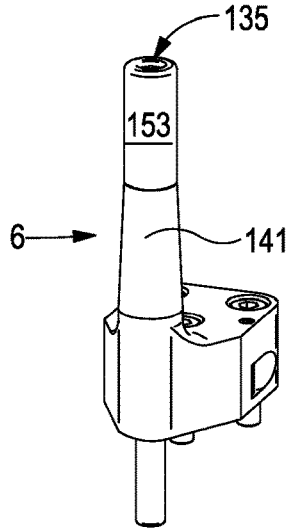
Figure 50B:
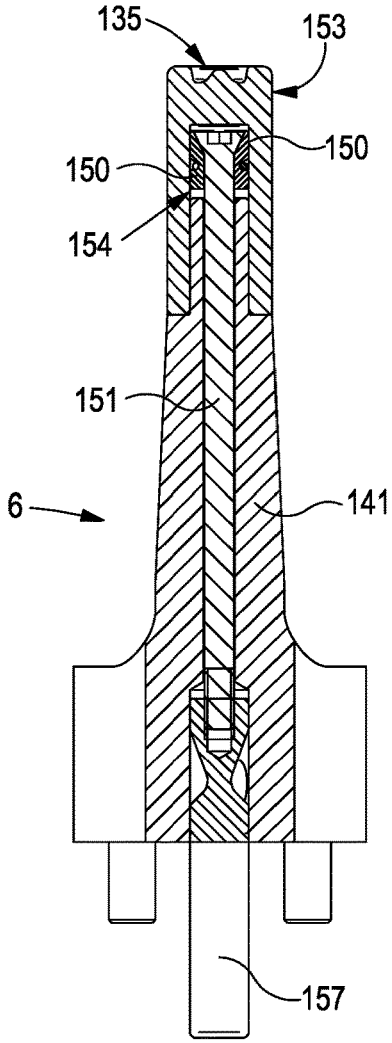
Figure 50C:
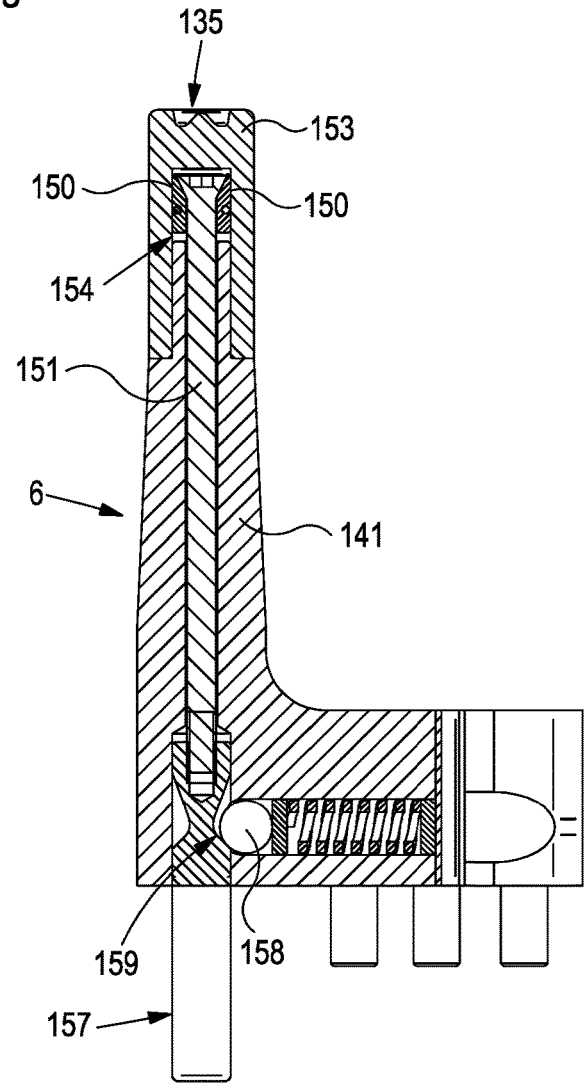

FIGS. 7A-B are, respectively, a side perspective view of parts of the rivet supply system in the configuration of FIGS. 3 and 4; and, an enlarged side perspective view of portions of FIG. 7A;

FIGS. 8A-C are, respectively, a plan view from the front (with a front plate removed); a plan view from the back with a cut-away portion; and, a plan view from the bottom; each view being of the distal end of the magazine of FIGS. 1-7 and of its actuator, showing the rotary cam escapement in a default configuration that stops two rivets;

FIGS. 9A-C are, respectively, a plan view from the front (with a front plate removed); a plan view from the back with a cut-away portion; and, a plan view from the bottom; each view being of the distal end of the magazine of FIGS. 1-7 and of its actuator, showing the rotary cam escapement in an actuated configuration that releases a rivet;

FIGS. 10A-B are, respectively, a perspective view from the front; and, a perspective view from the back; each view being of the components also shown in FIGS. 9A-C;

FIGS. 11A-C show an alternative magazine having a resiliently biased jaw escapement associated with each of the inlet and the outlet of the magazine;

FIG. 12 is a front perspective view of the rivet setting tool of FIGS. 1-6 with first and second carousel systems schematically shown on either side of the setting tool for supporting various replacement magazines and replacement die assemblies;

FIG. 13 is a front perspective view of the rivet setting tool of FIGS. 1-6 with first and second fixed support systems schematically shown on either side of the setting tool, each comprising racks for holding up to four replacement magazines, with respective docking blocks for refilling the magazines;

FIG. 14 is a side perspective view of the rivet setting tool of FIGS. 1-6 (without magazines connected thereto), with the C-frame including bracketry for supporting four replacement magazines on either side of the C-frame, with four fixed posts disposed around the setting tool, each for supporting a magazine, during a refill operation or a magazine replacement operation;

FIG. 15 is a schematic representation of a docking arrangement for refilling a magazine showing a magazine and a refill station including a pair of correlated-magnets docking interfaces;

FIG. 16 is a an alternative docking arrangement also including correlated-magnets surfaces;

FIGS. 17A-C are three examples of correlated-magnets docking interfaces;

FIG. 18 is a side perspective view of another rivet supply system for supplying rivets to a setting tool, mounted on a C-frame handled by a robotic arm (again only shown schematically), incorporating two refillable and replaceable pivotal rivet magazines, each disposed in a first angular configuration, with a front plate removed;

FIG. 19 is a front view of a back plate member of the pivotal rivet magazine of FIG. 18 showing the longitudinal extension of three magazine rivet track portions with respective rivets stopped thereon by respective rotary cam escapements;

FIGS. 20A-B show, respectively, enlargements of the proximal end and the distal end of the back plate of FIG. 19;

FIG. 21 is a side perspective view of the rivet supply system of FIG. 18 with the pivotal magazines each disposed in a second angular configuration;

FIG. 22 is a front plan view of the rivet supply system of FIG. 21;

FIG. 23 is a partially exploded side perspective view of the rivet supply system of FIGS. 18-22;

FIG. 24 is a side perspective view of the rivet supply system of FIGS. 18-23, with the nose arrangement of the setting tool in a partially extended configuration;

FIG. 25 is a side sectional representation of parts of the rivet supply system of FIGS. 18-24, with a pin member for actuating the rotary cam escapements in a retracted configuration;

FIG. 26 is a side sectional representation corresponding to that of FIG. 25, with the pin member partially extended;

FIG. 27 is a side sectional representation corresponding to those of FIGS. 25 and 26, with the actuator fully extended;

FIG. 28 is a side sectional representation corresponding to those of FIGS. 25, 26 and 27, with the actuator partially retracted;

FIG. 29 is a side perspective view of the rivet supply system of FIGS. 18-28 showing a docking block docked to one of the magazines on each side of the setting tool, for refilling the magazines in-situ;

FIG. 30 is a front perspective view of one of the pivotal magazines of FIGS. 18-29 detached from the setting tool and supported on one of the stands represented in FIG. 14, showing a docking block in an undocked configuration;

FIG. 31 is a front perspective view corresponding to that of FIG. 30, with the docking block docked to the magazine for refilling the magazine while supported on the stand;

FIG. 32 is a side perspective view showing a single-sided magazine arrangement including an alternative, single-track refillable and replaceable rivet magazine predisposed for, but not equipped with, a rivet handling device located part-way along the magazine, and an opposing elongated bracket;

FIG. 33 is a side perspective of a dual-sided arrangement including two mirrored single-track magazines of the type also represented in FIG. 32;

FIG. 34 is a side perspective of a dual-sided arrangement including two mirrored single-track magazines each equipped with a linear-pin escapement disposed about half-way along the magazine (note that these are the same magazines as represented in FIGS. 11A-C);

FIG. 35 is a side perspective of a dual-sided arrangement including two mirrored double-track magazines, each equipped with two linear-pin escapements disposed on upper tracks of the magazine, and a rotary track selector located downstream of the linear-pin escapements;

FIG. 36 is a perspective view of another rivet supply system for supplying rivets to a setting tool, mounted on a C-frame handled by a robotic arm (again, only shown schematically), incorporating two double-track refillable and replaceable rivet magazines disposed on either side of the setting tool, of the type also shown in FIG. 35;

FIGS. 37A-B are, respectively a side perspective view of the magazine of FIG. 34, in single-sided configuration; and, an enlarged perspective view of a portion thereof;

FIGS. 38A-B are, respectively, a side perspective view of a single-sided arrangement including an alternative double-track magazine incorporating two alternative rotary cam escapements disposed on upper tracks of the magazine, and a rotary selector located downstream of the rotary cam escapement; and, an enlarged perspective view of a portion thereof;

FIGS. 39A-B are, respectively, a side perspective view of the magazine of FIG. 34 in single-sided configuration; and, an enlarged perspective view of a portion thereof;

FIG. 40A-B are, respectively, a side perspective view of an alternative single-track rivet magazine in single-sided configuration incorporating the rotary cam escapement of FIGS. 38A-B; and, an enlarged perspective view of a portion thereof;

FIG. 41 is a perspective view of the internal arrangement of the magazine of FIGS. 38A-B, showing two conventional rivet sensors;

FIGS. 42A-B are plan views of the of the internal arrangement of the magazine of FIGS. 38A-B showing, respectively, a rivet being released on one or the other of the upper tracks of the magazine, with the rotary selector oriented accordingly to select the required upper track;

FIGS. 43A-B show in more detail the magazine of FIG. 34 and the operation of its linear-pin escapement;

FIGS. 44A-C illustrate in more detail the operation of the linear-pin escapement of FIGS. 43A-B;

FIGS. 45A-C illustrate in more detail the operation of the linear-pin escapement of FIGS. 43A-B;

FIG. 46 shows a first die adjustment option using external die adjustment means;

FIG. 47 shows a die replacement option;

FIG. 48 shows a second die adjustment option using internal die adjustment means;

FIGS. 49A-C are, respectively, a front perspective view of the die assembly of FIG. 46; a sectional side view of the die assembly of FIG. 46; and, a top plan view, partly in section, of the die assembly of FIG. 46; and, FIGS. 50A-C are, respectively, a front perspective view of the die assembly of FIG. 47; a front view, partly in section, of the die assembly of FIG. 47; and, a sectional side view of the die assembly of FIG. 47.

DESCRIPTION

In the present description, first the meaning associated to certain terms or phrases used herein will be introduced. The context of the presently described fastening operations will also be briefly discussed.

Reference will then be made to FIGS. 1-17 to describe the most important features of the present disclosure.

Finally, FIGS. 18-50 will also be described, albeit to less extent than FIGS. 1-17, particularly to discuss a number of alternative arrangements to those described with reference to FIGS. 1-17.

Introduction

We describe in particular self-piercing rivet setting machines of the type that set self-piercing rivets, for example, on plates of various thicknesses, for manufacturing vehicle bodies such as automobile frames and/or panels. Nonetheless, the skilled person will understand that at least some of the teachings herein are equally applicable to different setting tools, and/or to a more general description of fasteners.

The self-piercing rivet setting machines described herein are usually incorporated into a robotic arm so that they can travel and be positioned where required within a working area, according to many different orientations. To achieve this, a rivet setting tool, which has a punch for setting the rivets, is mounted on a C-frame which is in turn mounted on the robotic arm. The robotic arm may be operable to translate and/or rotate the setting tool according to several degrees of freedom. The robotic arm is only schematically shown in the drawings and will not be described herein in further detail. However, the operation of the robotic arm will be described in some further detail in connection with certain aspects of the present disclosure. It will be apparent that the rivet supply arrangements described herein are particularly suited to setting tools mounted on such C-frames and/or robotic arms.

As described herein, "nose arrangement" identifies the arrangement of the working end of the rivet setting tool. The punch travels through the nose arrangement to guide a rivet towards the workpiece and sets it into the workpiece. The nose arrangements described herein are mounted on a piston/cylinder arrangement operated by a servo mechanism on the setting tool. The nose arrangements described herein are thus movable and extend away from the setting tool to come into contact with the workpiece, thus preparing for a setting operation.

In or adjacent such nose arrangements, there are provided one or more designated "rivet-receiving areas" or "rivet transfer areas" where the rivets (having reached the end of their travel from a bulk feeder, or other-bulk storage system, to the nose arrangement, along the rivet supply system) await so that they can then be, in turn, transferred to a stand-by position under the punch to be set into the workpiece one at a time.

"Nose assembly" identifies a sub-assembly of the nose arrangement that more specifically serves to guide the rivet and the punch, after that the punch has engaged the rivet during a rivet setting operation. The nose assembly is not described herein in detail.

The action of the punch on the workpiece during a setting operation is resisted by a "die assembly" located at a receiving end of the C-frame. Certain die assemblies are described herein in some detail.

As mentioned above, "rivet setting operation" identifies the travel that the punch undertakes for setting a rivet into the workpiece. However, the mechanics of these operations is not described herein in detail since the present specification is mainly concerned with how the rivets are stored, and then supplied to the setting tool, and with how the rivets can be replenished in the magazine(s) when required.

Since the rivet supply systems described herein are suited to the supply of rivets from a bulk-storage apparatus to a setting tool, attributes such as "proximal" and "distal" are generally referred to the one-way direction of travel of the rivets through the supply system. Thus, for example, the "proximal end" of a rivet magazine identifies the end of the magazine where the rivets enter the magazine. The "distal end" of the magazine identifies the end of the magazine where the rivets exit the magazine to or towards the nose arrangement.

The various features shown in the Figures have been assigned reference numerals as customary. For clarity, however, where the same or an equivalent feature has been shown in connection with different arrangements, this feature (at least in the vast majority of cases) has been assigned the same reference numeral.

Multiple instances of the same feature shown in the drawings have been labelled using small-case letters suffixed to the reference numeral assigned to that feature. For example, multiple magazine portions of the rivet delivery track are labelled 11*a*, 11*b*, 11*c*. However, when general reference has been made to that feature, the reference numeral may have been used without the small-case letter suffix. For example, to designate in general said multiple magazine portions of the rivet delivery track reference numeral 11 may have been used.

The self-piercing rivets described herein are labelled with capital letters, for example A, B, C, etc. However, it will be apparent that other fasteners may be suited to be supplied to a setting tool according to the principles described herein. Nonetheless, the fasteners being in the form of rivets or self-piercing rivets are preferred features of at least some aspects disclosed herein.

Different positions or orientations assumed by a given component have been labelled using apexes following the reference numeral assigned to that component, or to a feature identifying said position. For example, the pivotal magazines in the positions shown in FIG. 21 have been labelled 10*a*', 10*b*', with reference numeral 10 identifying the magazines in general, and reference numerals 10*a*, 10*b* referring to the individual magazines on the right and left-hand sides of the setting tool. The leading and trailing rivets A shown in FIGS. 10A-B are likewise designated A' and A", given their different positions.

The attribute "independent" with reference to any rivet tracks, or portions thereof, has been used to mean that said independent tracks/portions do not intersect, or otherwise interact with regards to the flow of the rivets therethrough. In other words, these tracks/portions do not share any segments in common. Accordingly, the passage of the rivets in these independent tracks/portions can be independently regulated or controlled on each independent track/portion.

The attribute "independent" with reference to any described external means for supporting the magazines has been used to mean that such means are provided as separate entities with respect to the setting tool, the C-frame and/or the robotic arm on which the C-frame is mounted.

The attribute "passive" referred to a mechanism denotes the absence of a dedicated actuator operated by external means. Thus for example a pair of resiliently biased jaws for controlling the refill of rivets at the proximal end of the magazine are classed as a passive mechanism for the purposes of the present specification even though the jaws are initially biased in a closed position by a set of springs, and can be opened by the abutment (ie coupling, or docking) of the magazine with, for example, a magazine refill device such as a docking block, as will be further described herein.

The attribute "active" referred to a mechanism instead denotes the presence of a dedicated actuator operated by external means (eg an electric servo-mechanism, or a pneumatic mechanism operated by pneumatic lines) to control the position and/or the configuration of one or more elements of the mechanism itself according to an external command or signal. Thus for example a rotary cam mechanism that operates on a rivet delivery track to selectively release one or more rivets on said track upon operation of a dedicated actuator, which is in turn operated upon receipt by a controller or the like of an appropriate signal or command, is classed as active.

The term "replaceable" refers to a rivet magazine disposed in rivet-supply relation or rivet-supply engagement in the rivet supply line, and which can thus be removed to be replaced, ie substituted, with another identical or similar magazine, for example with another magazine which stores rivets, of the same or a different type, while the replaceable magazine is empty. This other magazine is instead referred to as a "replacement" magazine. The attribute "replacement" when used in conjunction with one or more magazines thus denotes one or more magazines that are ready for replacing a replaceable magazine, for example because the replaceable magazine is empty (for example because all of the fasteners initially stored therein have been used) and the replacement magazine is full, or partly full. It is understood that examples are not limited to the replacement of a replaceable, empty magazine with a replacement, full magazine. Alternatively, it may be necessary to substitute a partially full magazine with a magazine storing rivets of a different type and/or size, as a requirement for example of a particular fastening sequence. The replacement magazine may be full, or may have been only partly filled with the rivets. Alternatively, the substitution may be between an operable magazine and a magazine which is known to have been damaged, or which cannot operate, for any occurring reasons.

Each magazine described herein, in its most basic form, is a generally elongated tubular structure with a portion of the rivet supply line that runs internally through it. The rivets can thus be stored, as a line or a queue, in the magazine and, when required, can be released from the magazine to supply the setting tool. The cross-sectional shape of the rivet supply line described herein is a "T-shape" adapted to generally conform, with clearance, to the shape of the self-piercing rivets described herein. The rivets thus travel generally transversally with respect to the generally longitudinal extension of the rivet supply line through the magazine. However, other cross-sectional shapes are in principle possible, and these will mainly depend on the shape and/or dimension of the fasteners. Further, the rivets, or other types of fasteners, could in principle be made to travel maintaining a longitudinal orientation rather than travelling transversally. However, in the self-piercing rivet fastening applications described herein this alternative may not be preferred.

The magazines described herein are generally constructed by joining together back and front plate members each formed with suitable grooves to obtain the T-shaped cross sections of the rivet delivery tracks when the plate members are joined together to form the magazines. We will not provide any additional details relating to the specific construction of the magazines throughout this description, but, as will be apparent, a variety of magazine designs, constructions and materials are possible, including traditional materials, such as metals, including ferromagnetic metals, or non-ferromagnetic materials such as suitable polymeric materials.

The magazines, and other accessory structures described herein, may include one or more "patterned magnets", that is magnets having surfaces patterned with regions characterized by opposed magnetic polarities or signs (ie "north" and "south", or "plus" and "minus") as a result of magnetic structures (ie magnetic domains) arranged in alternate order within the patterned magnets.

Patterned magnets concentrate their resulting magnetic field closer to their surface than traditional magnets. Patterned magnets may thus be used to generate dense, local magnetic fields which may be used to strongly attract a ferromagnetic material disposed in close proximity to said magnets without affecting other spaced away ferromagnetic elements. The exposed surfaces of these patterned magnets are referred to herein as "magnetically patterned surfaces".

It is possible to arrange the above patterns/surfaces to achieve different resulting magnetic fields. It is thus also possible to program pairs of magnetically patterned surfaces to generate location-dependent forces to achieve various desired mechanical effects between such magnets and, therefore, between the structures that accommodate such magnets. We thus also refer to these pairs of patterned magnets as "correlated" magnets or "programmed" magnets. Pairs of "correlated" magnetically patterned surfaces or "complementary" magnetically patterned surfaces of this type may thus be designed to achieve a variety of mechanical performances that go beyond simple magnetic attraction, or magnetic holding force. We describe herein certain mechanical performances that can be obtained by providing suitable pairs of magnetically correlated surfaces which are advantageous, for example, in applications such as docking a rivet magazine to a refill station, or to a setting tool, or supporting a rivet magazine on a support structure provided on the setting tool, or elsewhere. These magnetically correlated patterned surfaces are also referred herein as "correlated-magnets surfaces", because of their mutual magnetic correlation. Reference is made to the research carried out by Larry W. Fullerton about a decade ago, the results of which are known from literature, including from patent literature.

For the purposes of the present description, magnetically correlated surfaces or correlated-magnets surfaces may be obtained in a number of different manners, including using permanent magnets, electromagnets or other equivalent field emission structures (although the latter may be less preferred in the rivet fastening applications described herein). Further, such correlated-magnets surfaces may vary widely as regards the specific geometry of their patterns. Moreover, such surfaces can be part of one or more magnetic inserts, such as one or more patterned magnets incorporated into, for example, the magazines. Alternatively, as mentioned above, they can potentially be induced (in a way akin to 'printing')

on any of the magazine surfaces, if the magazines are made, at least partly, of a ferromagnetic material.

Induced or printed individual magnetic elements (also known as "maxels") may thus be arranged to form correlated pairs of patterned magnets that interact via their correlated-magnets surfaces. These magnetically correlated surfaces can be designed to achieve the desired mechanical functions and can have different sizes, and be disposed in a number of different ways. It is not within the scope of the present application to describe any particular patterns or geometries related to said correlated-magnets surfaces and their mechanical functions. Instead, it is noted that adequate patterned magnets for forming pairs of useful correlated magnets can readily be purchased, for example, from Correlated Magnetics Research, LLC, at the time of writing the present specification from website www.polymagnet.com. Suitable correlated-magnets surfaces may otherwise be fabricated.

Product reference 1001107 from www.polymagnet.com, for example, is a two-dimensional (2D), one inch-square alignment patterned magnet which can be paired with another patterned magnet of the same type via opposed faces having complementary (ie correlated) polarity patterns. Thus one face has a given polarity pattern on the one patterned magnet, and the opposed paired face has a corresponding, negative-image polarity pattern on the other patterned magnet. Pairs of 1001107 correlated magnets can thus provide a two-dimensional alignment function with a holding force and an alignment shear resistance. This means that when the correlated-magnets surfaces of these patterned magnets are perfectly aligned, a holding force perpendicular to the magnetically engaged surfaces of the 2D magnets is generated together with a small, or null, alignment (shear) force. When the magnets are brought out of alignment (this can be done with a relatively small force), starting from the position of perfect alignment, the holding force decreases. Simultaneously, the alignment force increases and tends to realign the magnets.

Contact between engaged magnetic surfaces is not a requirement for magnetic interaction between a pair of correlated magnets, although contact may be a preferred feature. For example, holding perpendicular and shear forces of similar magnitude between the correlated magnets described above would nevertheless be generated if a small gap was present between the respective magnetically correlated surfaces. However, the resulting forces would be correspondingly weaker. This could be the case if a layer of a protective or compliant material, such as a protective film, was used to coat the correlated-magnets surfaces. The mechanical performance of the correlated magnets may also be affected by other characteristics, for example the presence and/or size of a layer of backing material disposed on the back of the correlated magnets.

Pairs of different correlated magnets having different magnetically correlated surfaces provide different mechanical functions defined by different sets of magnetically generated forces which depend on the relative positioning between the correlated magnets as well as on the actual shape of the patterns. Note that to achieve some of these function, the correlated magnets may have to be constrained in at least one degree of freedom.

The magnetically generated mechanical forces described herein may fulfil different functions including "alignment", as seen above in the case of correlated magnets 1001107. However, other possible mechanical functions may also be useful for the purposes set forth in the present description, for example:

"coupling" (also referred to herein as "connection"), that is the generation of a substantially attractive holding force (with shear and/or perpendicular components). Note that coupling is also achieved by the above 'alignment' correlated magnets 1001107. For example, when the alignment magnets 1001107 are perfectly aligned, they develop a coupling (or connection) force;

"latch", which involves the switch between a mildly repulsive force and a relatively stronger coupling force, as two correlated magnets are moved closer to each other;

"spring", which involves the generation of a stronger attractive or repulsive force, as two correlated magnets are moved further away or closer to each other in an axial direction, respectively. This function can be used, for example, to bias a magazine towards a docking interface, and this will be described in further detail below; and "release", which involves instead the generation of a relatively strong repulsion force as the two correlated magnets are sheared away one from the other.

The above list is not exhaustive. For example, similar functions are contemplated which relate to angular positioning, or degree of rotation, between the correlated magnets (eg "torsional alignment", "torsional spring" or "torsional latch").

It will further be appreciated that the above general mechanical behaviours are not mutually exclusive in that a given pair of correlated magnets may simultaneously behave according to multiple behaviours at a given time, depending on the relative positioning between the magnets.

As mentioned above, importantly the mechanical behaviour of correlated magnets generally changes with the relative positioning of the magnets to provide an overall 'mechanical experience'. At any given position, however, one of the above behaviours may be predominant. Within the scope of the present application, various possible practical uses of mechanical performances described in connection with and achieved by pairs of correlated magnets are presented, within the broad context of fasteners supply and storage applications.

"Docking interface" as used herein refers to a surface of a component (this could be for example the magazine) that has appropriate features to establish a rivet-supply communication with another component presenting a corresponding or complementary docking interface provided on that other component. The term "docking", therefore, is in the present description always used in connection with at least one rivet supply track. For example, a rivet supply track may be disposed in rivet-supply relation with a bulk-supply apparatus by docking the magazine directly to the bulk-supply apparatus, or by docking the magazine to an intermediate docking device that has a suitable docking interface. This docking device could, for example, be a docking block connected to the bulk-supply apparatus via one or more lengths of flexible tubes.

When instead mechanical connections are more generally described for the purpose of supporting a component, for example a replacement magazine, on a support structure such as a stand, general terminology such as "support", "supported", "connection", "connected", or more specific terminology indicating the manner of said support or connection such as "latch", "latched", "guide", "guided" is used. Thus, a replacement magazine may be supported on a stand while it is in non-rivet supply relation within a rivet supply line, for example while the magazine is not docked to the rivet supply line. To support the magazine on the stand, a magnetic pad may for example be provided on the magazine. The magnetic pad may comprise a patterned magnet. The stand may comprise a correlated patterned magnet. Alternative supporting means are however also possible. To dock the magazine to the nose arrangement, a U-shaped guide may for example be provided on the C-frame to guide the magazine in a direction substantially parallel to the punch.

A number of passive and active rivet handling devices are described herein which serve a variety of purposes at different stages of the progress of the rivets through a rivet delivery line. It is not within the scope of the present application to describe these devices in detail. However, their role in connection with the handling of the rivets through the rivet supply line will be described.

The first type of rivet handling devices encountered henceforth can be defined as "active in-line rivet selection devices". These devices are actuated via an external actuator and their purpose is, at the required time, to release a selected rivet on the rivet delivery track. Examples of active in-line rivet selection devices are "rotary cam escapements" and "linear pin escapements". Both will be briefly described herein. The main difference between these two types of devices is that the rotary cam escapement utilises rotary actuation of a cam device to release the selected rivet, while the linear pin escapement utilises linear actuation to move one or more pin-shaped barriers to release the selected rivet. The cam devices and pin-shaped barriers can in principle have many different forms, and some are described herein in some detail.

The second example of rivet handling devices briefly described herein can be defined as "active track selection devices". These devices are also actuated via an external actuator and their purpose is to connect one or another of multiple upper portions of a rivet delivery track to a common, lower portion of the rivet delivery track within the magazine. An example of an active track selection device is a "rotary track selector". In the rotary track selector, a rotary member rotates to join one of many possible upstream portions of the rivet delivery track with a common downstream portion of the rivet delivery track via a curved rivet delivery track portion located in the rotary selector, so that rivets can be transferred from the selected upper (or upstream) track to the common lower (or downstream) track. However, different active track selection devices would be possible.

The third type of rivet handling devices briefly described herein can be defined as "passive in-line rivet release devices". These devices are not actuated in the sense required by the devices identified above. Rather, these passive devices are by default biased to a default position, such as a close position. Depending on their use, in the closed position these devices may, for example, prevent one or more rivets from exiting the magazine, or may prevent one or more rivet from entering the magazine. These devices may be switched to their open position by, for example, contact of the magazine with other mechanical parts of the system designed to cooperate with the magazine, for example with a rivet transfer device provided in the nose arrangement, or a docking interface, to respectively transfer a rivet in the stand-by position under the punch, or to refill the magazine with fresh rivets.

It will by now be clear that the emphasis of the present patent specification is on the storage and supply of rivets in proximity of the setting tool. A complete rivet supply line usually extends from the bulk-storage apparatus to the setting tool. However, we do not focus on the bulk-supply end of such rivet supply lines. Rather, we focus on the last portion of these rivet supply lines, close to the setting tool, and we provide at least one (typically removable and replaceable) magazine to store a quantity of rivets close to the setting tool. The magazine(s) are, in use, in rivet-supply relation with the nose arrangement of the setting tool. It is thus possible, and in some cases preferable, to mount the magazines so that they are supported by the nose arrangement, which is part of the setting tool. The setting tool is, however, ultimately supported by the C-frame, and the magazine(s) is/are also, therefore, ultimately supported by the C-frame.

The C-frame usually incorporates appropriate brackets, guides or other like mechanical elements to guide and facilitate docking between a magazine and the nose arrangement, or between the magazine and an accessory such as a chute or the like, disposed between the magazine and the nose arrangement. Further, following a reverse sequence, these components may also facilitate the replacement of a docked magazine. In this way, the replaceable magazine is undocked from the setting tool. These support components may be provided according to a large variety of designs. Only a few such designs are described herein in some detail. A further function of these brackets is, in preferred designs, to guide the magazine so that the magazine is adequately supported when it moves in unison with the nose arrangement to prepare for a setting operation. This will be further described below.

FIGS. 1-17

Figure 1:
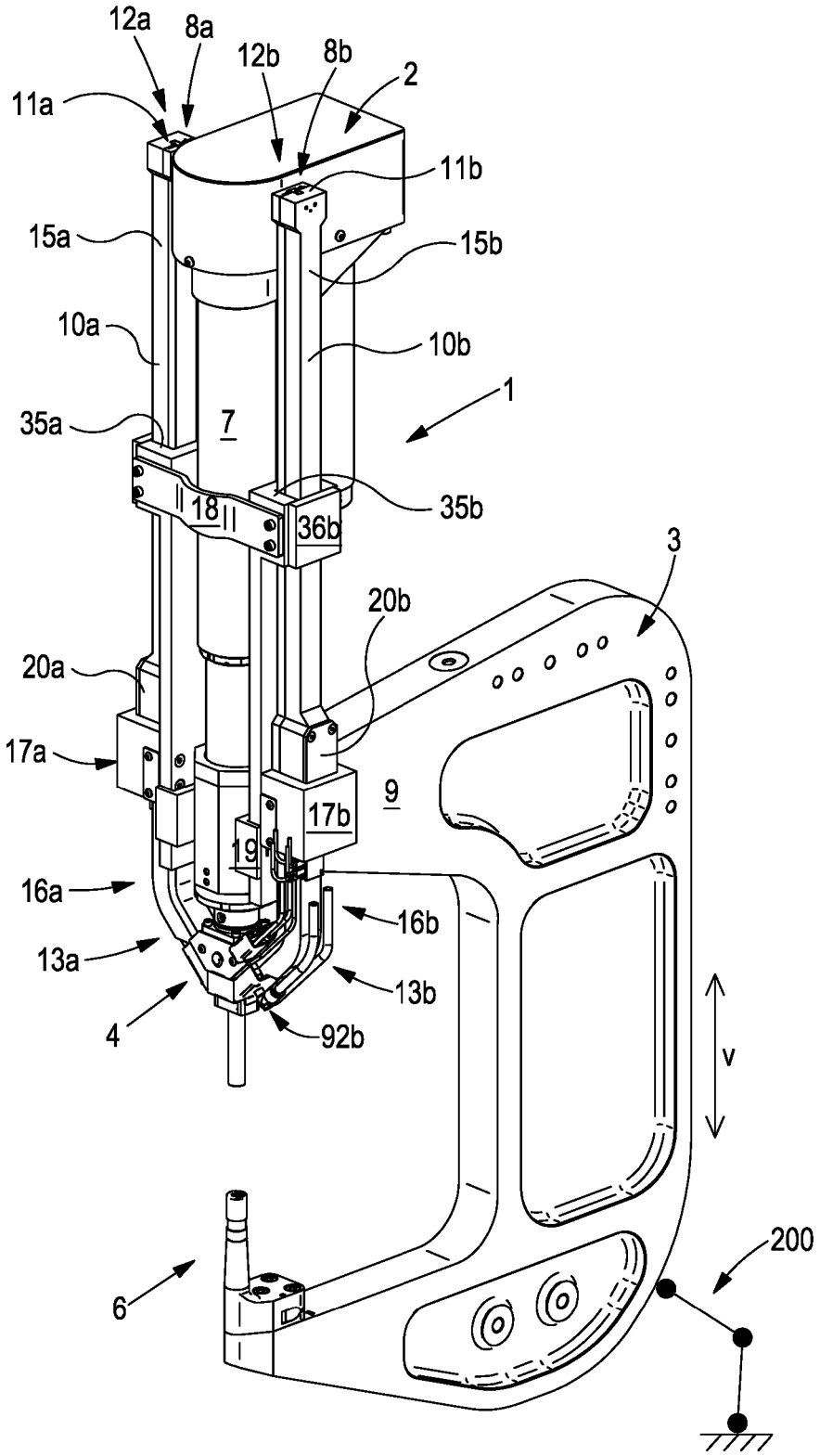
FIG. 1 is a side perspective view of a rivet setting tool including a rivet supply system for supplying rivets to the setting tool, mounted on a C-frame handled by a robotic arm (only shown schematically), and incorporating two refillable and replaceable rivet magazines.
Figure 2:
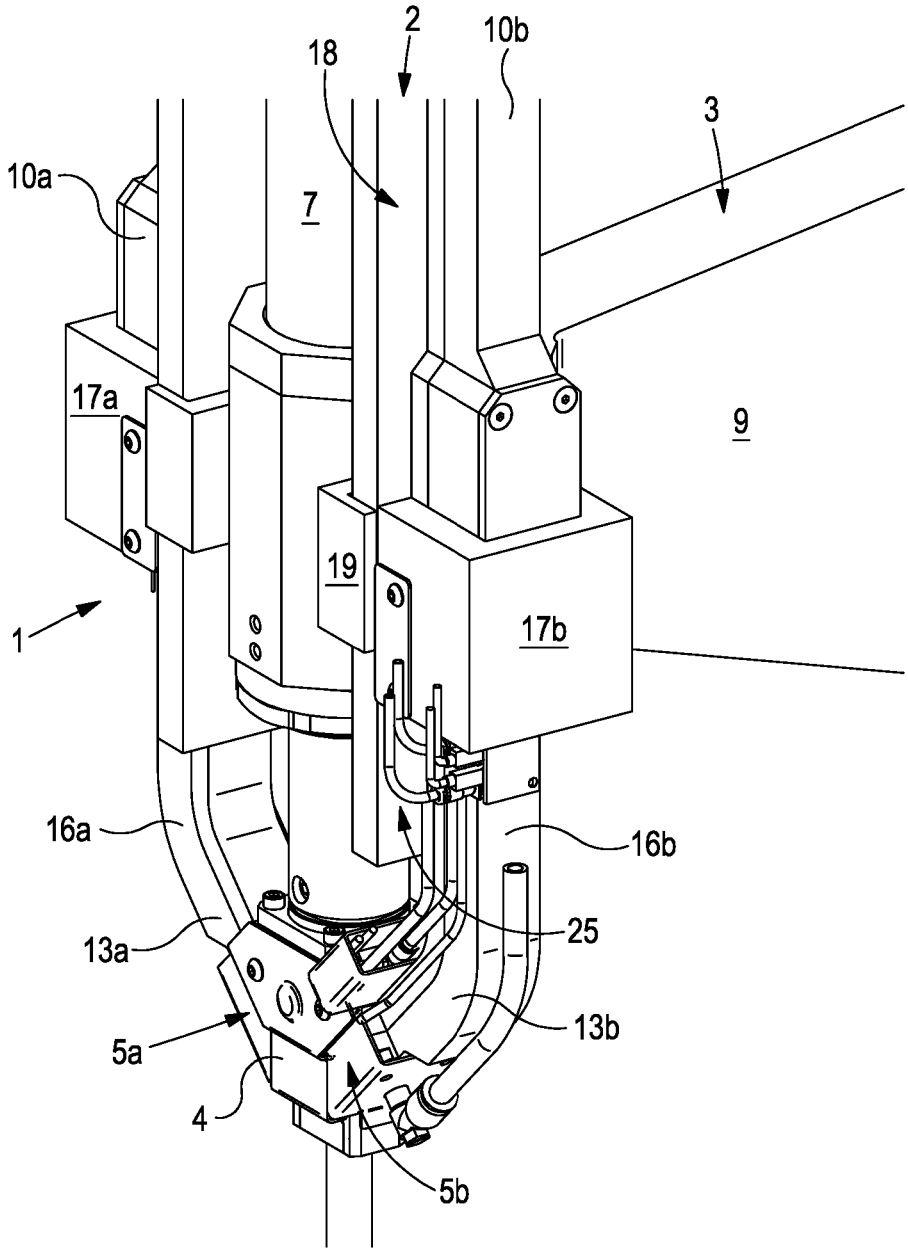
FIG. 2 is an enlarged side perspective view of the setting tool of FIG. 1, with a nose arrangement of the setting tool in a partially extended configuration.

Referring now to FIGS. 1-2, there are shown some key components of the presently described arrangements, in particular a rivet supply system 1 as described herein. The system 1 is for supplying rivets to a rivet setting tool 2. The rivet setting tool has a punch (not shown) for setting the rivets. The setting tool is mounted on a C-frame 3, as known in the art. The C-frame 3 is provided at the working end of a robotic arm 200.

The setting tool 2 comprises a nose arrangement 4 that defines at least one rivet-receiving zone or rivet-transfer zone 5*a*, 5*b* within or adjacent to it. Here, two rivet-transfer zones 5*a*, 5*b* are defined on, respectively, the left-hand side and the right-hand side of the setting tool 2 as shown in FIG. 2. At each of these zones, a delivered rivet awaits transfer under the punch in preparation for a setting operation. A die assembly 6 is provided opposite the nose arrangement 4. The nose arrangement 4 is mounted on piston/cylinder mechanism 7 which is part of the setting tool 2, and is thus movable to approach (and retract from) the die assembly 6. FIG. 2 shows the nose arrangement 4 in an extended configuration with respect to the configuration shown in FIG. 1, with the piston/cylinder mechanism 7 clearly shown in extended position, as evidenced by the distance between the nose arrangement 4 and the upper working end 9 of the C-frame. The C-frame 3 can be moved so as to locate a workpiece (not shown) between the nose arrangement 4 and the die assembly 6. This is in preparation for a rivet setting operation carried out by the setting tool 2.

Two magazines 10*a*, 10*b* are provided in mirror configuration on the left and right-hand sides of the setting tool 2 as shown in FIG. 1. Accordingly, two rivet delivery tracks 8*a*, 8*b* are provided through the magazines 10*a*, 10*b* in this arrangement, one on each side of the setting tool 2. These tracks 8 extend internally, through the magazines 10, in axial/longitudinal directions substantially parallel to the punch. The magazines 10*a*, 10*b* are each docked to a respective chute 16*a*, 16*b*. The chutes 16 thus connect in rivet-supply engagement the magazines 10 to the nose arrangement 4. In the mirrored-supply configuration shown in FIGS. 1-2, two rivet supply lines are provided one opposite the other, and the rivets can be supplied to the nose arrangement 4 from either the left or right-hand sides.

At the distal ends 13*a*, 13*b* of the chutes 16*a*, 16*b*, two passive in-line rivet transfer devices (not shown in FIGS. 1-2, but shown in FIGS. 11A-C) hold and then release, as and when required, any rivets that have been delivered from the magazines 10 to the chutes 16. The rivet magazines 10 shown in FIGS. 1-2 can be docked to and undocked from the respective chutes 16, and this feature will be described in further detail below. However, the chutes 16 and the magazines 10 may otherwise be formed as integral or 'single-piece' magazines disposed on the right-hand side and/or the left-hand side of the setting tool. These integral magazines would be docked directly to the nose arrangement 4. One such magazine is shown for example in FIGS. 11A-C. FIG. 11C, in particular, shows a rivet transfer device 14 of the type described herein disposed at the distal end of the magazine 10 rather than at the distal end 13 of the chute 16. This is the same transfer device which, although not visible, is disposed in the arrangement of FIGS. 1-2 at each distal end 13*a*, 13*b* of each chute 16*a*, 16*b*.

Each rivet delivery track 8*a*, 8*b* thus extends through a corresponding magazine 10*a*, 10*b* and, further, through the corresponding chute 16*a*, 16*b*, if the chutes 16 are provided. It is accordingly possible to identify a magazine portion 11 of the rivet delivery track 8 in each magazine 10. In the arrangement shown in FIGS. 1-2, consequently, there is also defined on each side of the setting tool 2 a chute portion 33 (visible in FIGS. 5 and 6) of the rivet delivery track 8. The chute portion 33 of the rivet delivery track 8 extends through the chute 16 in exactly the same way as the magazine portion 11 of the rivet delivery track 8 extends through the magazine 10. On each side of the setting tool 2, the magazine portion 11 of the rivet delivery track and the chute portion 33 of the rivet delivery track 8 together define a complete rivet delivery track 8 as described herein. It is not essential that two (or more) rivet delivery tracks 8 supply rivets to the setting tool. In alternative configurations, there is only one magazine 10 disposed on one side of the nose arrangement 4 (see for example the arrangement shown in FIG. 32) to supply the rivets to the setting tool 2.

Each magazine 10*a*, 10*b* defines at its proximal end 15*a*, 15*b* an upper docking interface 12*a*, 12*b* for refilling the magazine 10*a*, 10*b* from a bulk-storage apparatus (not shown). The magazines 10 can thus be refilled in-situ, if required, by docking the magazines 10 to the bulk-storage apparatus via the upper docking interfaces 12 according to any one of various possible refilling procedures, some of which will be described in the paragraph below.

A docking block 70 (one is shown in FIG. 13) with a mating docking interface 66 can for example be provided to dock with the magazine 10 in-situ. Alternatively, the C-frame 3 can be moved, and together with it the magazine 10, by the robotic arm 200 close to the bulk-storage apparatus and then the magazine can be connected to the bulk storage apparatus directly. Alternatively, the magazine 10 can be removed from the setting tool and refilled at a separate location, or the magazine 10 can be refilled while still mounted on the setting tool 2 but at an intermediate refill station which is in turn refilled from the bulk-storage apparatus, or continuously fed from the bulk-storage apparatus.

As can also be seen in FIGS. 11A-C, in the described arrangements the magazines 10 are each equipped with a docking device 114 that cooperates with the upper docking interface 12 of the magazine to control admission of rivets into the magazine. In the described arrangement, the docking device 114 is provided in the same form as the rivet transfer device 14 described above, ie it is provided as a passive in-line rivet release mechanism—with the only difference being in the position and role performed by these devices. The rivet transfer device 14 is provided to hold and then to release a rivet for transfer under the punch. The docking device 114 is provided to prevent spillage of rivets from the magazine during inversion of the setting tool, and to provide access to the magazine 10 for the refilling thereof when the magazine 10 is docked to the bulk-supply apparatus. It will be apparent, however, that other rivet transfer and/or docking devices would be possible.

The magazines 10 are supported on the setting tool 2 and on the C-frame so as to be movable together with the nose arrangement 4 to prepare a setting operation. At the distal ends 20*a*, 20*b*, the magazines 10*a*, 10*b* are each connected to the proximal end 17*a*, 17*b* of the respective chute 16*a*, 16*b*. The chutes 16 are rigidly connected to the nose arrangement 4 so that when the nose arrangement 4 moves towards the die assembly 6, the nose arrangement 4 causes the magazines 10 to move with it in direction "v" shown in FIG. 1.

A set of brackets 18 attached to each chute 16*a*, 16*b* is provided to dock the magazines 10 to the respective chutes 16. These brackets 18 move with the nose arrangement 4, guided by a pair of C-shaped brackets 19 attached to the upper working end 9 of the C-frame 3 on either side of the setting tool 2. The brackets 18, 19 ensure that each magazine is adequately maintained in rivet-supply engagement with the chute 16 as the nose arrangement 4 is moved to prepare for a setting operation, as shown in FIG. 2. In FIG. 2, it is to be noted the augmented vertical distance between the C-shaped brackets 19 and the proximal ends 17*a*, 17*b* of the chutes 16*a*, 16*b*, which denotes an extended configuration of the nose arrangement 4. Other support configurations that would ensure adequate mobility of the chutes 16 and magazines 10 together with the nose arrangement 4, while appropriately maintaining in rivet-supply engagement the magazines 10 on the respective rivet supply lines 8, would however be possible. For example, in some applications each magazine 10 could be designed to be self-supported on the respective chute 16, without any bracketry 18, 19 similar to that shown in FIGS. 1-2.

In the described arrangement, therefore, on each side of the setting tool 2 a complete rivet delivery track 8, that is a magazine portion 11 of the rivet delivery track 8 and a chute portion 33 of the rivet delivery track 8, moves in unison with the nose arrangement 4 to prepare for a setting operation. Accordingly, there is no requirement for any flexible tubing, at least downstream of the upper docking interfaces 12 of the magazines 10.

Further, the setting tool 2 may perform multiple riveting operations with continuity of supply from the magazines 10 without retracting, or without fully retracting, since the rivet-supply engagement with the magazines 10 is always maintained.

In other arrangements, the magazines 10 may be supported so as not to follow the movement of the nose arrangement 4, in other words so as to be fixed relative to the setting tool 2 and/or the C-frame 3. For example, the magazine(s) 10 may be mounted on the C-frame 3. These magazine(s) 10 can still be operated to release and feed one or more rivets to the chutes 16. However, they can only do so when the magazine(s) 10 are docked to the chute(s) 16. The rivets can then wait at the rivet-receiving zone(s) 5, and thereafter the nose arrangement 4 can be moved in unison with the chute(s) 16 to prepare for setting operations, without displacing the magazine(s) 10. In this case, only a limited number of riveting operations are possible before the nose arrangement 4 has to be fully retracted to load more rivets.

In other arrangements, small lengths of flexible, semi-rigid or rigid delivery tubing may be used between the magazine(s) 10 and the chute(s) 16. In these arrangements, however, the magazine(s) and the chute(s) would move together with the nose arrangement 4 when the nose arrangement 4 is extended. The delivery tubing would move accordingly with the magazine(s) and the chute(s) as a single body, or it could accommodate a differential movement between the magazine(s) and the chute(s), including in the case when the magazine is fixed with respect to the tool and the chute moves with the nose arrangement. Alternative chute arrangements than those illustrated and described herein could be devised. For example, the chute(s) could be arranged perpendicularly with respect to the punch axis and could include a substantially right angle bend to dock with the magazine(s).

The magazines 10 described herein are replaceable in that they can be removed from the respective chutes 16 and supports 18, 19 provided therefor on the setting tool 2 and the C-frame 3. Referring now to FIGS. 3-6, there are shown the magazines 10 of FIGS. 1-2 in partially (FIGS. 3-4) and fully (FIGS. 5-6) detached/undocked configurations. For clarity of representation, a portion of a face of the proximal end 17 of the right-hand side chute 16 has been cut away to reveal details of the distal end 20 of the right-hand magazine 10. As best seen from FIG. 6, the distal end 20 of the magazine 10 incorporates a rivet handling device 21 in the form of a rotary cam mechanism 31 for selectively stopping, trapping or releasing one or more rivets from the magazine 10. An actuated pin mechanism 22 is disposed at the proximal end 17 of the chute 16 and operates said rotary cam mechanism 31. Basic details of the operation of this device 31 will be described further below.

Figure 5:
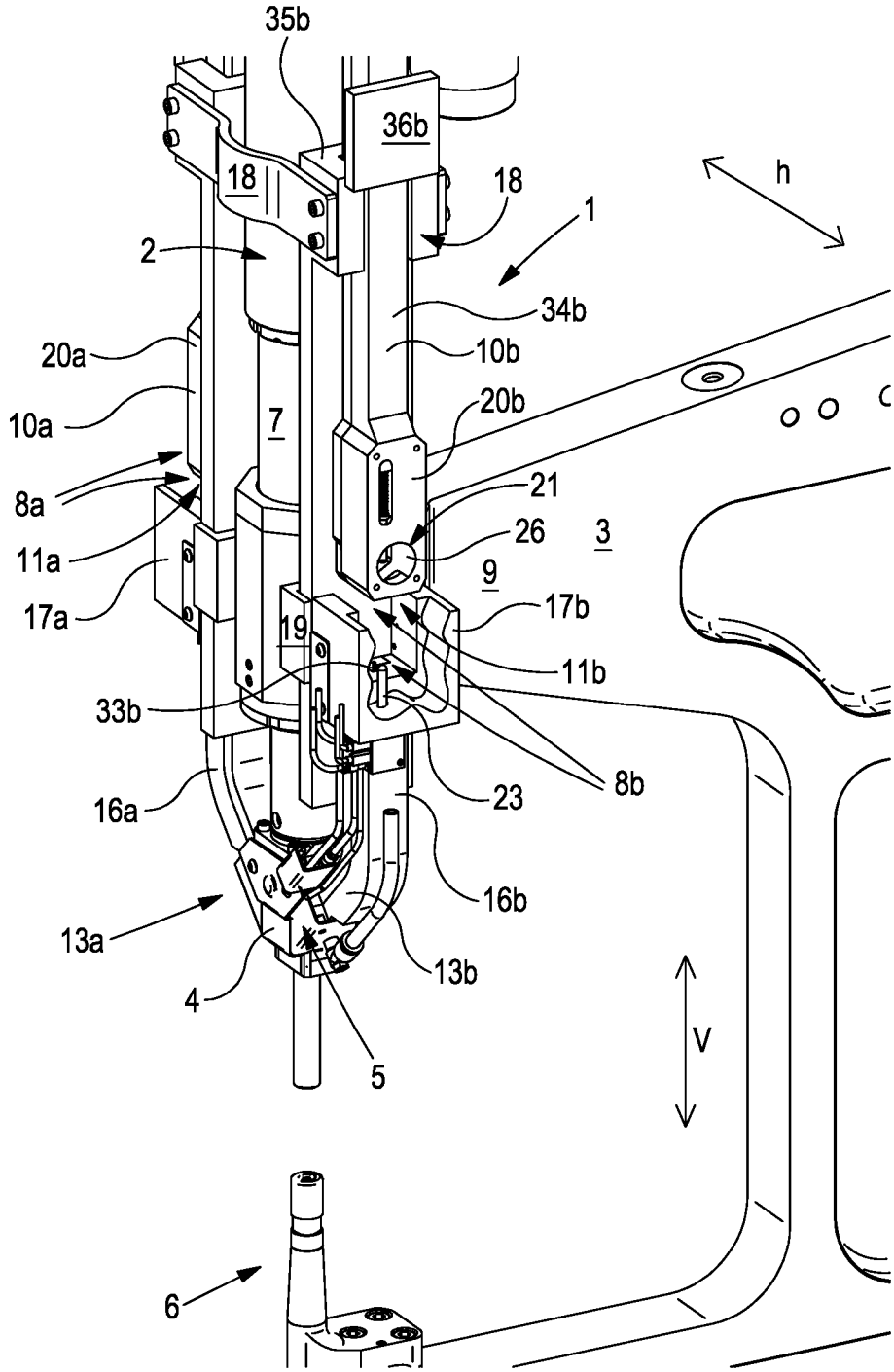
FIG. 5 is a side perspective view of the setting tool of FIGS. 3-4 with the magazines fully undocked from the rivet supply system.
Figure 6:
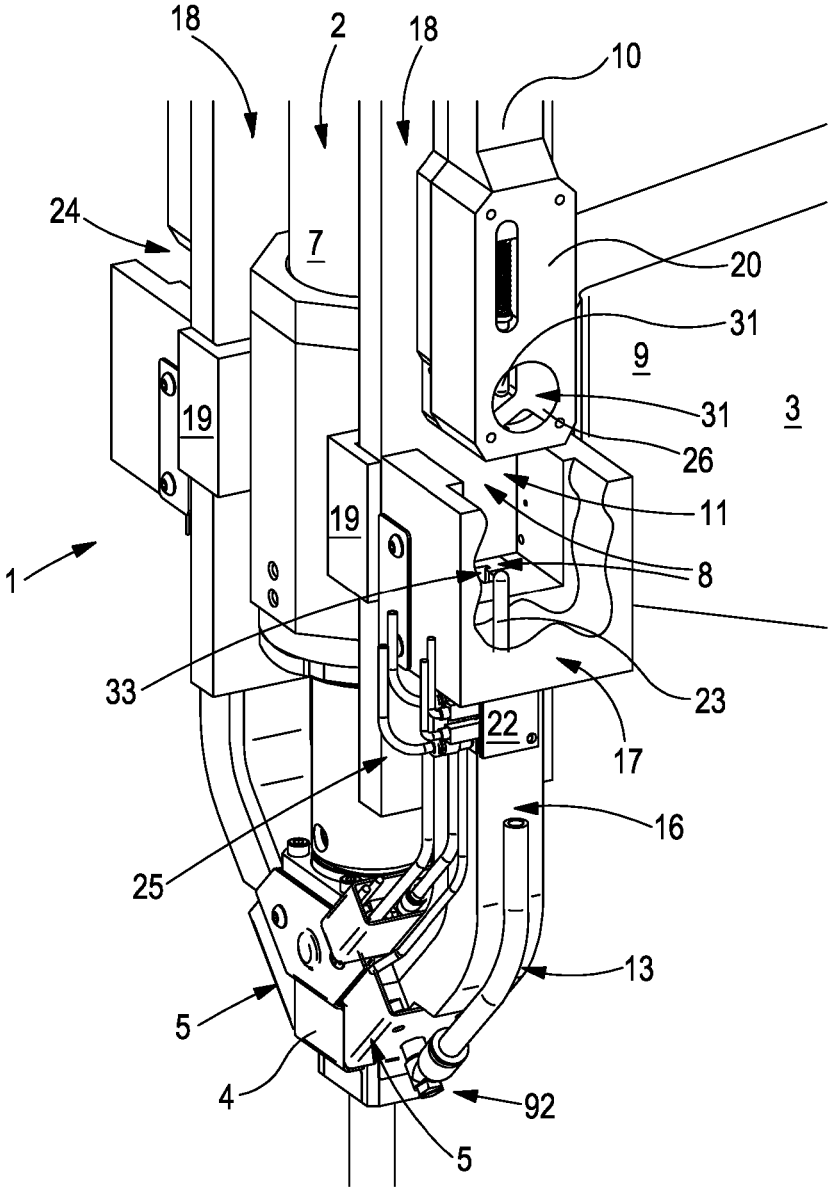
FIG. 6 is a an enlarged side perspective view of the setting tool of FIG. 5.

The operation of the rotary cam mechanism 31 of FIGS. 4-6 is explained in more detail in connection with FIGS. 7-10. A pin member 23 associated with and actuated by said actuated pin mechanism 22 is received in an aperture provided on a bottom docking interface 24 of the magazine 10. The pin member 23 is moved by appropriate amounts of compressed air transmitted via suitable pneumatic lines 25 to the actuated pin mechanism 22. The pin member 23 operates a rotary cam member 26 arranged in the rotary cam mechanism 31 to release one rivet A at a time from the magazine 10.

Referring now to FIGS. 8-10, a through-beam optical sensor 27 is also mounted on each chute 16 to check and confirm rivet presence before the rotary cam mechanism 31 is operated. The through-beam optical sensor 27 shines a beam of light through corresponding apertures 28 provided through the magazine 10 as seen in any of FIG. 8B, 9B or 10B in a transmitter-receiver fashion, as known in the art. Interruption of the beam signals the presence of a rivet A' in a leading position. The leading rivet A' is engaged by an arcuate cam 29 as seen in FIGS. 8B-C and is thus stopped from proceeding further in the magazine portion 11 of the rivet delivery track 8.

The leading rivet A' can also be "trapped" rather than "stopped" by the arcuate cam 29 in the leading rivet position following a slight anti-clockwise rotation from the default configuration shown in FIGS. 8A-C. This option would be used if there was the necessity to hold the leading rivet A' trapped in the leading position, for example in case of operation of the supply apparatus 1 by gravity and inversion of the setting tool 2.

If inversion of the setting tool 2 is not contemplated, then the trapping function may be redundant and the rotary cam mechanism 31 is operated in binary fashion as follows:

- the rotary cam 29 is initially rotated to a default configuration which is that shown in FIGS. 8B-C by a resiliently biased pin member 30 which impinges upon a suitable profile 32 on the front face of the rotary cam member 26; and,
- the pin member 23 is pneumatically actuated, when the rivet A' is sensed as being present, by the actuated pin mechanism 22 to rotate the rotary cam member 26 and thus the arcuate cam 29 disposed on the back face of the rotary cam member 26 to the position shown in FIG. 9B.

Accordingly, the leading rivet A' is released and the trailing rivet A" (and any other queuing rivets) is stopped by the arcuate cam 29. FIGS. 10A-B are equivalent to FIGS. 9A-C, but the perspective allows the relative positions of the leading and queuing rivets A', A", of the arcuate cam 29, and of the magazine portion 11 of the rivet track to be better visualized. The magazine portion 11 of the rivet track 8 defines a recess 47 to accommodate the rotary cam member 26 as shown in FIG. 10B.

Considering now FIGS. 5, 3 and 1 in sequence, it can be described how on each side of the setting tool 2 a magazine 10 can be docked to the chute 16. This is done by first disposing the magazine 10*b* such that the magazine portion 11*b* of the rivet delivery track 8*b* is aligned with the chute portion 33*b* of the rivet delivery track, as seen in FIGS. 5 and 6; then by moving linearly the magazine 10*b* in direction "v" towards the chute 16*b* until the pin member 23 of the actuated pin mechanism 22 engages the aperture on the magazine lower interface 24, as seen in FIG. 5; and, by finally docking the magazine 10*b* in place on the chute 16*b*, as seen in FIGS. 3 and 1. Alternatively, the setting tool 2 may be moved towards the magazine 10 by the robotic arm 200, and/or the setting tool 2 and the magazine 10 may move relative one to the other in the docking direction.

To facilitate the initial alignment of the magazine 10*b* with the chute 16*b*, the elongated body 34*b* of the magazine 10*b* is received in a U-shaped portion 35*b* of the brackets 18 provided with the chute 16*b*. The magazine 10*b* can then be smoothly guided down until docking is complete. Alternative or additional features for facilitating the docking of the magazine 10*b* onto the chute 16*b* are possible, for example utilising patterned magnets on the magazine 10*b* and/or on the chute 16*b*, or on the magazine 10*b* and/or on the brackets 18, or correlated magnets between the magazine 10*b* and the chute 16*b*, or between the magazine 10*b* and the brackets 18. These features may include coupling, alignment and/or latching via respective correlated magnets surfaces. One example will be described in more detail in connection with FIG. 14.

To undock the magazine, the reverse sequence is applied, for example as described by referring sequentially to FIGS. 1, 3 and 5, until the magazine 10*b* therefore becomes completely detached from the proximal portion 17*b* of the chute 16*b* on the right-hand side of the setting tool 2, as seen in FIG. 5. At this stage, the magazine 10 can be removed by moving it for example in direction "h" also shown in FIG. 5. Alternatively, the magazine can be held in place, and the robotic arm 200 can move the C-frame 3 away also in direction "h", away from the magazine 10*b*. Alternatively, both the setting tool 2 and the magazine 10 can be moved one away from the other.

An external pad 36*b* provided about half-way along the magazine 10*b* as seen in FIGS. 1, 3 and 5 aligns with the U-shaped portion 35*b* of the brackets 18 to visually signal docking of the magazine 10*b* in place on the setting tool 2 to an operator. The external pad 36*b* could however be provided further up or further down along the magazine 10*b*. Each pad 36 is essentially a plate covered with a compliant material such as a thin layer of rubber (or other material). Note that the pad 36*b* can be adapted to constitute a mistake-prevention (also referred to as "Poka-Yoke") feature for visual inspection from the operator. For example, the external pad 36*b* may be colour coded, or bar coded, to correspond to a specific type and/or size of rivets supplied by that magazine 10*b*. This information can be readily verified by an external operator, for example an operator carrying a bar-code reader, or trained to interpret the visual information provided by the colour coded pad 36*b*. Other possible uses of these external pads 36 in connection with replacement operations of the magazines 10 on the setting tool 2 will be described below.

A colour coded label, bar code or other Poka-Yoke feature (including one or more fully mechanical, electro-mechanical or electronic Poka-Yoke features) may alternatively be provided elsewhere on the magazine. For example, a fully mechanical Poka-Yoke feature could be provided by the fit (or lack thereof) between the distal end 20 of the magazine 10 and the proximal end 17 of the chute 16. Accordingly, certain chutes 16 could be adapted such that the setting tool 2 may only accept certain types of magazines 10 corresponding to predetermined types and/or sizes of rivets. Alternatively, the brackets 18 supporting the magazines 10 on the setting tool 2 could be so adapted.

As another example, a rivet information reader 201 in the form of an electro-mechanical rivet check device may be provided on the setting tool 2 as shown in FIG. 14. For example, this could be a device comprising one or more levers or buttons located on a longitudinally extending member 181 of the brackets 18 provided on the setting tool 2 to support the magazines 10. These levers or buttons could be actuated, thereby confirming a correct (or incorrect) type of rivets or other fastener stored in the magazine 10, by corresponding features (such as ridges, slots or the like) formed on a tool-facing side 203 of the magazine 10. The tool-facing side of the magazine 203 is indicated in FIG. 33. Note that, by way of example only, FIG. 33 also shows and indicates a bar code 202 as the magazine Poka-Yoke feature. The electro-mechanical rivet check device 201 is able to generate and transmit one or more signals to a controller 1203, as also show in FIG. 14 by the downward-pointing arrow. These signals are associated with and/or are representative of the type and/or size of rivets stored in the magazine 10.

The controller 1203 can be the controller of the robotic arm 200, or a separate controller that is however operatively coupled to the robotic arm 200. In its most basic form, the controller 1203 will include a processor and a memory. These details are not however discussed further in this disclosure. The skilled person will, however, recognise that a large variety of suitable controllers are possible, for example including one or more personal computers, which could be dedicated to the operation of the robotic arm 200 or that operate the robotic arm 200 in addition to other machines (such as the fastener setting tool 2 and/or bulk feeder apparatus). Further, the controller 1203 and the reader device 201 could be provided as parts of a same machine, or could be implemented on different machines in communication between them.

Said one or more signals issued by the rivet information reader 201 may be representative of a condition of the setting tool 2 whereby the setting tool 2 is capable of delivering the rivets required for a predetermined setting operation. This is, in the present disclosure, associated with the capability of the rivet setting tool 2 to read rivet type and/or size information from the correct magazine 10 docked to the setting tool 2. This capability is implemented by the presence of the rivet information reader 201 described herein. Alternatively, said one or more signals issued by the rivet information reader 201 may be representative of a condition of the setting tool 2 whereby the setting tool is not capable of delivering the correct rivets. This is, in the present disclosure, associated with an incorrect magazine 10 being docked on the setting tool 2. Note that it may be possible to adapt the rivet information reader 201 such that absence of any signals generated by it may signify a correct or incorrect fastener type and/or size being stored in the magazine 10 loaded on the setting tool 2.

The magazine controller 1203 is configured to receive and interpret any information received from the rivet information reader 201. In response thereto, if the fasteners stored in the magazine 10 are not of the type and/or size required for a current fastening application, the controller 1203 generates one or more signals (again, this may include a nil signal) to instigate the robotic arm 200 to undertake a magazine replacement operation as described herein. If instead the magazine 10 in question is correct (ie it stores one or more rivets of the type and/or size required in the instant fastening operation), then the controller 1203 may issue one or more signals that positively support a fastener setting operation. For example, the controller 1203 may issue a signal triggering a fastener setting operation as described herein. Alternatively, the controller 1203 may issue a signal triggering motion of the robotic arm 200 for relocating the setting tool 2 to a location where the installation of a rivet is required, or a signal signifying that any one of the above operations can be carried out by the robotic arm 200 and/or setting tool 2 at a later moment. In this case, the system has recognised that the correct rivet is available and thus the system is not inhibited from carrying out rivet setting operations. In other words, it is not necessary to first replace (or refill) any of the magazines 10 docked to the setting tool 2. These signals are schematically represented by the arrow pointing to the right in FIG. 14.

As it will be apparent, electronic Poka-Yoke features may be preferred. For example, to check the appropriateness of a tool-mounted magazine 10 in respect of a current or ongoing fastening operation, a rivet information reader 201 in the form of a bar code reader, or RFID reader, could be used. In this case, the magazines 10 would correspondingly have to be bar code tagged or RFID tagged. For example, in FIG. 33 the magazine 10 is bar code tagged (see bar code 202) and in FIG. 14 the rivet information reader 201 is represented by a bar code reader. Other chips may however equally be used, such as for example Near Field chips. Any of these chips and devices may or may not require contact for a reading to take place. Contactless chips and chip reading devices may be preferred.

Any of the above measures may contribute to ensure security of rivet type supply—provided that the magazines have correctly been filled with the intended type and/or size of rivets or other fasteners.

With reference to FIG. 12, a rotary magazine carousel 37 and a rotary die assembly carousel 38 are provided on either side of a setting tool 2 like that shown, for example, in FIGS. 1-6. The magazine and die assembly carousels 37, 38 support a number of replacement magazines 10*b*, 10*c*, 10*d*, 10*f*, 10*g*, 10*h* and a number of replacement die assemblies for replacing, respectively, the replaceable magazines 10*a*, 10*e* mounted on the setting tool, and the replaceable die assembly 6.

In FIG. 12, each magazine 10 has a magnetically patterned surface 39 for holding the magazine on attachment points 40 provided on supports 41 situated on the magazine carousel 37. The attachments points could be plates made of a ferromagnetic material. These plates could be coated with, for example, a layer of a compliant material, such as rubber, and thus be also referred to as "pads" instead of plates (conversely, the magazine pads described herein could be just plates). However, in the arrangement described, all the magazines 10 including the replaceable magazines 10*a*, 10*e* have respective magnetically patterned surfaces 39*a*, 39*e* for connecting with magnetically correlated surfaces 44*a*, 44*e* provided on free attachment points 40*a*, 40*e* located on spare support structures 41*a*, 41*e*. The attachment points 40 including free attachment points 40*a*, 40*e* are provided in the form of support pads 43*a*, 43*e* of equal size than the external pads 36*a*, 36*e* provided on the magazines 10*a*, 10*e*. However, alternative forms would be possible. The magnetically patterned surfaces 39 are provided on the magazines 10 on the respective pads 36 purely for convenience. Said magnetically patterned surface 39 could alternatively be provided, at least in principle, on any portion of outwardly-facing surfaces 42 of the docked magazine 10*a*. Providing dedicated pads 36 for this purpose is, however, preferred.

An undocking procedure for undocking the right-hand side replaceable magazine 10*a* is now described. The C-frame 3 can be moved by the robotic arm 200 towards any of the two magazine carousels 37 in direction "h". The C-frame is moved to the right to undock right-hand side magazine 10*a* until the corresponding pads 36*a*, 43*a* are in proximity one next to the other. In this configuration, magnetically correlated surfaces 39*a* on the magazines 10*a* is nearly magnetically engaged with corresponding correlated surface 44*a* on the attachment point 40*a* on the right hand side of the setting tool 2. The C-frame 3 may then undertake small movements in directions coplanar with the support pads 36*a*, 43*a* in directions "v" and "p" shown in FIG. 12, or out of plane, in direction "h", also shown in FIG. 12, until the magazine 10*a* becomes properly magnetically attracted to, and eventually held on, the attachment point 40*a* on the spare support structure 41*a*. Once connected to the support 41*a*, the magazine 10*a* can be undocked from the setting tool 2 by withdrawing the setting tool 2 downwards in direction "v". The magazine is held in position against any downward forces exerted thereon at the time of withdrawing the setting tool in direction "v" by a shear force generated by correlated-magnets surfaces 39*a*, 44*a*. Alternatively or additionally, the magazine may be held in position on the magazine carousel 37 by reaction key-like abutments or protuberances provided on the support plates 43. These features (not shown) could be provided so as to work in both the docking and undocking directions along direction "v" shown in FIG. 12. For example, these key-like abutments or protuberances could be provided on the upper and lower edges of the support plates 43. Approach to the rotary magazine carousel 37 to undock the magazine 10 could alternatively be in direction "p".

In the described arrangement it is the robotic arm 200 that moves the C-frame 3 and the setting tool 2 towards the magazine carousel 37 for undocking the magazine 10*a*. However, in principle, the carousel 37 could instead be moved toward the setting tool 2. Once undocked, the magazine 10*a* rests on previously spare support structure 41*a* in exactly the same way as other replacement magazines 10*b*, 10*c*, 10*d* rest on corresponding additional support structures 41*b*, 41*c*, 41*d* on the right hand side of the tool 2 as shown in FIG. 12.

The same procedure can be applied to undock replaceable magazine 10*e*, so that it will then be supported on spare support structure 41*e* on the left-hand side carousel 37. This other carousel supports the three other replacement magazines 10*f*, 10*g*, 10*h*, as also shown in FIG. 12.

By following a reverse sequence it is instead possible, for example, to dock one of the replacement magazines 10*f*, 10*g*, 10*h* on the left-hand side of the setting tool 2. For this purpose, assuming that replacement magazine 10*f* is chosen between the available replacement magazines 10*f*, 10*g*, 10*h* on the left-hand side of the setting tool, the magazine body 34*f* is first accommodated by moving the robotic arm and/or the carousel 37, as the case may be, within U-shaped portion 35*f* of the brackets 18 on the setting tool 2. Note that the left-hand side magazine carousel 37 shown in FIG. 12 may have to be rotated 90 degrees clockwise to facilitate this operation. The empty setting tool 2 and/or the movable nose arrangement 4 are then moved upwards in direction "v" to dock the magazine 10*f* on the distal end 17*e* of the chute 16*e*. The magnetic attraction force between the attachment point 40*f* on support structure 41*f* and the external pad 36*f* of replacement magazine 10*f* is such to permit the magazine 10*f* to detach from the carousel 37. Once the magazine 10*f* is docked in place on the chute 16*e*, the magazine 10 is constrained by the chute 16*e* and the setting tool 2 can therefore be moved away from left-hand side carousel 37 in direction "h" and/or "v" to overcome the magnetic force between the correlated-magnets surfaces 39*f*, 44*f* that hold the magazine 10*f* in place on the corresponding support pad 43*f*. Alternatively or additionally the docking procedure may involve the key-like abutments or protuberances described above in connection with the undocking procedure, and the docking procedure would then follow an inverse process with respect to that undocking procedure.

The magnetic holding force that holds the replacement magazine 10*f* on the support 41*f* may be relatively high. Thus it may not be advisable to break the magnetic force between the magazine 10*f* and the support pad 43*f* by suddenly moving away the setting tool 2 in a predetermined direction as this could in principle damage the magazine 10*f* or the chute 16*e* (or both) as undue stress on the joint between the magazine 10*f* and the proximal end of the chute 17*e* may be generated. It may be possible first to perform small movements of the setting tool 2 in direction "p", or in direction "v", to bring the magazine pad 36*f* in slight misalignment with the support pad 43*f* on the support 41*f*. This may suitably weaken the magnetic bond between magnetically correlated surfaces 39*f*, 44*f* when the pads 36*f*, 43*f* are in perfect alignment, and this may in turn facilitate the release of the magazine 10*f* from the carousel 37. This feature can be enabled by the characteristics of the magnetic forces generated by the correlated-magnets on the replacement magazine 10*f* on one side and the support structure 41*f* on the other side. Replacement magazine 10*f* has now replaced replaceable magazine 10*e* on the left-hand side of setting tool 2.

Each magazine carousel 37 comprises four support structures 41, disposed in quadrant arrangement, one or more of which may be free to receive a replaceable magazine 10*a*, 10*e* as exemplified in FIG. 12. Otherwise, the four support structures 41 on each carousel 37 may simultaneously support four magazines 10, for example at the start of a new setting procedure when the setting tool 2 has not yet been loaded. The magazine loading/unloading operations are facilitated by the fact that the carousels 37 can be rotated. Thus, an empty support structure 41*a* or a required replacement magazine 10*b*, 10*c*, 10*d* can be disposed to face the setting tool 2 in preparation for the loading/unloading operations described above.

While any magazines 10 are supported on the carousels 37, refill can take place. Meanwhile, the loaded setting tool 2 is ready for new setting operations, until any of the replaceable magazines 10*a*, 10*e* will need to be replaced by any of the available replacement magazines 10*b*, 10*c*, 10*d*, 10*f*, 10*g*, 10*h*. In FIG. 12, all the magazines contain the same rivets, but it will be appreciated that different magazines may contain different rivets and share the same magnetically patterned surface 39 on the external pads 36.

The pairs of magnetically correlated surfaces 39, 44 provided, respectively, on the magazines 10 and on the supports 41 provided on the carousels 37 can be designed to facilitate the docking and undocking operations described above. For example, said pairs of magnetically correlated surfaces 39, 44 may provide for mechanical alignment of the respective pads 36, 44 in addition to magnetic holding. Alternatively or additionally, mechanical latching as described above could also be implemented. In addition, mechanical release could also be implemented, for example triggered by bringing the pads 36, 44 out of alignment further than a predetermined distance.

Further, the properties of the magnetically correlated surfaces 39, 44 could also in principle be used as a Poka-Yoke feature, that is to ensure that only predetermined magazines having appropriate magnetically correlated surfaces can be supported on any specific supports 41. This could be achieved, for example, by specifying a spring-type mechanical function between those magazines and any supports 41 not intended for that magazine. A coupling function can instead be specified between these magazines and the supports intended to support them on one of the carousels 37.

A process of refilling the replacement or replaceable magazines 10 is now described with reference to FIGS. 13, 15, 16 and 17A-C. FIG. 13 illustrates a set up similar to that of FIG. 12. However, in the arrangement of FIG. 13 the replacement magazines 10*b*, 10*c*, 10*d*, 10*f*, 10*g*, 10*h* are supported on upright racks 41 on the right and left hand sides of the setting tool 2 instead of being supported on rotating carousels 37. Docking blocks 70 are provided to refill simultaneously up to four replacement magazines 10 on each upright rack 41. Each docking block 70 has a lower docking interface 66 as shown in FIG. 13 with docking features for coupling with up to four upper docking interfaces 12 of corresponding magazines 10 while they are all supported on one of the racks 41. Correspondingly, four rivet feed flexible tubes 71 extend away from each docking block 70 and feed rivets to the magazines 10 via the lower docking interface 66 of the docking block. Pairs of through-beam optical sensors 27 can be used in conjunction with the replacement magazines 10 as shown in FIG. 13 for confirming that the magazines have been filled with fasteners. The sensors, however, are not mounted on the magazines 10. Instead, they can be provided as an accessory to the docking block 70. The operation of these optical sensors has already been described in some detail above in connection with FIGS. 8-10, and it will not be described again. However, it is noted that the magazines 10 each define aligned pairs of suitable apertures in light-transmitting communication with the magazine portions 11 of the rivet delivery tracks 8 at their proximal ends 15, as shown for example in FIG. 13. The magazines 10 can thus be filled with rivets which are then stored in said magazine rivet delivery track portions 11 until the sensors 27 confirm that the magazines 10 are full. Alternatively, the magazines 10 can be weighed while on-stand to check the level of replenishment. Weighing the magazines to establish fill level constitutes an absolute measure of their replenishment. Therefore, this process can be considered to be more reliable, and thus preferable, with respect to the above method of counting the number of discrete rivets passing through the optical sensors.

While various docking mechanisms are possible, preferred methods involve providing the upper docking interfaces 12 of the magazines 10 with respective magnetically patterned surfaces 45 for connection and, more preferably, connection and alignment with, one or more corresponding magnetically correlated surfaces 46 provided on the lower docking interface 66 of the docking block 70 shown in FIG. 13, or on the lower docking interface of another refill device 48 such as that shown in FIG. 15.

In the arrangement shown in FIG. 15, the refill device 48 is a rivet feed tubular member 49 with a pair of internal passageways 50 for delivering rivets from a bulk-feeder to the magazine 10. The magazine is a dual-track magazine 10 with two upper magazine tracks 60 which can be refilled simultaneously once the magazine 10 has been docked to the refill device 48. The two upper tracks 60 of the magazine 10 could be independent, or merge and share a common lower magazine track, as for example shown in FIGS. 35-38, 41 and 42. These magazines will be further described below. Only the proximal end 15 of the magazine 10 is shown in FIG. 15, since this is the only relevant portion of the magazine 10 for the refill operations. Positioning and alignment of a robotically mounted magazine 10 may require a high degree of accuracy and repeatability by the robotic arm 200. In turn, this may require considerable programming skills to bring two faces together when account is taken of up to six degrees of freedom for the position of the magazine 10. Therefore, it is desirable to mount the refill device 48 in such a way that it has small freedom of movement, but for a relatively larger freedom of movement in a translational direction, for example the vertical direction in FIG. 15. It is also desirable to provide for a predetermined at-rest position of the refill device 48, ie a reset position that the refill device 48 is able to achieve when the magazine 10 is not docked thereto. The rivet feed tubular member 49 is thus mechanically constrained in the axial (vertical) direction by mechanical stop means 51, which in the arrangement shown are a pair of spaced-apart rings 52 which allow some axial (vertical) movement. One or more mechanical springs (not shown) may additionally be provided in this arrangement so as to centre the rivet feed tubular member in the at-rest position. The rivet feed tubular member 49 can thus move vertically only within a predetermined range of vertical positions, as permitted by the spaced apart rings 52, and will return to a default position when no magazine is docked thereto.

The rivet feed tubular member 49 is supported on a first support structure 53 which, in the shown arrangement, is in the form of a tripod 54 (only two arms of which are shown in the purely schematic representation of FIG. 15). The tripod 54 is mounted on a second support structure 55 via three compliant mounts 56. The second support structure 55 is a fixed stand 59 in this example. However, in other examples, the second support structure 55 could be mounted on a robotic arm, or movable vehicle. Various types of compliant mounts 56 are possible, for example using mechanical means such as springs or layers of compliant material such as rubber. The compliant mounts 56 shown in FIG. 15 are instead provided by three pairs 57 of spring-type correlated-magnets surfaces 58. Note that only two of these pairs 57 are shown in FIG. 15. For each pair 57, a first correlated-magnets surface 58*a* is disposed at a distal end 68 of the tripod 54; a second correlated-magnets surface 58*b* is disposed at a proximal end 69 of the stand 59. The three pairs 57 of compliant mounts 56 are thus arranged to provide omnidirectional compliancy so that the magazine 10 cannot be damaged by the refill device 48 when the magazine 10 is docked or undocked thereto. Further, it will be apparent that the compliant mounts 56 may in addition be designed to replace some of the one or more springs referred to above, which may be used to centre the refill device 48 between the pair of spaced apart rings 52.

The arrangement is such that when the magazine 10 hovers close to the correlated-magnets surface 46 provided on the refill device 48, the refill device 48 is gently drawn in contact with the docking interface 12 of the magazine 10, with the refill passageways 50 aligned with the two upper magazine tracks 60 in readiness for the magazine to receive rivets from the bulk feeder (not shown). This performance is made possible by the alignment function performed by the pair of correlated-magnets surfaces 45, 46 disposed, respectively, on the magazine docking interface 12 and on the lower docking interface 66 of the refill device 48 as shown in FIG. 15. The correlated-magnets surfaces 45, 46 are obtained by inserting pairs of correlated magnets 63, 35 on the respective docking interfaces 12, 66 on the magazine 10 and on the rivet feed tubular member 49 as shown in FIG. 15. The arrangement shown in FIG. 15 is preferred for refilling a magazine mounted on the setting tool. The docking process for refilling the magazines 10 is thus quick, simple and accurate. However, this arrangement can potentially also be used for refilling replacement magazines supported, for example, on the carousels 37 shown in FIG. 12 or on the upright racks 41 shown in FIG. 13.

When the refill operation is complete, as the refill device 48 is released (this can for example be determined by relative shear movement between the magazine 10 and the refill device 48), the compliant mounts 56, in cooperation with any additional springs provided for this purpose, return the rivet feed tubular member 49 to its default position shown in FIG. 15. The magazines 10 can thus be undocked by moving, for example, the setting tool 2 laterally to bring the interfaces 12, 66 out of alignment to overcome the alignment forces generated by the magnets 63, 65 to realign the interfaces 12, 66. The magnets may preferably be patterned so as to generate a repulsive release force when the misalignment exceeds predetermined limits. Alternatively, the magazine 10 may be driven in the axial (vertical) direction to break the magnetic holding force.

FIG. 16 shows an alternative arrangement for the compliance mounts 56. Each compliance mount is again provided as a pair 57 of magnetically correlated surfaces 58*a*, 58*b* capable of performing at least a compression spring-type function and, preferably, also a vertical alignment-type function. First correlated surfaces 58*a* are provided on respective internal faces 75 of an external cluster of first rhomboid plates 76 inclined with respect to the axial (vertical) direction. First rhomboid plates 76 are equivalent to tripod 54 of FIG. 15. Second correlated surfaces 58*b* are provided on respective external faces 77 of a corresponding internal cluster of second rhomboid plates 78, generally parallel to the first rhomboid plates 76, arranged as shown in FIG. 16. Some or all of the second rhomboid plates 78 could be used to mount a refill device 48 similar to that of FIG. 15. The second rhomboid plates 78 are equivalent to the support structure 55 in FIG. 15. The refill device could then be attracted downwardly by the approaching magazine as described above. Such attraction would displace the first cluster of rhomboid plates 76 and accordingly the first correlated-magnets surfaces 58*a* from the default position shown in FIG. 16. Second correlated-magnets surfaces 58*b* would then give rise together with displaced first correlated-magnets surfaces 58*a* to a return or realignment vertical force. In case of horizontal displacement of the first cluster of rhomboid plates 76 due to the action of the magazine 10 on the refill device 48, displaced first correlated-magnets surfaces 58*a* would then give rise together with the second correlated-magnets surfaces 58*b* to a return or realignment horizontal force.

FIG. 17A shows schematically two patterned magnets 65 mounted on the lower docking interface 66 of the refill device 48 of FIG. 15 and the resulting magnetically correlated docking surface 46. Two permanent magnet inserts with the same magnetic pattern are used. It will thus also be clear that the expression magnetically correlated surface does not mandate that said surface be completely magnetically patterned. Rather, a magnetically correlated surface as described herein is intended as a surface that is at least in part magnetically patterned to achieve a required mechanical function or overall user experience.

FIG. 17C shows an alternative arrangement showing schematically the same patterned magnets 65 disposed, however, on a portion of the lower docking interface 66 arranged at right angles with respect to the portion of the docking interface on which the outlets of the rivet feed passageways 50 depicted in FIG. 15 are located. This arrangement may be convenient in that the outlets and the magnets 65 do not lie on the same plane. Accordingly, this may prevent dust or debris from accumulating on the magnets thus potentially compromising the mechanical function or user experience provided by them. This may thus also in principle affect the alignment of the outlets 50 of the refill device 48 and the upper portions 60 of the rivet tracks in the magazine 10.

FIG. 17B shows instead a magazine upper docking interface 12 designed for docking with the interface 66 of FIG. 17C. The patterned magnets 63 on the magnetically correlated surface 45 have complementary patterns with respect to those of correlated magnets 65, as shown in FIGS. 17B-C (although it will be noted that the representation of the patterns in FIGS. 17A-C is merely schematic, and is not in agreement with patterns which would be used in practice). The upper docking interface 12 fits in a recess 77 defined by the lower docking interface 66 as shown in FIG. 17C.

The correlated magnets 65 may be mounted flush with the recessed mounting surface shown in FIG. 17C, or slightly underflush without an appreciable impact on magnetic performance. This may however favour an accurate positioning of the interfaces 12, 66 and thus of the magazine with respect to the refill device.

The arrangement in FIGS. 17B-C differs from that of FIG. 17A for three additional reasons:

a) it reduces the force required for disconnecting the docking interfaces 12, 66 by allowing a shearing force to act on the coupled magnets when the magazine is withdrawn axially (it will be recalled that shear forces in given patterned magnets are typically about one fifth of the axial holding force);

b) it provides for patterned magnets positioned further away from the rivet (or other fastener) delivery path to avoid any magnetic interference with the fasteners; and, c) it generally improves the compactness of, and therefore the accessibility to, the proximal end of the magazine.

FIG. 14 is similar to FIGS. 12 and 13 in that it shows a setting tool 2 predisposed for magazines 10 of the type described herein. A set of four fixed vertical posts 41*a*, 41*n*, 41*c*, 41*d* surrounds the setting tool 2: two posts 41*a*, 41*d* are located on the right-hand side of the setting tool 2 and two 41*b*, 41*c* on the left-hand side; two posts 41*a*, 41*b* are located at the back of the setting tool 2, and two 41*c*, 41*d* at the front thereof.

Each vertical post 41 has features similar to the supports 41 described in connection with the magazine carousels 37 of FIG. 12, or the upright racks 41 described in connection with FIG. 13. Thus, each post 41*a*, 41*b*, 41*c*, 41*d* has an attachment pad 43*a*, 43*b*, 43*c*, 43*d* for supporting a magazine 10. Each attachment pad 43*a*, 43*b*, 43*c*, 43*d* defines a respective attachment point 40*a*, 40*b*, 40*c*, 40*d* as indicated in FIG. 14. The attachment points 40 could in principle include a variety of attachment means. However, it is preferred that the magazines 10 be supported via corresponding magnetically patterned surfaces 44*a*, 44*b*, 44*c*, 44*d* as described above provided on said attachment pads 43*a*, 43*b*, 43*c*, 43*d*. Magazines 10 made of ferromagnetic material could thus be attached to the attachment pads 43 via the magnetic field generated by the corresponding patterned magnets. Alternatively, the attachment pads could include a ferromagnetic material and the magazine could incorporate one or more patterned magnets. However, it is preferred to provide magnetically correlated patterned surfaces 39 on the respective external surfaces 42 of the magazines 10, as shown in FIG. 14 for interaction with corresponding correlated magnets surfaces on the vertical posts 41. Further, it is preferred to provide said correlated-magnets surface 39 on a corresponding external pad 36 on each magazines 10. These external pads have already been described above and four such pads 36*a*, 36*b*, 36*c*, 36*d* are also shown in FIG. 14. The correlated-magnets surfaces 39, 44 will not be further described herein, but they can have any of the features described above in connection, for example, with FIGS. 12, 13, and 15-17.

Magnetically patterned surfaces to aid with the docking of the magazines 10 could also be included in any one or more of the recess faces of the U-shaped portions 35 of the brackets set 18 on the setting tool 2. These recesses are clearly shown in FIG. 14. The magazines 10 would then include on the corresponding face(s) corresponding magnetically patterned surfaces. The mechanical functions performed by these correlated magnets could be a combination of coupling, alignment, latching, spring biasing and/or release, to suit the docking manoeuvre.

The arrangement shown in FIG. 14 in addition has two racks 80 for supporting replacement magazines 10 on either side of the C-frame 3. Each rack 80 can support up to four replacement magazines 10. Fewer or more magazines 10 are however possible and this will generally depend on the overall size of the magazines 10 and the size of the C-frame 3 and the setting tool 2. The posts 41 could each represent a remote magazine refill station. Thus the robotic arm can be used as described in connection with the supports and upright racks 41 of FIGS. 12 and 13 to offload any replaceable magazines mounted on the setting tool or any of the replacement magazines 10 supported on the racks 80 on any one or more remote magazine refill stations 41 for refilling the magazines 10 remotely.

In addition, the arrangement of FIG. 14 allows the robotic arm 200 to carry out a complete magazine replacement operation in cooperation with one or more of the refill stations. Any replaceable magazines mounted on the setting tool 2 can first be offloaded at one or more of the posts 41. Optionally, these magazines can then be refilled and then loaded back on one of the racks 80 provided on the C-frame. The robotic arm 200 can then offload one or more replacement magazines 10 located on any one of the racks 80 at one or more of the posts 41. Finally, the robotic arm 200 can select any of the replacement magazines supported on the posts 41 and then dock them in rivet supply engagement on the setting tool with a procedure similar to that described in connection with FIGS. 12 and 13. The arrangement of FIG. 14 is thus advantageous because any replacement magazines are carried on the C-frame, and the robot can then autonomously replace any replaceable magazines with any of the replacement magazines when required (for example when the rivets of the replaceable magazines have run out) by cooperating with one or more external structures such as the posts 41 shown in FIG. 14 that have been provided for this purpose.

The utilisation of correlated-magnets surfaces in the procedures for refilling and/or replacing the magazines may conveniently reduce the positioning accuracy requirements on the robotic arm 200. Thus the robotic arm 200 may only be requested to dispose the magazines generally close to, for example, the refill device 48 of FIG. 15 or any one of the supporting structures 41 shown in FIGS. 12-14. Docking between the docking device 48 and the magazine 10 is then facilitated by the correlated magnets surfaces on the one and on the other of these components. Likewise, connection between one support 41 and the magazine 10 is facilitated by the presence of correlated-magnets surfaces.

FIGS. 18-50

With reference to FIGS. 18-24 there is shown an alternative setting tool 2 comprising a pivotal magazines 10*a*, 10*b* disposed, respectively on the right and left-hand sides of the tool 2. The right hand side magazine 10*a* includes three independent magazine portions 11*a*, 11*b*, 11*c* of the corresponding rivet delivery track 8*a*, as shown in FIG. 18. The rivet delivery track 8*a* extends further than the magazine 10*a* to reach the nose arrangement 4, as in the previous arrangements. The rivet delivery track 8*a* also includes a corresponding chute portion 33*a* (indicated in FIG. 24) of the rivet delivery track 8*a*. The magazine 10*a* is supported so as to be movable with the nose arrangement 4 as it extends towards the die assembly 6. The same considerations apply to left hand side magazine 10*b*.

The pivotal arrangement of the magazines 10*a*, 10*b* is used to select supply of rivets from any one of the three independent magazine portions 11 of the rivet delivery tracks 8 on each side of the setting tool. For example, in the configuration shown in FIG. 18, on the right hand side it is the central magazine portion 11*b* of the rivet delivery track 8*a* which is in rivet-supply relation with the chute 16*a*. Any rivets present in the other magazine tracks 11*a*, 11*c* are held within the magazine by respective rivet handling devices 21 located at the distal end 20*a* of the magazine 10*a*. Three rivet handling devices 21 are provided on each magazine at the distal ends 20 thereof. These will not be described again, since they are each in the form of the rotary cam escapement 31 described above. In FIG. 18, three rotary cam escapements 31*a*, 31*b*, 31*c* are visible, each associated with a respective independent magazine track portion 11*a*, 11 *b*, 11*c*.

FIG. 19 illustrates the extension of the magazine track portions 11*a*, 11*b*, 11*c* within the pivotal magazines 10*a* shown in FIG. 18. There is a central track portion 11*b* which has a substantially straight extension along a central axis of the magazine 10*a*. On either side thereof, second and third curved tracks 11*a*, 11*c* extend with opposed curvatures as shown in FIG. 19. At the proximal ends of the tracks 11, three docking devices 114*a*, 114*b*, 114*c* of the same type described in conjunction with FIG. 11B are provided to permit refill of the magazine from a bulk feeder (not shown), and to prevent spillage of rivets in case of magazine inversion. Thus, the upper docking interface 12*a* of the magazine 10*a* is predisposed for docking with the lower docking interface 66 of a docking block 70 (shown in FIGS. 29-31) similar to that shown in FIG. 13, but with the lower docking interface 66 curved to match the curvature of the magazine docking interface 12*a*.

The docking devices 114 are also represented in enlarged form in FIG. 20A, which shows the proximal end 15*a* of the magazine 10*a* in greater detail. The round apertures 28*a*, 28*b*, 28*c* visible in FIG. 20A represent intakes for respective beams of light emitted by through-beam optical sensors as described above (but not shown herein). Each transmitter-receiver pair of said sensors can be used to check whether each of the three independent magazine tracks 11 on each of the magazines 10 has been fully filled with rivets.

At the distal end 20*a* of the magazine 10*a*, which is shown in more detail in FIG. 20B, three arcuate cams 29*a*, 29*b*, 29*c* of the respective rotary cam escapements 31*a*, 31*b*, 31*c* described above are visible. In the configurations shown in FIGS. 19 and 20B, these arcuate cams stop corresponding rivets Ba, Bb, Bc located at the distal ends of the respective tracks 11*a*, 11 *b*, 11*c*. The rotary cam escapements 31 are operated in similar fashion as the rotary cam escapement described above, for example, in connection with FIGS. 7-8. The operation of the rotary cam escapements 31 of the pivotal magazine 10 is briefly further described below in connection with FIGS. 25-28.

By rotating the magazine 10*a* around its pivot 81 (indicated in FIG. 19), and by operating the actuation mechanisms 22*a* provided therefor, it is therefore possible to select supply of rivets B from any of the three independent magazine tracks 11*a*, 11 *b*, 11*c*, on either side of the rivet setting tool 2, in the mirror magazine configuration of FIGS. 18-24. FIG. 21, in particular, shows the pivotal magazines 10*a*', 10*b*' of FIG. 18 in clockwise-rotated configuration. Thus in FIG. 21 independent magazine track 11*c* is selected on the right hand side pivotal magazine 10*a*'. It is noted that the rivets B stored on each of these tracks 11 may be the same or may have different shapes and/or sizes. FIG. 22 is a front view of the setting tool 2 in the configuration shown in FIG. 21. This Figure allows a better appreciation of the position of the respective pivots 81*a*, 81*b* of the magazines 10*a*, 10*b*. The actuated pin mechanisms 22*a*, 22*b* on either side of the setting tool 2 can also be better visualized.

With continued reference to FIG. 22, a rivet B thus enters, for example, magazine 10*b* on the left hand side, via docking interface 12*b*. The rivet B is stored and transits through one of the corresponding magazine tracks 11 in the magazine 10*b*, depending on the pivotal configuration of the magazine 10*b* at the time the rivet B enters the magazine 10*b*. Release of the rivet B from the magazine 10*b* to the nose transfer area 5*b* is decided by operation of one of the rotary cam escapements 31 associated with the magazine 10*b*, when the appropriate track 11 is in rivet-supply communication with the respective chute 16*b*. The rivet enters the chute 16*b* and transits therethrough from the proximal end 17*b* to the distal end 13*b* until reaching the rivet transfer area 5*b*. This describes the path of the rivet through the left hand side supply system 1*b*. A similar path would occur on the right hand side supply system 1*a*.

FIG. 23 shows additional constructive details of the pivotal arrangement of the magazines 10*a*, 10*b*. A pivotal key 82*a* is provided on the right hand side for coupling with a corresponding recess (now shown) provided on the right hand side magazine 10*a*. The pivotal key 82*b* of the left hand side magazine 10*b* is visible in FIG. 23, disposed around the magazine pivot 81*b*. A rotary actuator such as an electric motor 83*a* is responsible for the pivotal configuration of the magazine 10*a* on the right hand side and, therefore, for selection between the independent rivet tracks 11*a*, 11*b*, 11*c* provided on the magazine in connection with any rivet refill, or rivet supply operations, to and from the magazine 10*a*.

FIG. 24 is an enlargement of parts of FIG. 23 with the nose arrangement 4 in an extended configuration to reveal the chute portions 33*a*, 33*b* of the rivet delivery tracks 8*a*, 8*b*. In the arrangements described herein, the pivotal magazines 10*a*, 10*b* are supported so as to be movable with the nose arrangement 4 when the nose arrangement 4 is extended in preparation for a setting operation. However, alternatively the pivotal magazine could be fixed with respect to the setting tool and/or C-frame and load one or more rivets into the chute in preparation for one or more setting operations.

As mentioned above, FIGS. 25-28 show in sequence the operation of one 31*b* of the rotary cam escapements 31*a*, 31*b*, 31*c* associated with a pivotal magazine 10. The operation is entirely consistent with the rotary cam escapement described in connection with FIGS. 7-10. Accordingly, the aspects already described above will not be repeated and express reference is instead made to those parts of the present description, and to FIGS. 7-10. In the arrangement of FIGS. 25-28, however, the pin member 23 of the actuated pin mechanism 22 also registers in place the magazine 10 before a rivet is released from the magazine 10 on the chute 16 in preparation for a setting operation. Thus, with reference to FIG. 25, the magazine is rotated on its pivot to select the required magazine track. This is the central magazine track as shown in FIG. 25. The pin member 23 is then partially extended by the actuator 22 as shown in FIG. 26. A successful outcome of this part of the actuation routine signals registration in place of the selected magazine track with respect to the proximal end of the chute 17. The magazine 10 and the chute 16 are now in rivet-supply relation. The proximal end of the chute 17 is in the present arrangement in the form of a chute block rather than a chute sleeve, as was the case for the non-pivotal magazines previously described. If registration in place of the pivotal magazine 10 is not successful, the electric motor 83 is operated accordingly until registration is achieved. The pin member 23 can then be extended fully (refer to FIG. 27) to operate the rotary cam member 26 of the rotary cam escapement 31. The rotary cam member has a profile 32 which, in cooperation with the movement of the pin member 23, determines clockwise rotation of the rotary cam member 26 which, in turn, determines rotation of arcuate cam 29 to release a rivet. The rotary cam mechanism then regains its default, rivet-stopping position due to the retraction of the pin member 23 (refer to FIG. 28) and the passive, contrary action of the corresponding resiliently biased pin member 30*b* on the profile 32 of the rotary cam member 26.

In FIG. 29, the pivotal magazines 10 are each docked to a respective docking or refill block 70. Each refill block 70 is permanently connected to a bulk feeder device via three flexible refill tubes 71. Each tube exclusively serves one of the independent magazine tracks 11 that run through the magazine 10. Note that this could be a permanent arrangement for supplying rivets from a bulk feeder to the magazines 10 while they are mounted on the setting tool 2. Alternatively, the refill block 70 could be releasable (refer to FIG. 30) and could be docked to any magazines when required. For example, one of the magazines 10 could be supported on a support structure 41 as shown in FIGS. 30-31. Further, the magazines shown in FIGS. 30-31 could be supported on the corresponding support structures 41 by means of a patterned magnet mounted on the magazine's back face or on the support structure 41. This requires the other of said parts 10, 41 to be made of a ferromagnetic material. Alternatively, the magazines and the support structures 41 could be supported via correlated-magnets surfaces exactly as discussed in connection with FIGS. 12-17, and reference is made herein to the corresponding parts of the present description.

FIGS. 32-35 show alternative magazines 10 which do not require a chute. Each of these magazines 10 is directly docked to the nose arrangement 4. Each of these magazines thus includes at the outlet thereof a rivet transfer device 14 of the type already described in connection with FIG. 11 (although not visible in FIGS. 32-35).

In FIG. 32, a single magazine arrangement is shown whereby rivets would be supplied to the rivet setting tool 2 only from the right hand side. To provide adequate support for the arrangement, the bracket 18 that supports the magazine 10 is extended on the left hand side to reach and connect with the nose arrangement 4. This prevents the rivet transfer area on the left hand side of the nose arrangement from being unnecessarily exposed to dust from outside. Further, this arrangement clearly allows the supply system 1 to be symmetrically supported on the setting tool despite the presence of a single magazine 10. It will be understood that the extension of said bracket 18, which effectively acts as a dummy magazine, can at any time be replaced with an actual magazine 10, for example, but not exclusively, with another magazine of the same type. This brings us to the configuration shown in FIG. 33.

In FIG. 33, a dual-sided arrangement includes two mirrored single-track magazines 10 of the type also represented in FIG. 32. It is to be noted that each magazine is predisposed for, but not equipped with, a rivet handling device in connection with a lateral enlargement of the magazine body 34 located about half way along the extension of the magazine 10. At that location, front and back cover plates 84, 85 can be removed to provide access for the installation of a rivet handling device such as those shown in FIG. 34.

FIG. 34 is a dual-sided arrangement including two mirrored single-track magazines 10*a*, 10*b* each equipped with a linear-pin escapement 21*a*, 21*b* disposed about half-way along the magazine. The linear-pin escapement will be described briefly below.

FIG. 35 is a dual-sided arrangement including two mirrored double-track magazines 10*a*, 10*b*, each equipped with two rivet handling devices 21*aa*, 21*ab*, 21*ba*, 21*bb* in the form of linear-pin escapements 96 (indicated in FIG. 37) disposed on each of upper tracks (similar to those described in connection with FIG. 15) of the magazines 10*a*, 10*b*. Each magazine 10, 10*b* further includes a track selection device 90*a*, 90*b* for selecting from which of the two upper rivet tracks to supply one or more rivets to the nose arrangement 4. In the described magazine, the track selection device 90 is in the form of a rotary track selector 91 and this will be briefly described below.

FIGS. 32-35 also show a number of other features of the magazines 10 described herein which have already been described above. These features will not be described again, but are listed herein for ease of reference to FIGS. 32-35. Each magazine has a lower docking interface 24 at the distal end 20 of the magazine for docking with the nose arrangement 4. Next to the docking interface 24 a vacuum connection 92 which communicates with the rivet delivery track 11 inside the magazine provides a rivet motive force in the magazine 10. Accordingly, the magazines 10 are not required to have a sealing feature at the upper docking interface 12, as would normally be required if positive pressure was used to move the rivets through the rivet supply system 1. The magazines are generally tubular structures comprising a body 34 and a magazine track 11 extending therethrough, from a corresponding magazine inlet 93 to an outlet 94. In the case of the magazines of FIG. 35, the magazine track 11 bifurcates to accommodate two upper magazine portions 60 of the magazine track 11, as shown in FIG. 15 and as will further be described in connection with FIG. 41 below. Accordingly, two inlets 93*aa*, 93*ab* and a single outlet 94*a* are defined in this magazine 10*a*. The upper tracks 60 merge into a lower portion 95 (refer to FIG. 41) of the magazine track 11 where all the rivets delivered by that magazine 10 transit. The magazines 10 may be equipped with one or more rivet handling devices 21 and, where multiple independent upper tracks 60 of the magazine track 11 are present, a track selection device 90.

FIG. 36 shows two magazines 10*a*, 10*b* of the type shown in FIG. 35 mounted in mirror configuration on a setting tool 2 to provide a complete rivet supply system 1 as described herein. The nose arrangement is shown in the retracted configuration in FIG. 36. However, as described above, this can extend toward the nose assembly 6 in preparation for one or more rivet setting operations. The magazines 10*a*, 10*b* are supported so as to be movable with the nose arrangement 4 by means of bracket set 18 (of slightly different mechanical construction than those described above). The magazine's distal ends 20*a*, 20*b* are adapted so as to be guided and slide through corresponding C-shaped brackets 19*a*, 19*b* provided on the C-frame 3, as also shown in FIG. 36. Accordingly, the magazines 10*a*, 10*b* maintain their rivet-supply relation with the nose arrangement 4 without any undue stresses while moving, especially at the lower edge where they dock with the nose arrangement 4. Further, as for the magazines described above, the movement of the nose arrangement 4 can be used to disengage the magazines 10*a*, 10*b* from the setting tool 2, if the magazines 10*aa*, 10*b* are appropriately connected to an attachment point 40 for example provided on an external post 41 as described above. The use of patterned magnets and correlated-magnets surfaces can also be extended to this type of magazines 10*a*, 10*b*, as will be apparent to the skilled person based on the teachings in the present specification.

FIGS. 37A-B show a magazine 10 of the same type shown in FIGS. 35 and 36, and show in more detail some external features of the linear-pin escapements 96. These escapements are essentially constituted by a set of pin barriers mounted on a common plate (refer to FIGS. 43-45). Linear actuation of this common plate provides the required rivet stop, trap and release functions, similar to the functions of the rotary cam escapement 31 described above. FIG. 37B in particular shows two external housings 97 each associated with one linear-pin escapement 96 and respective pneumatic first and second lines 98, 99 to actuate the plate to move in the required directions. This will be described further below in connection with FIGS. 43-45. Alternatively, electrical actuation may be provided, for example employing solenoid-based electrical actuators.

FIGS. 38A-B show a variation of the magazine 10 illustrated in FIGS. 37A-B, with two rotary cam escapements 31 replacing the linear-pin escapements. These escapements 31 are similar to those described above, and therefore reference is made to the corresponding previous passages of the present description. However, it is noted the different manner of actuation which, in the present case, involves pneumatic first and second lines 98, 99 similar to the first and second lines described above. The first pneumatic line causes movement (of the linear pin escapement) or rotation (of the rotary cam escapement) in one way. The second pneumatic line causes movement (of the linear pin escapement) or rotation (of the rotary cam escapement) in the opposite direction. The corresponding housing 97 is similar to that described above in that it is required to provide an appropriate seal to allow the rotary cam escapement 31 to be actuated by the associated first and second pneumatic lines 98, 99. However, as mentioned above, alternatively the actuation may be electrical for example via an electric motor or solenoid-based electrical actuator.

FIGS. 39A-B show a single track magazine 10 in isolation. The magazine 10 is equipped with a single linear-pin escapement 96 acting on the single rivet delivery track 8, 11 all of which extends through the magazine 10 to provide a complete rivet supply system 1 as described herein. The housing 97 and the first and second rivet supply lines 98, 99 are as described above.

FIGS. 40A-B show a further single track magazine 10 in isolation. This magazine 10 is however equipped with a single rotary cam escapement 31 acting on the single rivet delivery track 8, 11, all of which extends through the magazine 10 to provide a complete rivet supply system 1 as describe herein. The housing 97 and the first and second rivet supply lines 98, 99 are also as described above.

FIGS. 41 and 42A-B show in detail the operation of the rotary track selector 91. Rotary track selector 91 includes a rotary member 101 designed to be in selective rivet supply engagement with either of the upper magazine tracks 60. In the example of FIGS. 41 and 42A, the right hand side upper track 60 is selected, while in the example of FIG. 42B the left hand side upper track 60 is selected, for feeding rivets C to the nose arrangement from the one or the other of the upper magazine tracks 60.

Selection of the required upper track 60 is performed by rotating rotary member 101 in one direction, or in the opposite direction, of about 145 degrees, as can be appreciated in particular referring to FIGS. 42A-B. Accordingly, rotary member portion 102 of the magazine track 11 can be put in selective rivet-supply relation between the required upper magazine track 60 and the common, lower portion 95 of the magazine track 11, as also shown in these Figures. It will be appreciated that in the configuration of FIG. 42A, a first end 103 of the curved track portion 102 that passes through the rotary member 101 is in rivet-supply communication with the right hand side upper magazine track 60, and a second end 104 of said curved track portion 102 is in rivet supply communication with the lower magazine track 95. In the configuration of FIG. 42B, the first end 103 of the curved track portion 102 is instead in rivet-supply communication with the lower magazine track 95 while the second end 104 is in rivet supply communication with the left hand side upper magazine track 60.

Actuation of the track selection device 90 is via a pair of dedicated actuation lines 88, 89 as also shown in FIGS. 41 and 42A-B. Thus, by admitting compressed air in a first actuation line 88 the rotary member 101 is rotated in one direction by 145 degrees, and by admitting compressed air in a second actuation line 89 the rotary member 101 is rotated in the other direction by 145 degrees. Although this may not be a preferred feature, it would in principle be possible to arrange the rotary track selector to allow the rotary member 101 to rotate different angles to remove any rivet-supply engagement between the upper tracks 60 and the lower track 95, for example by rotating the rotary member 101 of about 45 degrees instead of 145 degrees anticlockwise starting from the configuration shown in FIG. 42B.

FIG. 41 also shows a pair of sensors 100 for detecting the presence of rivets C' ready for supply to the nose arrangement. The sensors 100 are each integrated within a respective rotary cam mechanisms 31. In the described arrangement, the sensors are each a proximity sensor. However, different sensors can be used including magnetic, optical, eddy currents etc.

FIGS. 43-45 explain the operation of the linear-pin escapement 96. FIG. 43A depicts a single-track magazine 10 (disposed in horizontal configuration for illustration purposes) with one such escapement 96. FIG. 43B is a cross sectional representation through the linear-pin escapement 96 and portions of the magazine 10 shown in FIG. 43A. A lead pin 120 is provided to stop or release rivets D stored in the magazine 10. The lead pin 120 is connected to a plate 121 located inside housing 97, above the magazine track 11, as seen in FIG. 43B. In the configuration of FIG. 43B, three rivets D', D", D'" are queued at the linear-pin escapement 96. Leading rivet D' is ready to be released so that it can then reach, under the action of gravity or suction applied by vacuum connector 92, rivet transfer device 14 located at the lower docking interface 24 of the magazine 10. From there, the rivet D' can transferred under the punch when required, although this is not described herein.

The plate 121 is connected via a rod 122 to a piston actuator 123 disposed within a portion of the housing 97 of the linear-pin escapement 96 located below the magazine 10, as also visible in FIG. 43B. The piston actuator 123 is displaced up or down as required by compressed air supplied via the first and second pneumatic lines 98, 99 to displace the plate 121 within a sealed chamber 126 in the housing 97. This predisposes the magazine 10 (which is equipped with a linear-pin escapement 96) for positive or negative pressure transportation of the rivets D, if required, so that any rivet motive air supplied through the magazine track 11 is not leaked through the linear pin escapement 96. This can be achieved relatively easily in the described arrangement by sealing the chamber 126 around perimeter interface 127 against an outer surface of the magazine. Other sealing configurations, however, may be possible. As the piston actuator 123 is moved, the plate 121 and thus the lead pin 120 are actuated via the connecting rod 122. Note that the actuator 123 may be provided above rather than below the rivet track 11. The described configuration is preferred for reasons of optimum envelope with respect to the space occupied by the magazine 10 on the tool 2.

FIGS. 44A-C and 45A-C provide further details of the operation of the linear-pin escapement 96.

With reference to FIG. 44C, the same arrangement of FIGS. 43A-B is depicted showing three rivets D', D", D'"

queued at the lead pin 120. FIG. 44C also clearly reveals how the depth of the rivet delivery track 8 is greater than the length of the rivets D shown in FIGS. 44A-C. Thus, rivets of different lengths could also be stored on the same magazine 10 and transported on the T-shaped tracks 8 described herein, the rivets D being supported by the T-shaped profile of the rivet delivery tracks 8 around their heads rather than their stems. The presence of the leading rivet D' is sensed by a sensor 100, similar to the sensor described above. When the presence of the leading rivet D' is sensed, at the correct time this can be released for a setting operation.

FIGS. 44A-B reveal the arrangement of a pair of profiled pins 125 comprising pin sections of large diameter 128 and pin sections of narrow diameter 129 disposed upstream with respect to the lead pin 120, and sideways with respect to the magazine track 11. The large diameter pin sections 128 are such that they can stop the rivets D from flowing through the magazine 10. The narrow diameter pin sections 129 are such that they can let the rivets D flow. The two profiled pins 125 are thus arranged such that when the lead pin 120 is in the configuration of FIG. 44C, the trailing rivets D", D"' are free to flow and thus come into contact with the leading rivet D'. In this configuration, therefore, the lead pin 120 stops all the rivets D', D", D"' from flowing. The plate 121 and the actuator 123 are in their lowermost configuration as also shown in FIG. 43B.

When the lead pin 120 is retracted as shown in FIGS. 45A-C, the leading rivet D' is released and under the action of an appropriate motive force (gravity, suction or positive pressure) reaches the rivet transfer device 14 at the lower docking interface 24 of the magazine 10, as discussed above. Retraction of the lead pin is effected by upwards movement of the piston actuator 123, connecting rod 122 and plate 121. This also determines movement of the profiled pins 125 to the configuration best shown in FIG. 45A. The large diameter pin sections 128 are now disposed within the magazine track 11 to effectively restrict passage therethrough for the rivets D. Accordingly the trailing rivets D", D"' are now stopped in the magazine 10, while the leading rivet D' flows to the nose arrangement. Note that, as shown in FIG. 45B, the large sections 128 of the pair of profiled pins 125 interact with the head of the rivet D" rather than with its stem. The plate is actuated to cycle through its lowermost position shown in FIGS. 44A-C and its uppermost position shown in FIGS. 45A-C. After the leading rivet D' has been released, the plate 121 is returned by the piston actuator 123 to its lower most position and the first trailing rivet D" is now in contact with the lead pin 120 to be released next. The trailing rivet D" at this stage moves forwards just the short distance that separates the lead pin 120 and the pair of profiled pins 125 as the narrow sections 129 are moved to occupy the position just next to the magazine track 11. The rivets D are thus cycled through the various configurations of the liner-pin escapement with minimum 'slicing' force imparted on them by the linear-pin escapement 96. In particular, in the configuration of FIGS. 45A-C the trailing rivet D" is gently held by the action of the profiled pins 125 on opposed sides of the rivet's head, as best seen from FIG. 45A. In the configuration of FIGS. 44A-C, the trailing rivet D" is held in its position solely by the lead pin 120, thus excluding any further catch points. The magazine track 11 is minimally affected by the presence of the linear-pin escapement and the flow of the rivets D may thus be controlled with minimal invasiveness.

Possible options for the replacement and/or adjustment of the die assembly 6 are described briefly below in connection with FIGS. 46-50. It is noted that the replacement or adjustment of the die assembly 6 may be required pursuant to the replacement of a replaceable magazine 10 with a replacement magazine 10 filled with rivets of a different type, as described herein. These rivets may require a different die geometry and/or die volume. The die assembly may be replaced and/or adjusted manually by an operator considering that such a replacement and/or adjustment may be necessary for the setting operations. Alternatively, the die assembly may be replaced and/or adjusted automatically or semi-automatically in response to one or more signals generated by the controller 1203 described herein. The controller 1203 may thus be configured to issue one or more signals for replacing and/or adjusting the die assembly 6 based in response to information identifying the magazine 10 and, hence, the type and/or size of rivets stored therein and thus now available to the setting tool.

In FIG. 46 there is shown a setting tool 2 as described herein with a rivet supply system 1 constituted by two replaceable double-track magazines 10 in mirror configuration. The die assembly 6 provides for an adjustable die volume 135. The die volume 135 is adjusted using an external/independent spanner tool 130. The spanner tool 130 can be engaged to the die assembly 6 via a number of slots 131 formed in the spanner tool 130. Each slot 131 can be coupled to an adjustment head 132 provided on the lower end of the die assembly 6. Relative movement (rotation) of the spanner tool 130 and adjustment head 132 results into a die volume change. How this is achieved is the object of FIGS. 49A-C described below. The C-frame can be mounted on a robotic arm (not shown) for this purpose. Alternatively, the spanner tool may be mounted on a robot (not shown).

A method of ensuring that the correct die volume has been set may be advisable. This might be achieved by a combination of mechanical registration and/or software control. Thus for example only one of the multiple slots 131 of the spanner tool 130 may at any one time register together with the adjustment end 132 provided on the die assembly 6. The software may then determine the next required die volume 135 for the riveting process. The angular position of the adjustment end 132 will then need to be adjusted accordingly. When a successive die volume adjustment operation is required, the previous position of engagement between the spanner tool 130 and the adjustment end 132 of the die assembly 6 is recalled by the software from a memory. Alternatively/additionally, the spanner tool 130 could have slots 131 which are each associated with a specific die volume 135. Thus the robotic arm could be used to engage the adjustment end 132 of the die assembly 6 by any of these predetermined slots 131. A predetermined angular rotation could then also be associated to each slot. Therefore, upon engagement of the end 132 with a predetermined slot 131, a predetermined angular rotation would take place to achieve the desired die volume 135.

In FIG. 47, the die volume 135 is changed by changing the die assembly 6. The die assembly 6 is released by an external release mechanism in the form of a release pin 137. This is described further in connection with FIGS. 50A-C.

In FIG. 48, the die volume 135 is changed by operation of an on-board motorised means such as an on-board motorised die adjustment actuator 136.

With reference to FIGS. 49A-C, the die assembly 6 comprises a centre pin 140 located in and guided by a die sleeve 141. The axial position of the centre pin 140 can be adjusted by an adjustment cam mechanism 142 having discrete cam platforms 143 located below the centre pin 140. Each cam platform 143 has a different height with respect to the die assembly 6. Each cam platform 143 corresponds to a predetermined axial location of the centre pin 140 and, thus, to a predetermined die volume 135.

When switching active cam platforms 143, the centre pin 140 may have to be retained in the position corresponding to its minimum die volume 135 to allow the adjustment cam mechanism 142 to be rotated.

With reference to FIGS. 50A-C, the die assembly 6 includes a die sleeve 141 similar to that shown in FIGS. 49A-C. Different die volumes 135 are associated to different dies 153 with semi-hollow construction as shown in FIGS. 49B-C. The die 153 is retained in place on the die assembly 6 by the action of two C-shaped split collets 150 which exert a transversal force on an inner cavity 154 of the die 153, also shown in FIGS. 49B-C. The C-shaped split collets are urged outwardly by a tapered end 152 of a central mandrel 151 that extends through said sleeve 141. The mandrel 151 and its tapered end 152 are pulled downwards by the action of a resiliently biased sphere 158 that acts on an inclined surface 159 formed on a protruding pin 157 that is at one end coupled to said mandrel 151, and at the other end protruding from the die assembly 6, as also shown in FIGS. 50B-C.

To replace the die 153, the protruding pin 157 is pushed upwardly by release pin 137 against the downwards force exerted on it by the resiliently biased sphere 158. This in turn releases the split collets 150 so that the die 153 is no longer gripped to die sleeve 141. The die 153 can be replaced with another die with different die volume 135 bay external means, including by manual intervention of an operator.

The invention thus provides a simple yet flexible magazine-based rivet supply system that can seamlessly handle self-piercing rivets of different shapes and sizes.

Any requirement for portions of flexible tubes within the rivet supply systems is reduced or eliminated.

The rivets are stored in magazines which are conveniently located at all times close to the nose of the setting tool.

Further, the magazines incorporate multiple rivet handling features which maximise control of the flow of the rivets through the supply system.

While the magazines described herein are preferably used with gravity or vacuum as the rivet motive force, these can also easily be adapted to accept compressed air, as it will be apparent to the skilled person.

The magazines can also be easily replaced and/or refilled, and these operations can further be conveniently carried out automatically by the robotic arm without the need for external intervention.

Further, the accuracy requirements relating to the robotic arm are advantageously reduced.

Further, it is possible, upon identification of a joint to be created, to call up a desired rivet type from one of the magazines docked on the setting tool, or from one or more replacement magazines, and, based on that selection, change or reconfigure the die assembly accordingly.

If a replacement magazine is required, the tool can prevent or signal inadvertent docking of an incorrect replacement magazine, and/or confirm that a correct replacement magazine that stores the intended rivets in terms of their type and/or size has been successfully selected and docked on the tool.

The invention has been described above purely by way of example. Protection is sought within the scope of the appended claims.

The invention claimed is:

1. A rivet supply system for supplying rivets to a rivet setting tool comprising a punch for setting the rivets, a nose arrangement defining at least one rivet-receiving zone for receiving the rivets in preparation for setting operations, and a die provided opposite the nose arrangement for reacting the punch, the nose arrangement being movable towards the die to engage with a workpiece, the rivet supply system comprising:

at least one rivet delivery track for delivering the rivets to the rivet-receiving zone;

at least one rivet transfer device for holding, and subsequently releasing, the rivets received at the rivet-receiving zone;

at least one refillable magazine for storing the rivets in proximity of the setting tool, the magazine comprising at least a magazine portion of said rivet delivery track, wherein the rivets can be stored within the magazine, or can transit through the magazine, the magazine comprising at least one docking interface for docking the magazine to a bulk-supply apparatus for refilling the magazine, wherein the magazine is in rivet-supply relation with the nose arrangement and is supported so as to be moveable together with the nose arrangement; and, wherein a substantially undeformable rivet delivery track length extends to said rivet-receiving zone, at least a portion of the substantially undeformable rivet delivery track length that adjoins the rivet-receiving zone being enclosed.

2. The rivet supply system of claim 1, wherein the rivet supply system is adapted to be operated by gravity;

and/or is adapted to be operated by suction generated by a vacuum pump;

wherein the docking interface comprises an inlet for receiving the rivets which is fluidly open to atmosphere;

and/or wherein the magazine is removably supported on the setting tool and/or on a C-frame that supports the setting tool;

optionally, wherein the magazine is replaceably supported such that a replacement magazine can replace said replaceable magazine;

alternatively, wherein the magazine is permanently installed on the setting tool;

and/or wherein the system comprises two such magazines and two such undeformable lengths disposed in mirror configuration on opposed sides of the setting tool.

3. The rivet supply system of claim 1, wherein each magazine comprises a first elongated body part extending generally parallel to an axial direction defined by the punch and/or the setting tool;

optionally, wherein each magazine comprises a second elongated body part disposed downstream of the first elongated body part and angled towards said nose arrangement;

optionally, wherein said first and/or second elongated body parts comprise at least a portion of said undeformable rivet delivery track length.

4. The rivet supply system of claim 1, wherein the rivet supply system further comprises a chute, the chute comprising a chute portion of the rivet delivery track which comprises at least part of said substantially undeformable rivet delivery track length, wherein the magazine is in rivet-supply relation with the nose arrangement via said chute;

optionally, wherein the magazine is directly coupled to the chute;

alternatively, wherein the magazine and the chute are coupled via a flexible feed tube.

5. The rivet supply system of claim 4, wherein the magazine is pivotally supported on the setting tool.

6. The rivet supply system of claim 5, wherein the magazine comprises multiple independent magazine portions of the rivet delivery track, said multiple rivet delivery track portions being selectable for supplying the rivets to the rivet-receiving zone according to corresponding angular orientations of the magazine on the setting tool;

optionally, wherein at least one of said multiple rivet delivery track portions has a curved longitudinal extension to facilitate the refilling of the rivets into the magazine and/or the supply of the rivets from the magazine to rivet receiving zone in the nose arrangement;

optionally, wherein at least two of said multiple rivet delivery track portions are provided with said curved longitudinal extension, and the respective curves define opposed concavities that tend to converge towards a pivot of the magazine;

optionally, wherein said pivot is generally located at a centre of the magazine;

optionally, wherein the magazine comprises three of said multiple rivet delivery track portions, wherein said three portions comprise a first straight portion extending substantially longitudinally, and the second and third portions have said curved longitudinal extensions and are disposed on either side of the first portion.

7. The rivet supply system of claim 6, wherein the magazine comprises two or more rivet handling devices each associated with one of said multiple magazine rivet delivery track portions for selectively stopping, trapping and/or releasing one or more rivets on the respective magazine portion of the rivet delivery track;

optionally, wherein said rivet handling devices are disposed at a distal end of the magazine;

optionally, wherein said rivet handling devices are each in the form of an actuated in-line rivet selection device;

optionally, wherein said actuated in-line rivet selection device comprises a rotary cam escapement for selectively stopping, trapping and/or releasing one or more rivets on the respective magazine portion of the rivet delivery track based on a rotation angle of the rotary cam escapement;

optionally, wherein said rotary cam escapement comprises a rotatable cam member for selectively stopping, trapping and/or releasing one or more rivets on said respective magazine portion of the rivet delivery track based on a rotation angle of said rotatable cam member;

optionally, wherein said rotatable cam member comprises an arcuate cam;

optionally, wherein the actuated in-line rivet selection devices are each resiliently biased to a default configuration, which is optionally a default rotary configuration of the rotary cam escapement and/or of the rotatable cam member, for stopping and/or trapping the rivets on said respective magazine portion of the rivet delivery track;

and/or wherein each rivet handling device is generally disposed at a distal end of the magazine and is configured to be actuated via an actuated pin mechanism disposed on said chute and received on corresponding one or more apertures also provided at the distal end of the magazine, wherein the actuated pin mechanism is configured to register the magazine in place according to a predetermined angular orientation, and to actuate the rivet handing device.

8. The rivet supply system of claim 1, wherein the magazine comprises at least one rivet handling device associated with the magazine portion of the rivet delivery track for selectively stopping, trapping and/or releasing one or more rivets;

optionally, wherein said one or more rivets are stopped, trapped and/or released on said rivet delivery track portion;

optionally, wherein said rivet handling device is located at a distal end of the magazine;

optionally, wherein said rivet handling device is in the form of an active in-line rivet selection device;

optionally, wherein said active in-line rivet selection device comprises a rotary cam escapement for selectively stopping, trapping and/or releasing one or more rivets on said portion based on a rotation angle of the rotary cam escapement;

optionally, wherein said rotary cam escapement comprises a rotatable cam member for selectively stopping, trapping and/or releasing one or more rivets on said portion based on a rotation angle of said rotatable arcuate member;

optionally, wherein said rotary cam member comprises an arcuate cam;

optionally, wherein the active in-line rivet selection device is resiliently biased to a default configuration, which is optionally a default rotary configuration of the rotary cam escapement and/or of the rotatable cam member and/or of the arcuate cam, for stopping and/or trapping one or more rivets; and optionally, wherein the rivet supply system further comprises a chute, the chute comprising a chute portion of the rivet delivery track which comprises at least part of said substantially undeformable rivet delivery track length, wherein the magazine is in rivet-supply relation with the nose arrangement via said chute, wherein the rivet handling device is generally disposed at a distal end of the magazine and is configured to be actuated via an actuated pin mechanism disposed on said chute and received on a corresponding aperture also provided at the distal end of the magazine, wherein the actuated pin mechanism is configured to register the magazine in place, and to actuate the rivet handing device.

9. The rivet supply system of claim 8, wherein said rivet handling device is disposed between a first end and a second end of the magazine portion of the rivet delivery track;

and/or wherein the system comprises two or more independent magazine portions of the rivet delivery track, two or more independent rivet handling devices being associated one with each of said two or more magazine portions of the rivet delivery track for selectively stopping, trapping and/or releasing one or more rivets;

optionally, wherein said one or more rivets are stopped, trapped and/or released on said portions;

optionally, wherein said two or more independent magazine portions of the rivet delivery tracks are upper magazine portions configured to supply rivets to a common lower segment of the rivet delivery track;

optionally, wherein at least part of said common lower segment of the rivet delivery track is disposed within the magazine;

optionally, wherein the magazine comprises an actuated track selection device for selecting one of said two or more independent upper magazine portions of the rivet delivery tracks for supplying the rivets to said common lower segment of the rivet delivery track.

10. The rivet supply system of claim 1, wherein the magazine comprises a docking device disposed at the docking interface for permitting or inhibiting refilling of the rivets into the magazine from the bulk-supply apparatus;

optionally, wherein the docking device is a passive in-line rivet release device adapted to permit said refilling when the magazine is docked to the bulk-supply apparatus, and adapted to inhibit flow of refilled rivets out of the magazine when the magazine is undocked from the bulk-supply apparatus;

optionally, wherein the passive in-line release device comprises at least one resiliently biased jaw member disposed on a side of the magazine portion of the rivet delivery track;

optionally, wherein the release device is disposed at a proximal end of the rivet delivery track and/or at a proximal end of the magazine;

optionally, wherein the passive in-line release device comprises a pair of opposed resiliently biased jaw members disposed on opposed sides of the magazine portion of the rivet delivery track at a proximal end of the rivet delivery track and/or of the magazine;

and/or, wherein the system further comprises a docking block comprising one or more delivery tubes for connecting the magazine to the bulk-supply apparatus, wherein said docking block is adapted to dock with said magazine via said docking interface;

optionally, wherein said delivery tubes are flexible;

alternatively, wherein said delivery tubes are rigid or semi-rigid.

11. The rivet supply system of claim 1, wherein the rivet transfer device is a passive in-line rivet release device adapted to hold, and subsequently release, the rivet at the rivet-transfer zone;

optionally, wherein the rivet release device comprises at least one resiliently biased jaw member disposed on a side of the rivet delivery track at a distal end of the rivet delivery track;

optionally, wherein the rivet release device comprises a pair of opposed resiliently biased jaw members disposed on opposing sides of the rivet delivery track at the distal end of the rivet delivery track;

alternatively, wherein the rivet transfer device is in the form of an active in-line rivet selection device configured to selectively stop, trap and/or release one or more rivets at the rivet transfer zone;

optionally, wherein said rivet selection device comprises a linear-pin escapement.

12. A machine for setting rivets comprising:

a rivet supply system for supplying rivets to a rivet setting tool including a punch for setting the rivets, a nose arrangement defining at least one rivet-receiving zone for receiving the rivets in preparation for setting operations, and a die provided opposite the nose arrangement for reacting the punch, the nose arrangement being movable towards the die to engage with a workpiece, the rivet supply system comprising: at least one rivet delivery track for delivering the rivets to the rivet-receiving zone;

at least one rivet transfer device for holding, and subsequently releasing, the rivets received at the rivet-receiving zone;

at least one refillable magazine for storing the rivets in proximity of the setting tool, the magazine comprising at least a magazine portion of said rivet delivery track, wherein the rivets can be stored within the magazine, or can transit through the magazine, the magazine comprising at least one docking interface for docking the magazine to a bulk-supply apparatus for refilling the magazine, wherein the magazine is in rivet-supply relation with the nose arrangement and is supported so as to be moveable together with the nose arrangement; and, wherein a substantially undeformable rivet delivery track length extends to said rivet-receiving zone, the substantially undeformable rivet delivery track length being enclosed, and at least a portion of the substantially undeformable rivet delivery track length that adjoins the rivet-receiving zone is enclosed.

13. A method of supplying rivets to a rivet setting tool having a punch for setting the rivets, a nose arrangement defining at least one rivet-receiving zone for receiving the rivets in preparation for setting operations, and a die provided opposite the nose arrangement for reacting to the punch, the nose arrangement being movable towards the die to engage with a workpiece, the method comprising:

feeding at least one rivet through at least one rivet delivery track for delivering the rivet to the rivet-receiving zone;

holding and/or releasing the rivet at the rivet-receiving zone by means of using at least one rivet transfer device;

storing and/or transiting the rivet in a refillable rivet magazine in proximity of the setting tool, the magazine comprising at least a magazine portion of said rivet delivery track, the magazine comprising at least one docking interface for docking the magazine to a bulk-supply apparatus for refilling the magazine, wherein the magazine is in rivet-supply relation with the nose arrangement and is supported so as to be moveable together with the nose arrangement;

wherein a substantially undeformable rivet delivery track length extends to the rivet-receiving zone, at least a portion of the substantially undeformable rivet delivery track length that adjoins the rivet-receiving zone being enclosed.

14. A method of manufacturing a vehicle or a part thereof by setting one or more rivets, wherein said method comprises the method of claim 13.

* * * * *